US010602251B2

(12) United States Patent
Ivey

(10) Patent No.: US 10,602,251 B2
(45) **Date of Patent: *Mar. 24, 2020**

(54) COVERED PLASTIC ACOUSTIC ENCLOSURE

(71) Applicant: Mitek Corp., Inc., Phoenix, AZ (US)

(72) Inventor: Johnathan Ivey, Chandler, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/803,816

(22) Filed: Nov. 5, 2017

(65) Prior Publication Data

US 2018/0124486 A1 May 3, 2018

Related U.S. Application Data

(63) Continuation-in-part of application No. 15/337,950, filed on Oct. 28, 2016.

(51) Int. Cl.
*H04R 1/02* (2006.01)
*H04R 1/28* (2006.01)

(52) U.S. Cl.
CPC ..... *H04R 1/026* (2013.01); *H04R 1/025* (2013.01); *H04R 1/021* (2013.01); *H04R 1/288* (2013.01); *H04R 2201/028* (2013.01)

(58) Field of Classification Search
CPC ... H04R 1/026; H04R 1/288; H04R 2201/028
USPC ..... 381/332
See application file for complete search history.

(56) References Cited

U.S. PATENT DOCUMENTS 3,366,748 A * 1/1968 Ashworth ..... H04R 17/00 181/144
3,848,696 A * 11/1974 Everitt ..... H04R 1/021 181/156
4,063,614 A * 12/1977 Iven ..... H04R 1/021 181/152
4,122,911 A 10/1978 Croup
4,146,745 A 3/1979 Froeschle et al.
4,227,051 A * 10/1980 Thomas ..... H04R 1/24 181/144
4,319,098 A * 3/1982 Baitcher ..... H04R 7/20 181/166
5,661,271 A 8/1997 Moser
(Continued)

*Primary Examiner* — Quynh H Nguyen
(74) *Attorney, Agent, or Firm* — Keith L. Jenkins, Registered Patent Attorney, LLC; Keith L. Jenkins

(57) ABSTRACT

A corrugated plastic sheet with an acoustically effective material with fold lines as centerlines of V-shaped grooves between panels that can be folded by hand into a covered plastic acoustic enclosure, with or without additional corrugated plastic panels. The sheet has a speaker opening and a speaker support fixture, ring, or panel may assist in supporting the speaker on the enclosure. Foldable flanges and foldable narrow panels with adhesive strips, preferably with release layers, enable assembly of the covered enclosure without tools, other than for speaker installation. An amplifier attached to a panel of the enclosure, preferably on an external surface, is presented. An enclosure that supports more than one speaker is presented. The plastic acoustic enclosure can be shipped flat and unassembled and then assembled by a user. The enclosure is lightweight, and so ships economically and does not significantly burden automobiles in which such enclosures may be installed.

18 Claims, 31 Drawing Sheets

(56) References Cited

U.S. PATENT DOCUMENTS

| | | | | |
|---|---|---|---|---|
| 5,704,578 | A * | 1/1998 | Fischer | F16C 11/106 248/221.11 |
| 5,828,766 | A * | 10/1998 | Gallo | H04R 17/00 381/190 |
| 9,084,047 | B2 | 7/2015 | O'Polka | |
| 2004/0125974 | A1* | 7/2004 | Kosatos | H04R 1/025 381/335 |
| 2005/0018868 | A1 | 1/2005 | Chick et al. | |
| 2006/0165248 | A1* | 7/2006 | Butcher | H04R 1/021 381/345 |
| 2008/0000714 | A1* | 1/2008 | Adams | H04R 1/025 181/148 |

* cited by examiner

2900

COVERED PLASTIC ACOUSTIC ENCLOSURE

RELATIONSHIP TO OTHER APPLICATIONS

This application is a continuation in part of U.S. patent application Ser. No. 15/337,950 filed Oct. 28, 2016 to the same inventor.

FIELD OF ART

The present invention relates to lightweight enclosures for loudspeakers. The present invention more particularly relates to corrugated plastic loudspeaker enclosures having coverings, which enclosures may be shipped in a flat configuration and folded to final shape by a recipient. Alternatively, they may be sold assembled with speakers attached.

BACKGROUND OF THE INVENTION

Loudspeaker enclosures are traditionally made of wood, which is heavy, sand supports a limited variety of coverings. Accordingly, a lightweight speaker enclosure is desired. In addition, a speaker enclosure made of a material that can support a wide variety of coverings is desired.

SUMMARY OF THE INVENTION

A covered corrugated plastic sheet with fold lines, as centerlines of V-shaped, grooves that can be folded by hand into a covered plastic acoustic enclosure with or without additional corrugated plastic panels. A speaker opening is provided in the sheet, and a speaker support fixture, ring, or panel may assist in supporting the speaker on the enclosure. Foldable flanges and foldable narrow panels with adhesive strips, preferably with release layers, enable assembly of the covered enclosure without tools, other than for speaker installation. An amplifier attached to a panel of the enclosure, preferably on an external surface, is presented. An enclosure that supports more than one speaker is presented. The plastic acoustic enclosure can be shipped flat and unassembled and then assembled by a user. The enclosure is lightweight, and so ships economically and does not significantly burden automobiles in which such enclosures may be installed.

An embodiment includes a covered plastic acoustic enclosure, including: a sheet of foldable corrugated plastic having: a first side that will be an exterior side when the sheet is folded; and a second side that will be an interior side when the sheet is folded; a plurality of panels; a plurality of fold lines delineating the plurality of panels; an acoustically effective covering attached on at least a portion of the first side, where the covering is not corrugated plastic; and at least one of: an opening in the sheet of corrugated plastic; and a speaker support shaped to correspond to the opening. That covered plastic acoustic enclosure, including an additional panel of corrugated plastic configured to become part of the covered plastic acoustic enclosure upon assembly. That covered plastic acoustic enclosure, where each fold line of the plurality of fold lines includes a centerline of a V-shaped groove in the additional panel of corrugated plastic. That covered plastic acoustic enclosure, including an audio amplifier attached to either the sheet of corrugated plastic or a panel of the additional panel of corrugated plastic. That covered plastic acoustic enclosure, including a foldable flange extending from the additional panel of corrugated plastic. That covered plastic acoustic enclosure, including at least one adhesive positioned to secure the sheet of corrugated plastic in a folded configuration. That covered plastic acoustic enclosure, where each fold line of the plurality of fold lines includes a centerline of a V-shaped groove in the second side of the sheet of corrugated plastic. That covered plastic acoustic enclosure, including acoustic dampening material applied to at least one of: the V-shaped groove; a portion of the sheet of corrugated plastic; and a channel in the sheet of corrugated plastic. That covered plastic acoustic enclosure, where the speaker support supports the speaker at least partially within the plastic acoustic enclosure, when assembled. That covered plastic acoustic enclosure, including a rim on the at least one speaker support, where at least a portion of the rim is configured to rest on an environmental surface when the plastic acoustic enclosure is assembled and placed in an operational orientation. That covered plastic acoustic enclosure, including a plurality of adhesive applications adapted to adhere the speaker support to the sheet of corrugated plastic. That covered plastic acoustic enclosure, including: two covered corrugated plastic side panels; and where the speaker support includes: a speaker support panel having a speaker opening; and a rim extending from one edge of the speaker support panel. That covered plastic acoustic enclosure, including: a corrugated plastic interior support; and where the speaker support includes a speaker support ring. That covered plastic acoustic enclosure, including: top and bottom panels extending from a front panel, the top panel and the bottom panel each having three adhesive foldable flanges, each adhesive foldable flange of the three adhesive foldable flanges extending from one of three edges of the panel, respectively; and where the speaker support includes a speaker support ring. That covered plastic acoustic enclosure, including: a corrugated plastic panel foldable to form a tweeter horn, when assembled; and where the speaker support includes a speaker support panel having a counter sunk annular flange.

An embodiment includes a covered plastic acoustic enclosure, including: a sheet of foldable corrugated plastic having: a first side that will be an exterior side when the sheet is folded; and a second side that will be an interior side when the sheet is folded; a plurality of panels; a plurality of fold lines delineating the plurality of panels; an acoustically effective covering attached on at least a portion of the first side, where the covering is not corrugated plastic; and either an opening in the sheet of corrugated plastic or a speaker support shaped to correspond to the opening; and where each fold line of the plurality of fold lines includes a centerline of a V-shaped groove in the second side of the sheet of corrugated plastic; an adhesive strip adapted to secure the sheet of corrugated plastic in a folded configuration, when assembled; and an adhesive foldable flange extending from the panel of the sheet of foldable corrugated plastic. That covered plastic acoustic enclosure, including: a speaker support supporting a speaker at least partially within the plastic acoustic enclosure, when assembled; a rim on the speaker support, where a portion of the rim is configured to rest on an environmental surface when the covered plastic acoustic enclosure is assembled and placed in an operational orientation; and a plurality of adhesive strips adapted to adhere the speaker support to either the sheet of corrugated plastic or the covering, when assembled. That covered plastic acoustic enclosure, including acoustic dampening material applied to either the V-shaped groove, a portion of the sheet of corrugated plastic, and/or a channel in the sheet of corrugated plastic. That covered plastic acoustic enclosure, including an audio amplifier attached to either the sheet of corrugated plastic, a panel of the additional panel of corrugated plastic, and/or the covering.

An embodiment includes a covered plastic acoustic enclosure, including: a sheet of foldable corrugated plastic having: a first side that will be an exterior side when the sheet is folded; and a second side that will be an interior side when the sheet is folded; a plurality of panels; a plurality of fold lines delineating the plurality of panels; an acoustically effective covering attached on a portion of the first side, where the covering is not corrugated plastic; and an opening in the sheet of corrugated plastic or a speaker support shaped to correspond to the opening and/or where each fold line of the plurality of fold lines includes a centerline of a V-shaped groove in the second side of the sheet of corrugated plastic; an adhesive strip adapted to secure the sheet of corrugated plastic in a folded configuration, when assembled; an adhesive foldable flange extending from the panel of the sheet of foldable corrugated plastic; and further including either: a corrugated plastic side panel adapted to form a part of the plastic acoustic enclosure, when assembled; the speaker support including a speaker support ring adapted to form a part of the plastic acoustic enclosure, when assembled; the speaker support including a speaker support panel adapted to form a part of the plastic acoustic enclosure, when assembled; the speaker support including a speaker support fixture adapted to form a part of the plastic acoustic enclosure, when assembled; a corrugated plastic interior support adapted to form a part of the plastic acoustic enclosure, when assembled; top and bottom panels of the sheet of corrugated plastic, each panel having three adhesive foldable flanges, each adhesive foldable flange of the three adhesive foldable flanges extending from one of three edges of the panel, respectively; an audio amplifier attached to either: a corrugated plastic panel of the at least one corrugated plastic side panel; and the corrugated plastic sheet; and acoustic dampening material applied to the V-shaped groove, a portion of the sheet of corrugated plastic, and/or a channel in the sheet of corrugated plastic; and attachment features on the sheet of corrugated plastic, including: channels; adhesive strips; adhesive strips with release layers; channels with adhesive strips; channels with adhesive strips with release layers; adhesive sound deadening materials; adhesive sound deadening materials with release layers; channels with adhesive sound deadening materials; and/or channels with adhesive sound deadening materials with release layers.

DESCRIPTION OF THE FIGURES OF THE DRAWINGS

The present invention will hereinafter be described in conjunction with the following drawing figures, wherein like numerals denote like elements.

DETAILED DESCRIPTION OF THE INVENTION

As used and defined herein, "left" and "right", "top" and "bottom" are referenced to a viewer's left and right as the viewer looks at the front of the cabinet on which the speaker is mounted and facing. As used and defined herein, "top" and "bottom" are referenced to the cabinet in its normal operational orientation, which may be the top and bottom of the page, or on a side of the page indicating a portion which will be at the top or bottom, respectively, when the cabinet is assembled and placed in its operational orientation. As used and defined herein "fold line" refers to a scribed or grooved line about which a panel bearing such fold line is to be folded during assembly. As used and defined herein, "speaker" means an acoustic driver, or loudspeaker.

Figure 1:
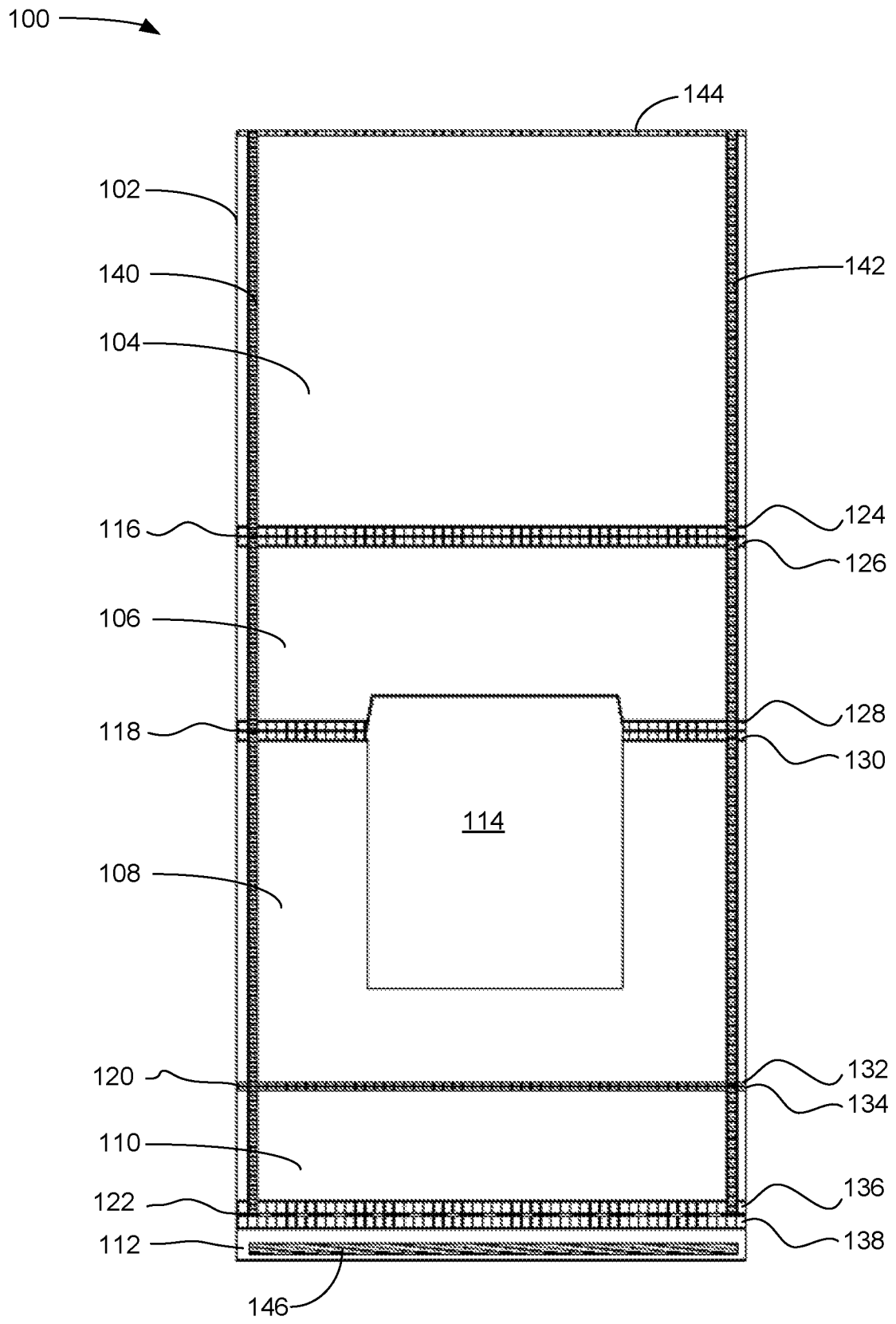
FIG. 1 is an interior side plan view illustrating an exemplary embodiment of a prepared panel for forming an exemplary plastic acoustic enclosure, according to a preferred embodiment of the present invention.

FIG. 1 is an interior side plan view illustrating a prepared cut sheet 102 for forming an exemplary embodiment of the plastic acoustic enclosure 100, according to a preferred embodiment of the present invention. The five-panel main body of plastic acoustic enclosure 100 is made from a single prepared cut sheet 102 of corrugated plastic 702 (see FIG. 7) or similarly lightweight, foldable, and strong material. Corrugated plastic 702 is preferred, as it is strong, lightweight, acoustically compatible with loudspeakers, water resistant, dirt and dust resistant, insect resistant (including termites), can be painted, printed, or produced in various colors, and is readily fastened with adhesives. The single prepared cut sheet 102 of corrugated plastic 702 is divided into a plurality of panels 104, 106, 108, 110 and 112 by fold lines 116, 118, 120, and 122, respectively. Fold line 116 is the centerline of a V-shaped grove having groove sides 124 and 126, which are angled such that, when panel 104 is folded with respect to panel 106, the two panels close the groove sides 124 and 126 together. Fold line 118 is the centerline of a V-shaped grove having groove sides 128 and 130, which are angled such that, when panel 106 is folded with respect to panel 108, the two panels close the groove sides 128 and 130 together. Fold line 120 is the centerline of a V-shaped grove having groove sides 132 and 134, which are angled such that, when panel 108 is folded with respect to panel 110, the two panels 108 and 110 close the groove sides 132 and 134 together. Fold line 122 is the centerline of a V-shaped grove having groove sides 136 and 138, which are angled such that, when panel 110 is folded with respect to panel 112, the two panels 110 and 112 close the groove sides 136 and 138 together. In a various embodiments, a sound deadening material may be applied to any of the groove sides 124, 126, 128, 130, 132, 134, 136, and 138 to avoid plastic-on-plastic vibration noise. In various embodiments, the sound deadening material may be an adhesive sound deadening material. In various embodiments, sound deadening materials may be applied to any portion of the plastic acoustic enclosure 100.

Speaker support opening 114 extends from panel 108 into panel 110, crossing fold line 118. Panel 112 has an adhesive strip 146, preferably with a release layer (not shown), for securing panels 104, 106, 108, 110, and 112 in a folded configuration. Preferably, the adhesive is permanent. In various embodiments, adhesive may be applied my means other than adhesive strip 146, but the present embodiment is preferred. Side panel attachment features 140 and 142 assist in securing side panels 302 and 306 (see FIG. 3). Side panel attachment features 140 and 142 may be channels, adhesive strips with or without release layers, channels with adhesive strips with or without release layers, adhesive sound deadening materials with or without release layers, or channels with adhesive sound deadening materials with or without release layers. Edge 144 is beveled to abut panel 110 at an appropriate angle. The particular embodiment, when folded, has a unique cross sectional shape (see FIG. 11), but the invention is not limited to that shape, nor to any particular number of panels. Single prepared cut sheet 102 may, for various embodiments, be of various thicknesses, as is appropriate for the size of the enclosure. Thicknesses in the range of ⅜ inches to ¾ inches are used in various embodiments.

Figure 2:
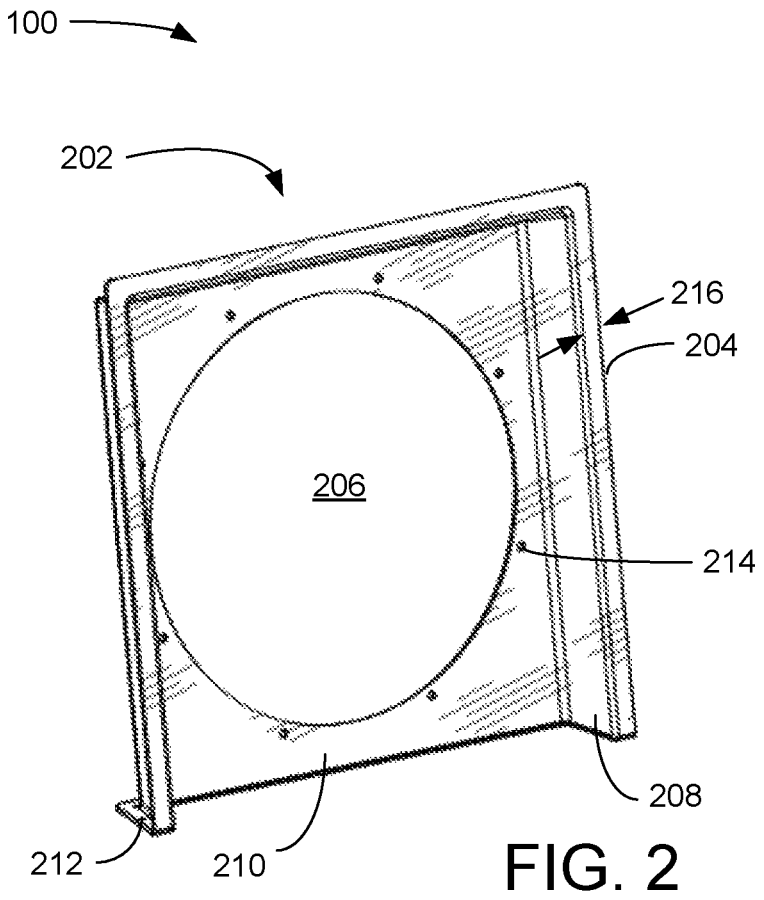
FIG. 2 is a front perspective view illustrating an exemplary embodiment of a speaker support of the exemplary plastic acoustic enclosure of FIG. 1, according to a preferred embodiment of the present invention.

FIG. 2 is a front perspective view illustrating an exemplary embodiment of a speaker support fixture 202 of the exemplary plastic acoustic enclosure 100 of FIG. 1, according to a preferred embodiment of the present invention. Speaker support fixture 202 may be made of any rigid material, such as, without limitation, metal or hard plastic. Speaker support fixture 202 may be made by metal stamping. Speaker support fixture 202 has a generally rectangular panel 210 having a speaker opening 206 and a plurality of fastener openings 214 (one of eight labeled). Walls 208 (one of three labeled) extend obliquely and forward from three sides of rectangular panel 210 and support a rim 204 having width 216, extends obliquely, outwardly, and continuously from walls 208, as shown. On the fourth (bottom) side of rectangular panel 210 a rim 212 extends angularly rearward from rectangular panel 210, with the rim 212 extending around the bottom ends of walls 208 to merge with rim 204. In operation, rim 212 will rest on the floor, shelf, or other environmental surface supporting the plastic acoustic enclosure 100 and so put the weight of the speaker on the speaker support fixture 202, rather than on the corrugated plastic of the plastic acoustic enclosure 100. Other shapes for rectangular panel 210 may be used in various embodiments. However, the present embodiment is preferred for simplicity of design and low cost.

Figure 3:
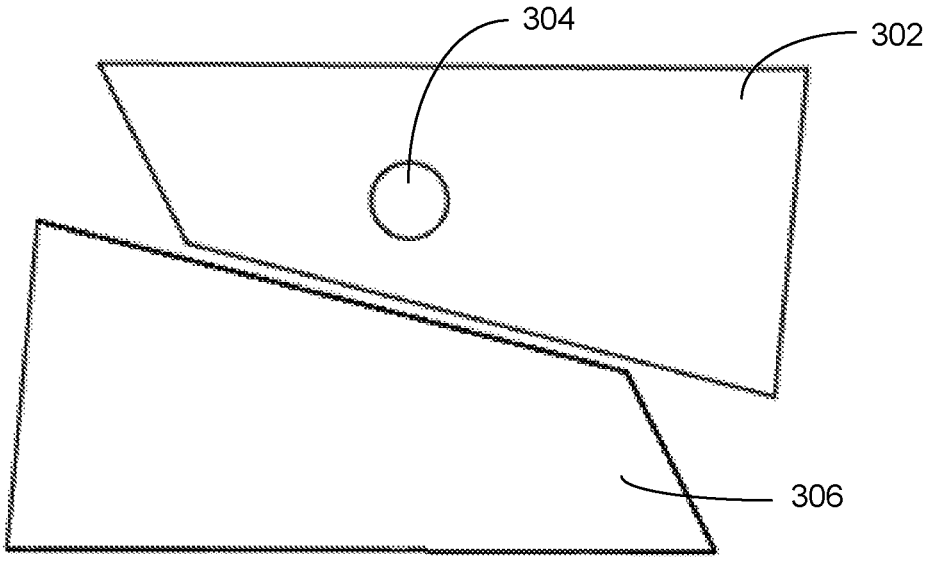
FIG. 3 is a top plan view illustrating an exemplary embodiment of side panels of the exemplary plastic acoustic enclosure of FIG. 1, according to a preferred embodiment of the present invention.

FIG. 3 is a top plan view illustrating an exemplary embodiment of side panels 302 and 306 of the exemplary plastic acoustic enclosure 100 of FIG. 1, according to a preferred embodiment of the present invention. Side panel 302 has an opening 304 for a speaker wiring connector plug 1004 (see FIG. 10). Side panel 306 is a mirror image of side panel 302, but without any openings. Side panels 302 and 306 are preferably made of corrugated plastic 702 (see FIG. 7).

Figure 4:
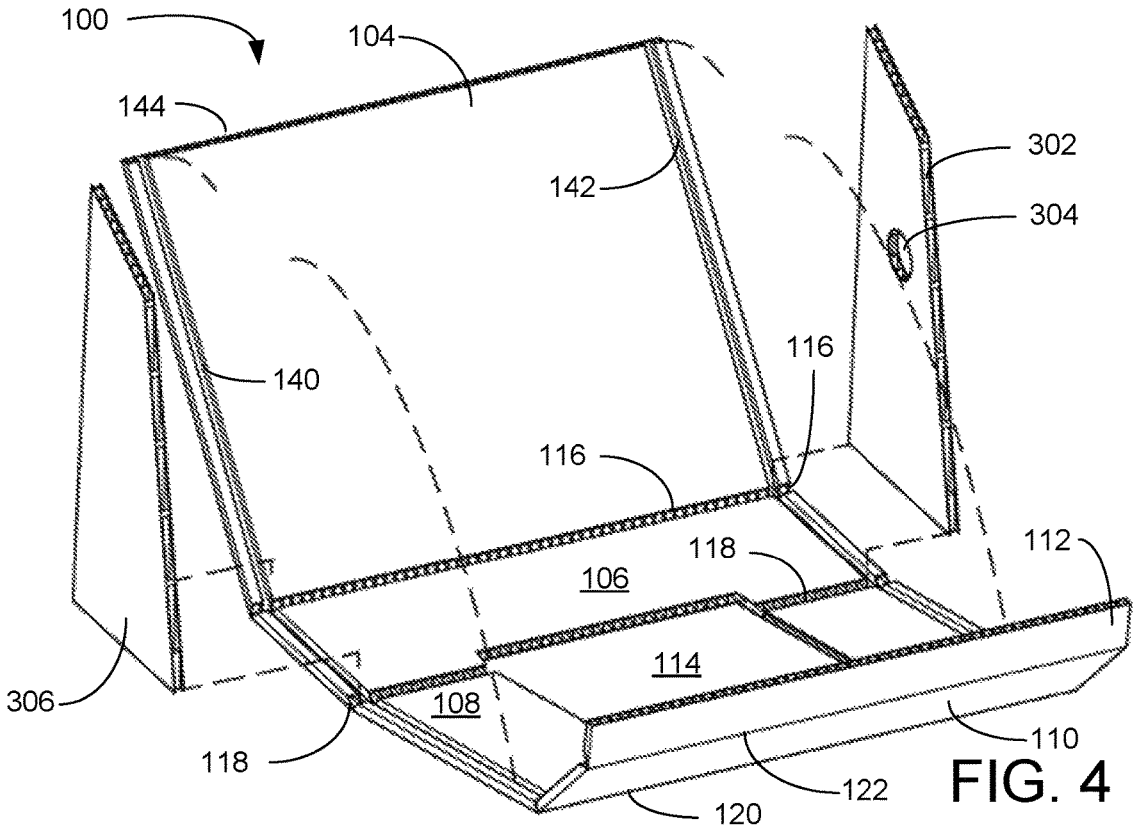
FIG. 4 is a front perspective exploded view illustrating the exemplary embodiment of the plastic acoustic enclosure of FIGS. 1 and 3, according to a preferred embodiment of the present invention.

FIG. 4 is a front perspective exploded view illustrating the exemplary embodiment of the plastic acoustic enclosure 100 of FIGS. 1 and 3, according to a preferred embodiment of the present invention. Panels 104, 110, and 112 are shown partially folded, and the positioning of left side panel 306 and right side panel 302 is shown in this intermediate step of assembly. The relationships of the edges of side panels 302 and 306 with the attachment features 142 and 140, respectively, can be clearly visualized from FIG. 4.

Figure 5:
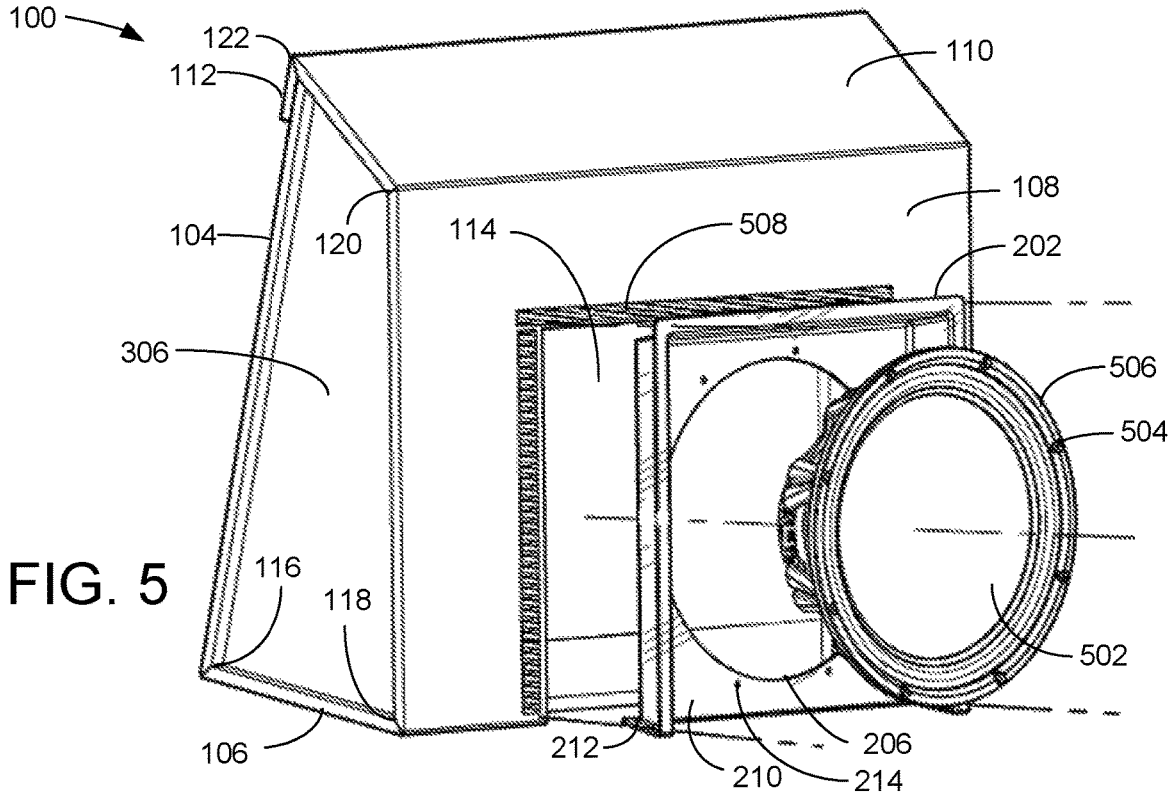
FIG. 5 is a front perspective exploded view illustrating the exemplary embodiment of the plastic acoustic enclosure of FIGS. 1-3, according to a preferred embodiment of the present invention.

FIG. 5 is a front perspective exploded view illustrating the exemplary embodiment of the plastic acoustic enclosure 100 of FIGS. 1-3, according to a preferred embodiment of the present invention. With the five panels 104, 106, 108, 110, and 112 and the side panels 306 and 302 assembled, speaker support fixture 202 and speaker 502 are shown in an intermediate step of assembly. Speaker support opening 114 is surrounded by adhesive strips 508 (one of two visible of four used) with release layers. Adhesive strips 508 adhere to the rear side of rim 204 and the top side of rim 212 when the speaker support fixture 202 is installed. Speaker 502 is then fastened to speaker support fixture 202 using fasteners, such as, without limitation, screws or bolts, through speaker fastener holes 504 in speaker basket rim 506 and through aligned fastener openings 214 in the speaker support fixture 202. In various embodiments, other shapes of speaker 502 and speaker support fixture 202 may be used. For non-limiting example, a square speaker 502 may be used, with adaptive modification of speaker support fixture 202.

Figure 6:
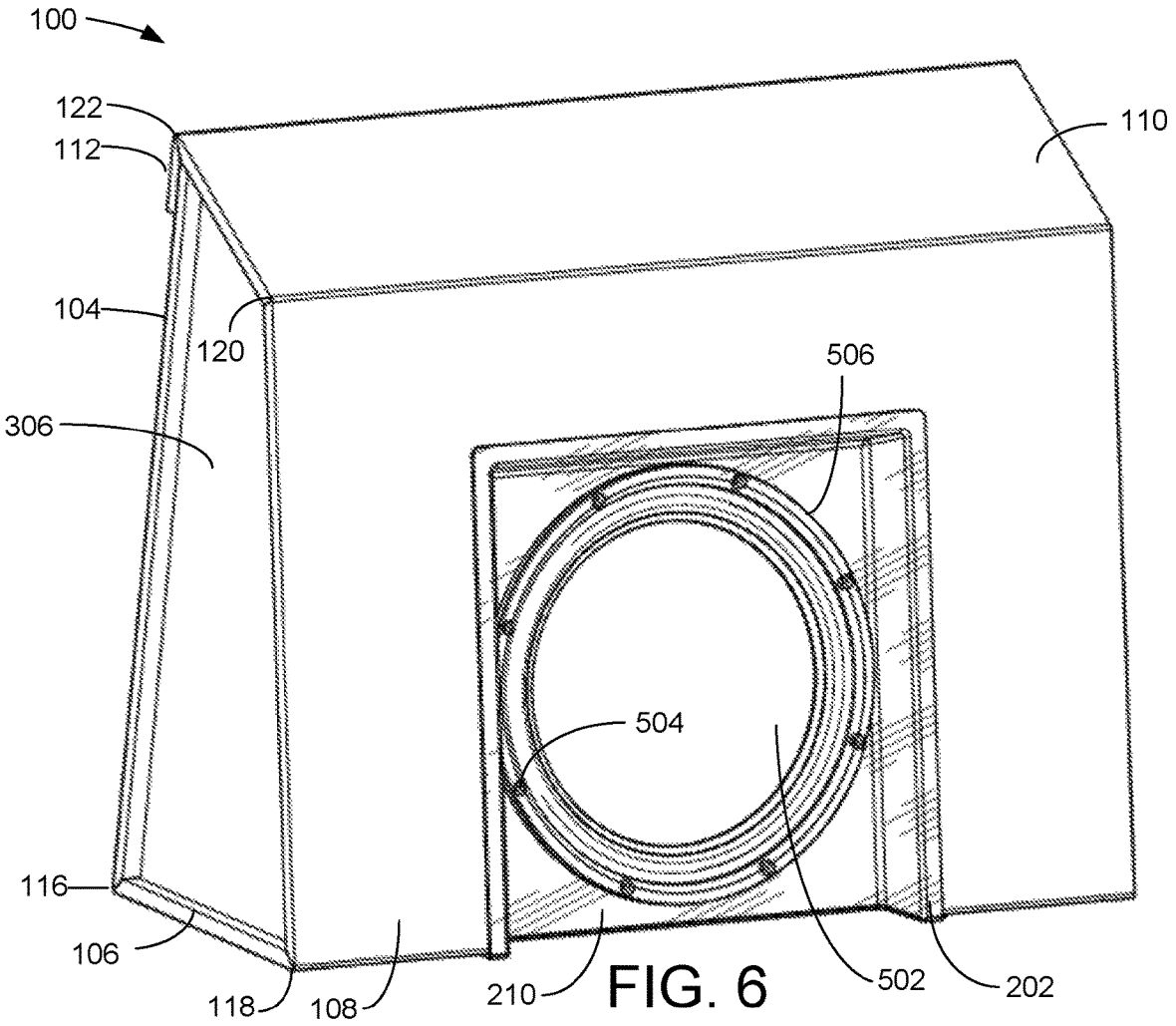
FIG. 6 is a front perspective view illustrating the exemplary embodiment of the plastic acoustic enclosure of FIGS. 1-5, according to a preferred embodiment of the present invention.

FIG. 6 is a front perspective view illustrating the exemplary embodiment of the plastic acoustic enclosure 100 of FIG. 1, according to a preferred embodiment of the present invention. The fully assembled plastic acoustic enclosure 100 is shown. In various embodiments, considerable variation of the shape of the plastic acoustic enclosure 100, such as to fit within a cavity in an automobile, is possible, within the design constraints of using corrugated foldable plastic sheets, folded and secured adhesively, and adapted to support a speaker. All the embodiments 100, 1300, 2300, and 2900 presented herein, and others referred to, may be sold assembled, with speakers attached.

Figure 7:
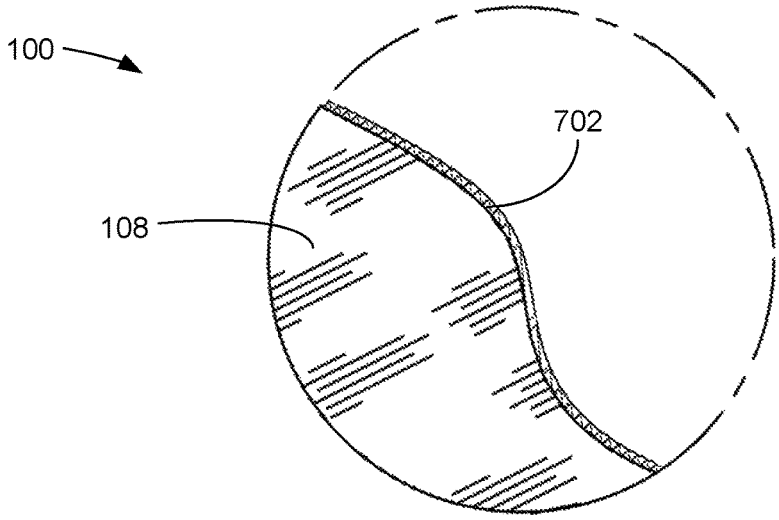
FIG. 7 is a top perspective cutaway view illustrating a detail of the exemplary embodiment of the plastic acoustic enclosure of FIG. 1, according to a preferred embodiment of the present invention.

FIG. 7 is a top perspective cutaway view illustrating a detail of the exemplary embodiment of the plastic acoustic enclosure 100 of FIG. 1, according to a preferred embodiment of the present invention. A cutaway detail of a piece of corrugated plastic 702 panel 108 is shown. Corrugated plastic sheets, such as corrugated plastic prepared cut sheet 102, are commercially available. Plastic acoustic enclosure 100 is merely exemplary, and variations such as positioning of speaker support fixture 202, size and shape of the plastic acoustic enclosure 100, and angular orientation of speaker 502, are within the scope of the present invention.

Figure 8:
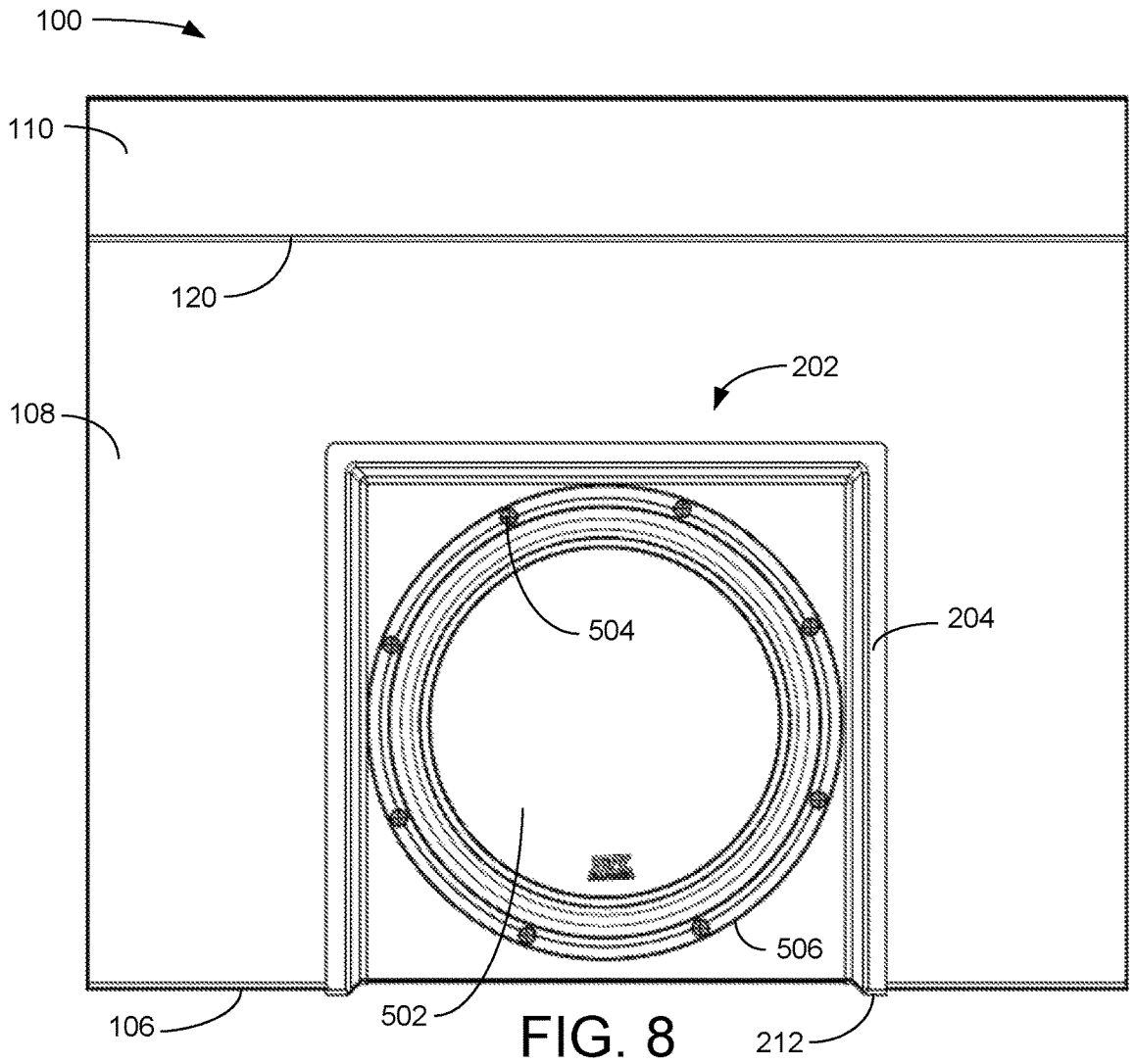
FIG. 8 is a front elevation view illustrating the exemplary embodiment of the plastic acoustic enclosure of FIG. 1, according to a preferred embodiment of the present invention.

FIG. 8 is a front elevation view illustrating the exemplary embodiment of the plastic acoustic enclosure 100 of FIG. 1, according to a preferred embodiment of the present invention. It is clear from FIG. 8 that the weight of speaker 502, attached to speaker support fixture 202, predominately rests on rim 212. Variation in the width of rim 212, adaptive to larger speakers 502 and larger plastic acoustic enclosures 100, are within the scope of the present invention.

Figure 9:
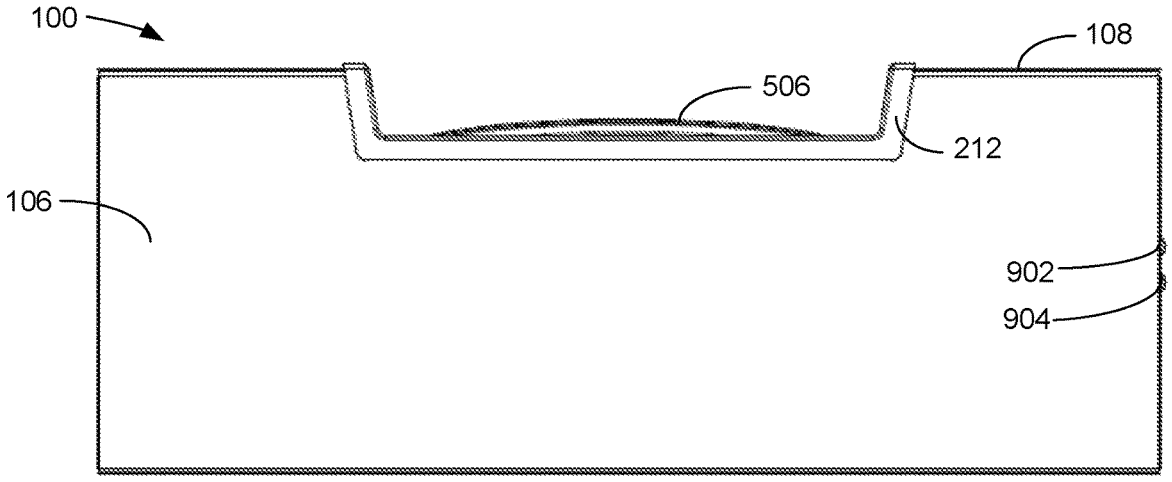
FIG. 9 is a bottom elevation view illustrating the exemplary embodiment of the plastic acoustic enclosure of FIG. 1, according to a preferred embodiment of the present invention.

FIG. 9 is a bottom elevation view illustrating the exemplary embodiment of the plastic acoustic enclosure 100 of FIG. 1, according to a preferred embodiment of the present invention. Rim 212 is fully shown. Speaker wiring connectors 902 and 904 can be seen on the right side.

Figure 10:
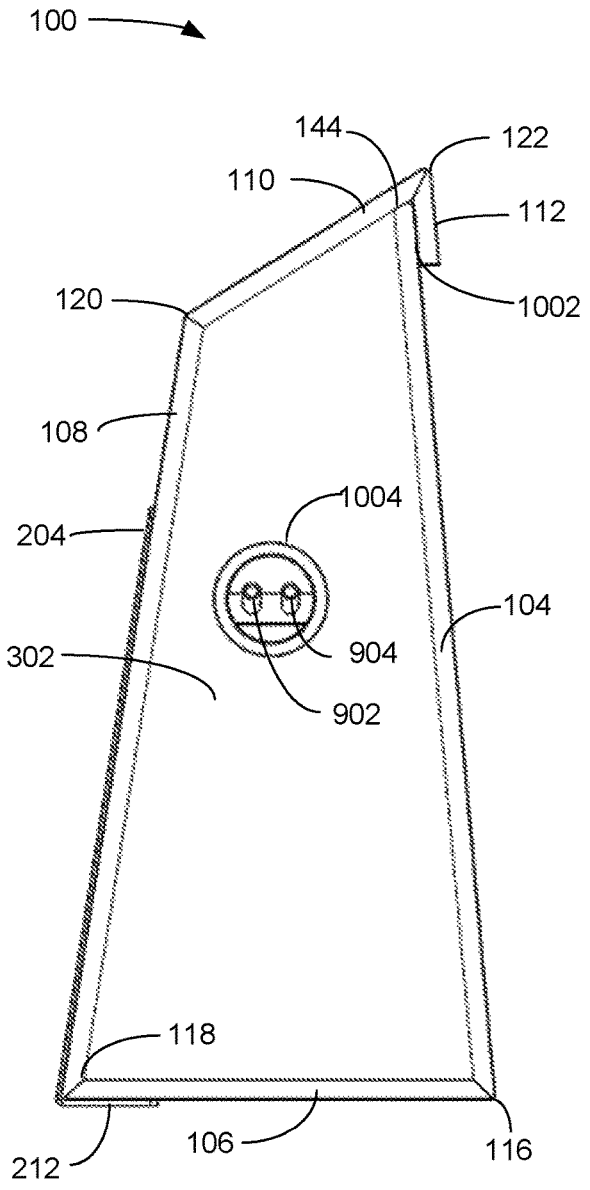
FIG. 10 is a right side elevation view illustrating the exemplary embodiment of the plastic acoustic enclosure of FIG. 1, according to a preferred embodiment of the present invention.

FIG. 10 is a right side elevation view illustrating the exemplary embodiment of the plastic acoustic enclosure 100 of FIG. 1, according to a preferred embodiment of the present invention. Right side panel 302 is shown installed as part of the plastic acoustic enclosure 100, with a speaker wiring connector plug 1004 installed in opening 304 of right side panel 302. Speaker wiring connector plug 1004 supports speaker wiring connectors 902 and 904, which provide external wiring connections from an external audio source to speaker 502. Adhesive bond 1002 of adhesive strip 146 of panel 112 to panel 104 secures side panels 302 and 306 and maintains the plastic acoustic enclosure 100 in its folded assembled configuration.

Figure 11:
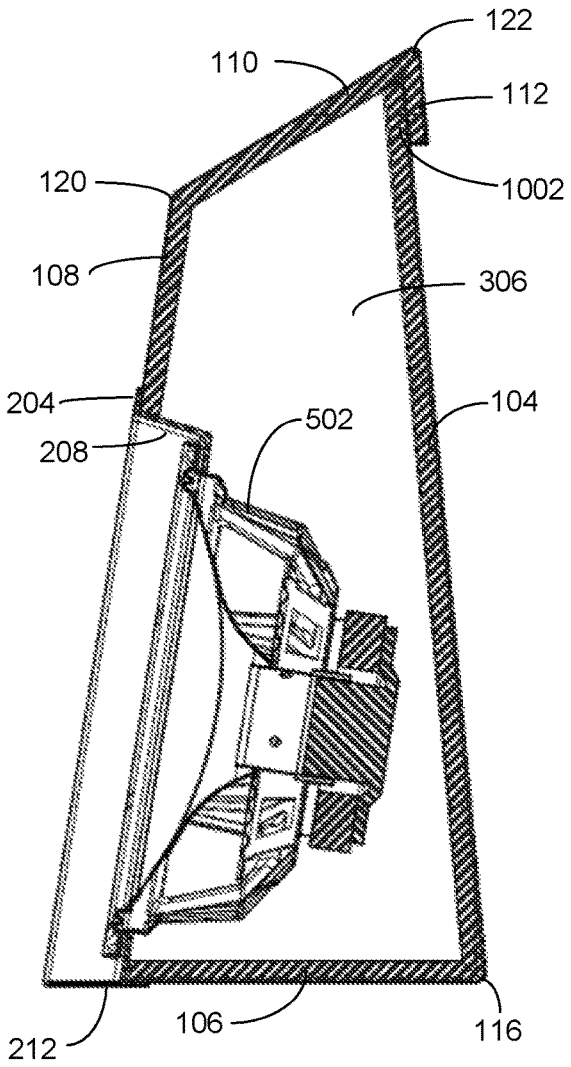
FIG. 11 is a side cross sectional view illustrating the exemplary embodiment of the plastic acoustic enclosure of FIG. 1, according to a preferred embodiment of the present invention.

FIG. 11 is a side cross sectional view illustrating the exemplary embodiment of the plastic acoustic enclosure 100 of FIG. 1, according to a preferred embodiment of the present invention. The relationship of the speaker 502 to the rim 212 can be best visualized in this view. Some torque force from the extent of the speaker 502 rearward of rim 212 will be opposed by panel 106, resting on an environmental support surface.

Figure 12:
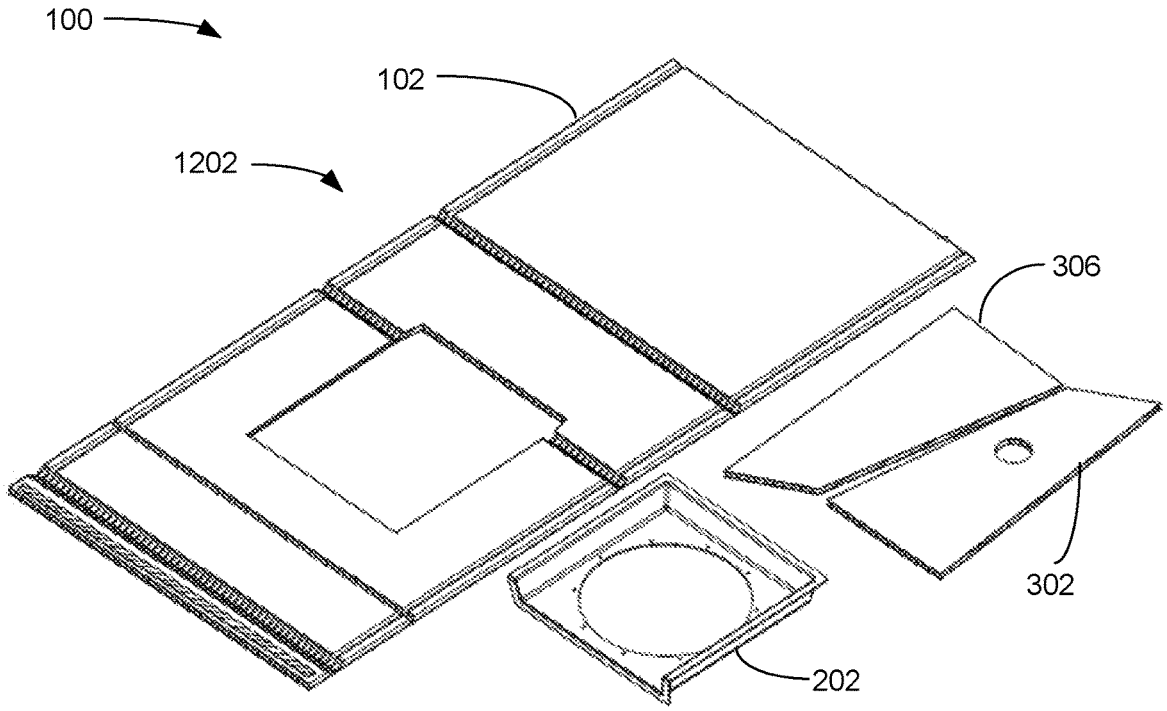
FIG. 12 is a top perspective view illustrating a shipping kit of the exemplary embodiment of the plastic acoustic enclosure of FIG. 1, according to a preferred embodiment of the present invention.

FIG. 12 is a top perspective view illustrating a shipping kit 1202 of the exemplary embodiment of the plastic acoustic enclosure 100 of FIG. 1, according to a preferred embodiment of the present invention. The plastic acoustic enclosure 100 can be shipped in reduced packaging due to being flat. In addition, because of the light weight of the plastic acoustic enclosure 100, shipping costs are substantially reduced as compared to wood acoustic enclosures. When used as speaker enclosures in automobiles, the reduced weight of plastic acoustic enclosure 100 assists in improving gas mileage.

Figure 13:
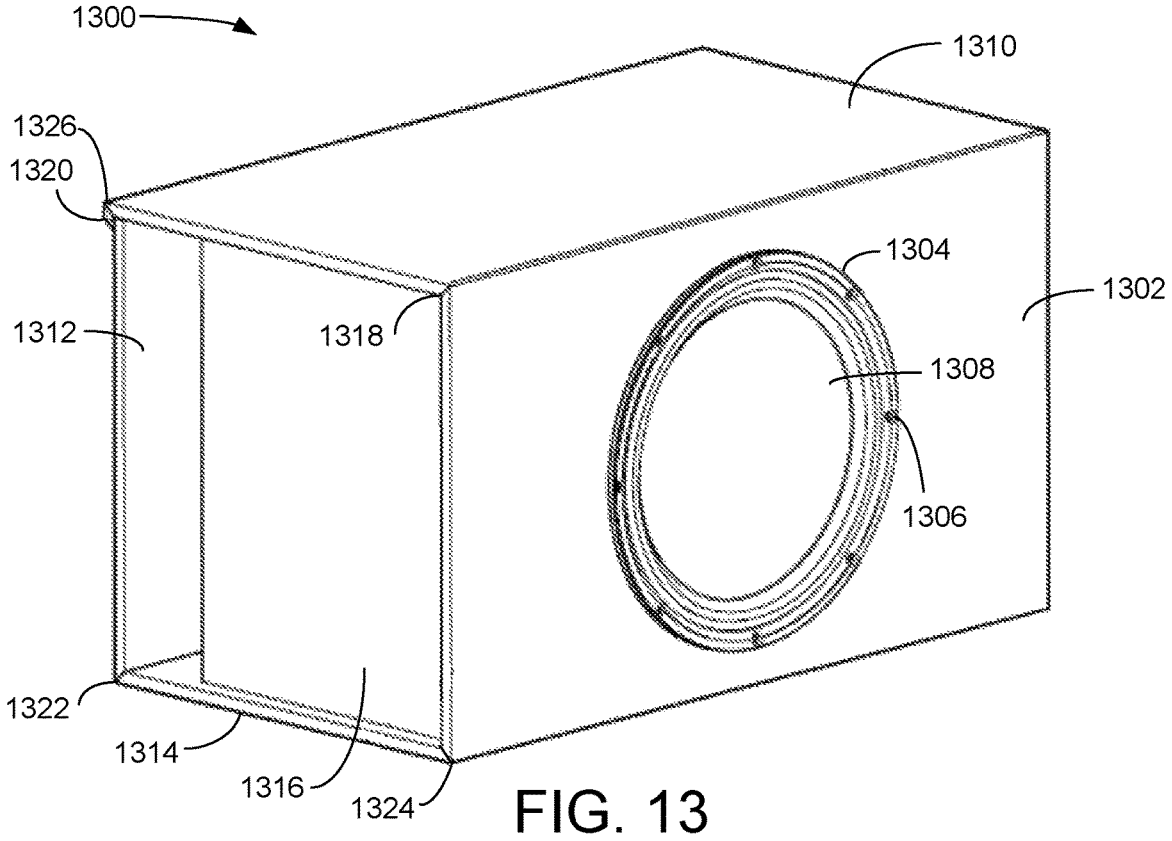
FIG. 13 is a front side perspective view illustrating a second exemplary embodiment of a plastic acoustic enclosure, according to a preferred embodiment of the present invention.

FIG. 13 is a front side perspective view illustrating a second exemplary embodiment of the plastic acoustic enclosure 1300, according to a preferred embodiment of the present invention. Plastic acoustic enclosure 1300 has an integrated flat-package audio amplifier 1704 (see FIG. 17), as will be discussed further below. The outer body of plastic acoustic enclosure 1300 has four main panels: rear panel 1312, bottom panel 1314, front panel 1302, and top panel 1310, all of which are folded panels of a single cut sheet of corrugated plastic 1402 (see FIG. 14). The outer body of plastic acoustic enclosure 1300 also includes short adhesive panel 1320 which, upon assembly, adheres to the exterior surface of rear panel 1312. Fold lines 1322, 1324, 1318, and 1326 are centerlines for corners to be folded during assembly. Fold line 1322 is between rear panel 1312 and bottom panel 1314. Fold line 1324 is between bottom panel 1314 and front panel 1302. Fold line 1318 is between front panel 1302 and top panel 1310. Fold line 1326 is between top panel 1310 and short adhesive panel 1320. Front panel 1302 supports speaker 1308 having basket rim 1304 with a plurality of fastener holes 1306 (one of eight labeled). Left side panel 1316 is part of an internal support structure 1524 (see FIG. 15).

Figure 14:
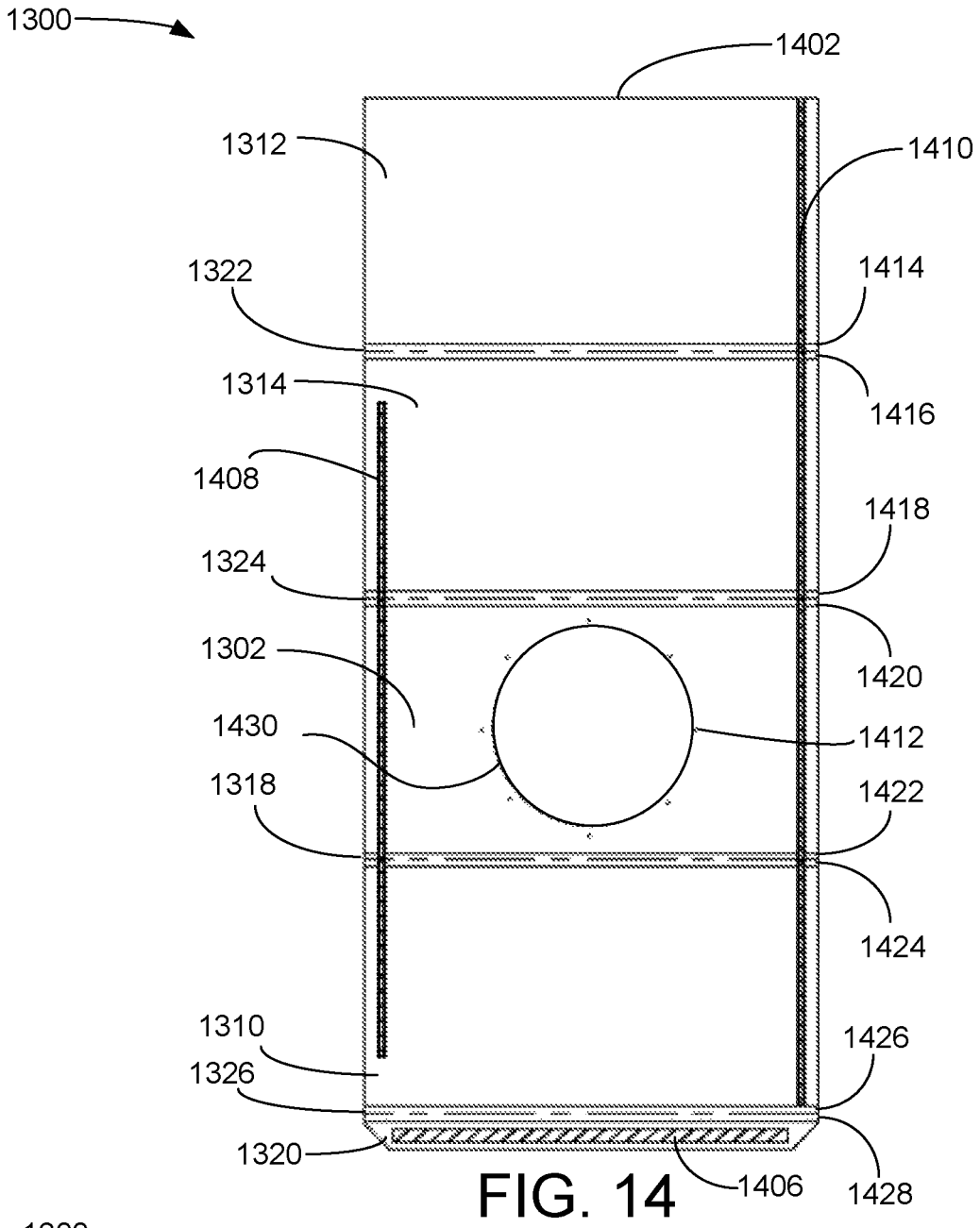
FIG. 14 is an inner side plan view illustrating the second exemplary embodiment of a prepared panel for forming the plastic acoustic enclosure of FIG. 13, according to a preferred embodiment of the present invention.

FIG. 14 is an interior side plan view illustrating the second exemplary embodiment of the plastic acoustic enclosure 100 of FIG. 13, according to a preferred embodiment of the present invention. Single cut sheet of corrugated plastic 1402 includes back panel 1312, bottom panel 1314, front panel 1302, top panel 1310, and short adhesive panel 1320. Fold line 1322 is the centerline of a V-shaped grove having groove sides 1414 and 1416, which are angled such that, when back panel 1312 is folded with respect to bottom panel 1314, the two panels 1312 and 1314 close the groove sides 1414 and 1416 together to make a right angle joint. Fold line 1324 is the centerline of a V-shaped grove having groove sides 1418 and 1420, which are angled such that, when bottom panel 1314 is folded with respect to front panel 1302, the two panels 1314 and 1302 close the groove sides 1418 and 1420 together to make a right angle joint. Fold line 1318 is the centerline of a V-shaped grove having groove sides 1422 and 1424, which are angled such that, when front panel 1302 is folded with respect to top panel 1310, the two panels 1302 and 1310 close the groove sides 1422 and 1424 together to make a right angle joint. Fold line 1326 is the centerline of a V-shaped grove having groove sides 1426 and 1428, which are angled such that, when panel 1310 is folded with respect to short adhesive panel 1320, the two panels 1310 and 1320 close the groove sides 1426 and 1428 together to make a right angle joint. In various embodiments, a sound deadening material may be applied to any of the groove sides 1414, 1416, 1418, 1420, 1422, 1424, 1426, and 1428 to avoid plastic-on-plastic vibration noise. In various embodiments, the sound deadening material may be an adhesive sound deadening material. Short adhesive panel 1320 supports an adhesive strip 1406 with a release layer for securing back panel 1312, bottom panel 1314, front panel 1302, top panel 1310, and short adhesive panel 1320 in a folded configuration. Preferably, the adhesive is permanent. Side panel attachment features 1408 and 1410 assist in securing left and right side panels 1316 and 1702 (see FIG. 18). Side panel attachment features 1408 and 1410 may be channels, adhesive strips with release layers, channels with adhesive strips with release layers, adhesive sound deadening materials with release layers, or channels with adhesive sound deadening materials with release layers. Front panel 1302 has a speaker opening 1430 and multiple fastener openings 1412 (one of eight labeled). In various embodiments, other panel sizes, shapes, and folding angles may be used. However, the present embodiment is preferred for simplicity of design and low cost.

Figure 15:
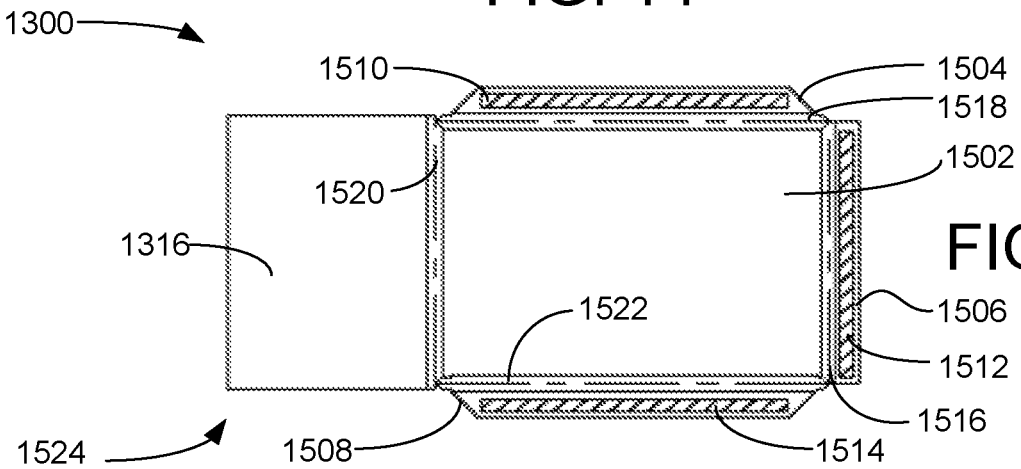
FIG. 15 is an inner side elevation view illustrating a prepared panel for forming an exemplary plastic internal support of the second exemplary embodiment of the plastic acoustic enclosure of FIG. 13, according to a preferred embodiment of the present invention.

FIG. 15 is an inner side elevation view illustrating an internal support structure 1524 of the second exemplary embodiment of the plastic acoustic enclosure 1300 of FIG. 13, according to a preferred embodiment of the present invention. Left side panel 1316 is coupled to interior rear panel 1502 across fold line 1520, which is grooved in a manner similar to the grooves of FIG. 14. Interior rear panel 1502 has top adhesive flange 1504, right side adhesive flange 1506, and bottom adhesive flange 1508 connected across grooved fold lines 1518, 1516, and 1522, respectively. Top adhesive flange 1504, right side adhesive flange 1506, and bottom adhesive flange 1508 support adhesive strips 1510, 1512, and 1514, with release layers, respectively. Edges of left side panel 1316 not coupled to interior rear panel 1502 are received in side panel attachment feature 1408, when assembled.

Figure 16:
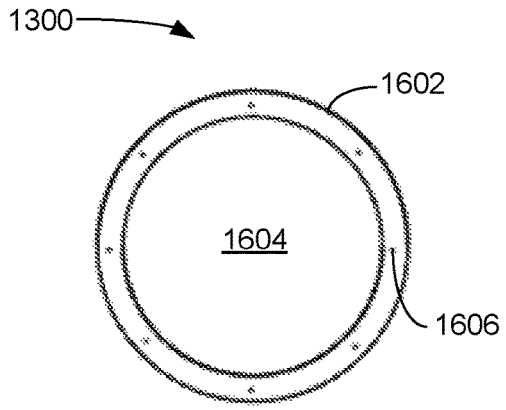
FIG. 16 is a front elevation view illustrating a support ring of the second exemplary embodiment of the plastic acoustic enclosure of FIG. 13, according to a preferred embodiment of the present invention.

FIG. 16 is a front elevation view illustrating a speaker support ring 1602 of the second exemplary embodiment of the plastic acoustic enclosure 1300 of FIG. 13, according to a preferred embodiment of the present invention. Speaker support ring 1602 is a flat annular ring, distinct from speaker 1308, of preferably rigid material with a central opening 1604 that is preferably at least as large in diameter as speaker opening 1430. Speaker support ring 1602 has multiple support ring fastener openings 1606 (one of eight labeled) that are alignable to fastener openings 1412. In various embodiments, the external perimeter of speaker support ring 1602 need not be round, and may be any size consistent with space available for its use (see FIG. 18). The rigid material of speaker support ring 1602 may be, without limitation, metal, hard plastic, or a composite material.

Figure 17:
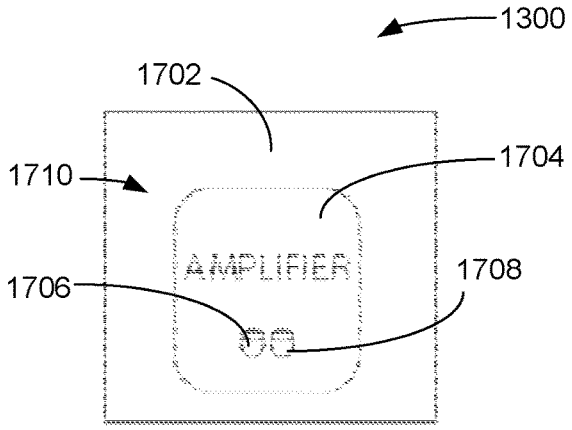
FIG. 17 is a front elevation view illustrating an exemplary amplifier end panel of the second exemplary embodiment of the plastic acoustic enclosure of FIG. 13, according to a preferred embodiment of the present invention.

FIG. 17 is a front elevation view illustrating an exemplary right side panel 1702 of the second exemplary embodiment of the plastic acoustic enclosure 1300 of FIG. 13, according to a preferred embodiment of the present invention. Right side panel 1702 is preferably made of corrugated plastic 702 and supports a flat-package audio amplifier 1704 on exterior surface 1710. Edges of right side panel 1702 are engaged with side panel attachment feature 1410, when assembled. Audio amplifier 1704 supports audio signal wire connectors 1706 and 1708. The advantage of this design is that the audio amplifier 1704 is impedance matched to speaker 1308, and the user need only connect an external audio source to audio signal wire connectors 1706 and 1708 to obtain amplified audio from speaker 1308. Audio speaker wires from the output of audio amplifier 1704 connect through an opening in right side panel 1702 located behind audio amplifier 1704, and so is not visible in this view. In various embodiments, various sizes and shapes of audio amplifiers 1704 may be used, consistent with the size and shape of the particular plastic acoustic enclosure 1300.

Figure 18:
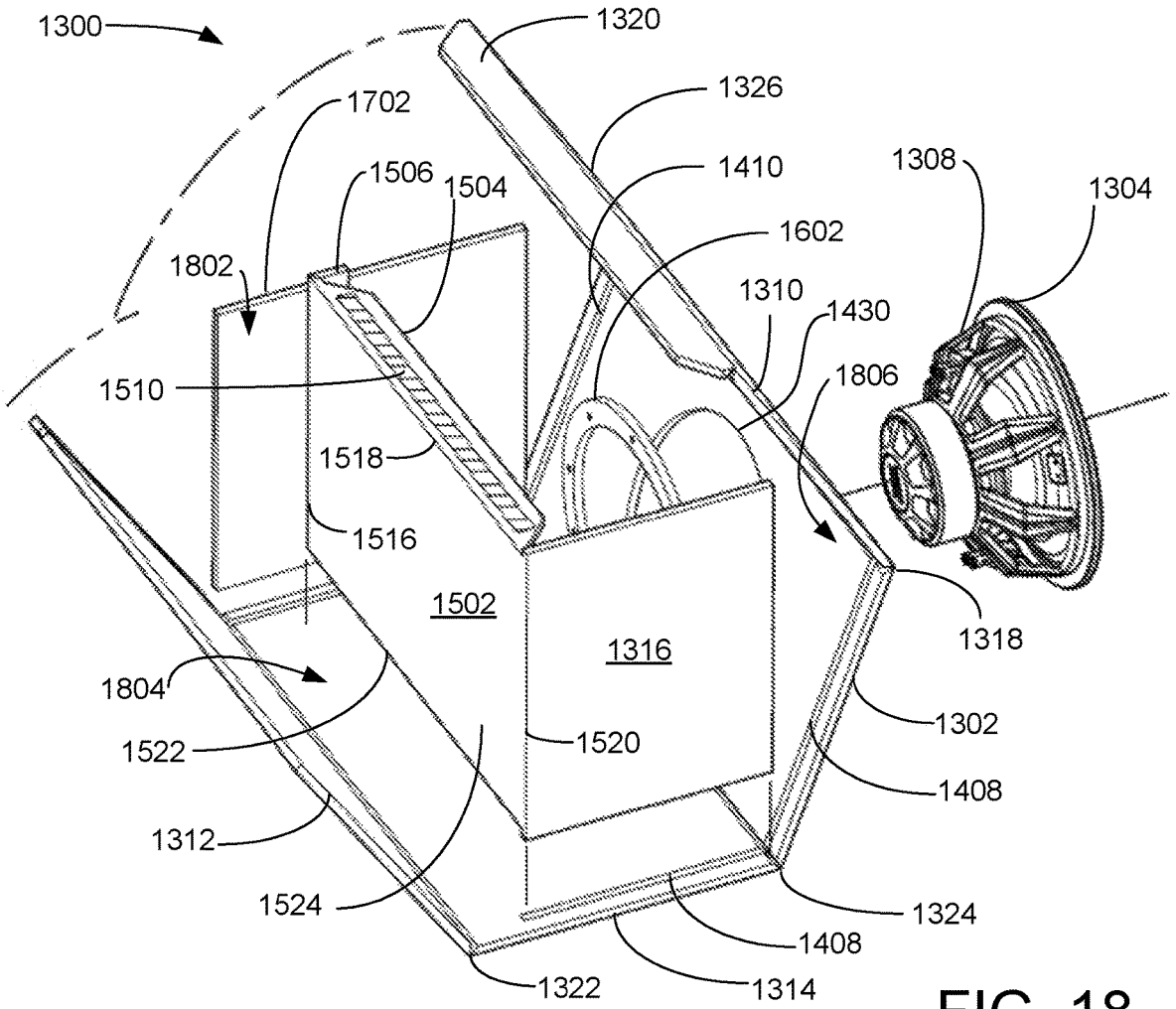
FIG. 18 is a top rear perspective exploded view illustrating the exemplary embodiment of the plastic acoustic enclosure of FIGS. 13-17, according to a preferred embodiment of the present invention.

FIG. 18 is a top rear perspective exploded view illustrating the exemplary embodiment of the plastic acoustic enclosure 1300 of FIGS. 13-17, according to a preferred embodiment of the present invention. Plastic acoustic enclosure 1300 is shown in an intermediate step of assembly. Left side panel 1316 is being attached on its bottom, front, and top edges to side panel attachment feature 1408, and left side panel 1316 and internal rear panel 1502 have been fully folded along fold line 1520. Top adhesive flange 1504 and interior rear panel 1502 have been fully folded along fold line 1518, and adhesive strip 1510 is positioned to adhere to the underside of top panel 1310 as assembly proceeds. Right side adhesive flange 1506 and interior rear panel 1502 have been fully folded along fold line 1516, and adhesive strip 1512 (see FIG. 15) is positioned to adhere to the inner surface 1802 of right side panel 1702 as assembly proceeds. Bottom adhesive flange 1508 (not visible here) and interior rear panel 1502 have been fully folded along fold line 1522, and adhesive strip 1514 (not visible here) is positioned to adhere to the top surface 1804 of bottom panel 1314 as assembly proceeds. Right side panel 1702 is being attached on its bottom, front, top, and rear edges to side panel attachment feature 1410. Once the internal support structure 1524 and right side panel 1702 are in place, speaker support ring 1602 is attached, preferably adhesively, to the interior surface 1806 of front panel 1302 with support ring fastener openings 1606 aligned to front panel fastener openings 1412. Speaker 1308 is then attached to front panel 1302 via fasteners though fastener holes 1306 in speaker basket rim 1304 aligned to and through front panel fastener openings 1412 and support ring fastener openings 1606. With the speaker 1308 attached, the folding between panels 1312, 1302, 1310, 1314, and 1320 may be completed.

Figure 19:
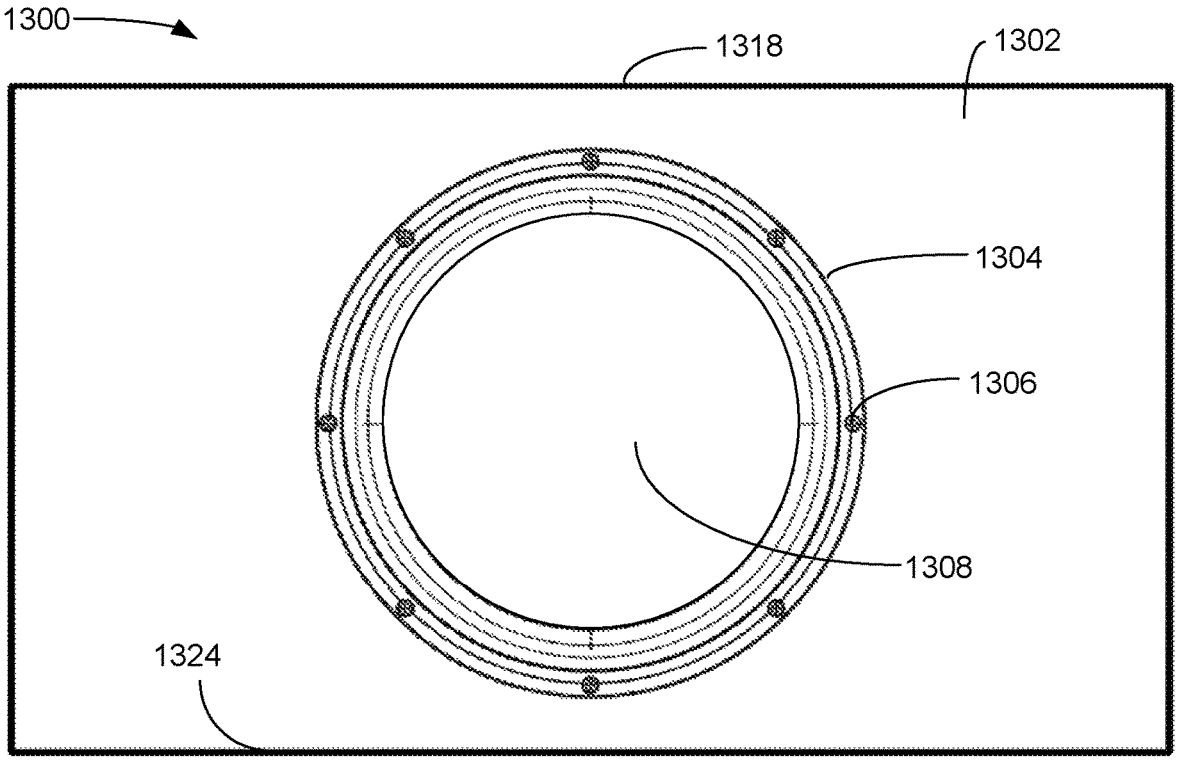
FIG. 19 is a front elevation view illustrating the second exemplary embodiment of the plastic acoustic enclosure of FIG. 13, according to a preferred embodiment of the present invention.

FIG. 19 is a front elevation view illustrating the second exemplary embodiment of the plastic acoustic enclosure 1300 of FIG. 13, according to a preferred embodiment of the present invention. Speaker 1308 is shown substantially centered on front panel 1302, but that is not a limitation of the present invention. Likewise, the circular shape of speaker 1308 is not a limitation of the present invention.

Figure 20:
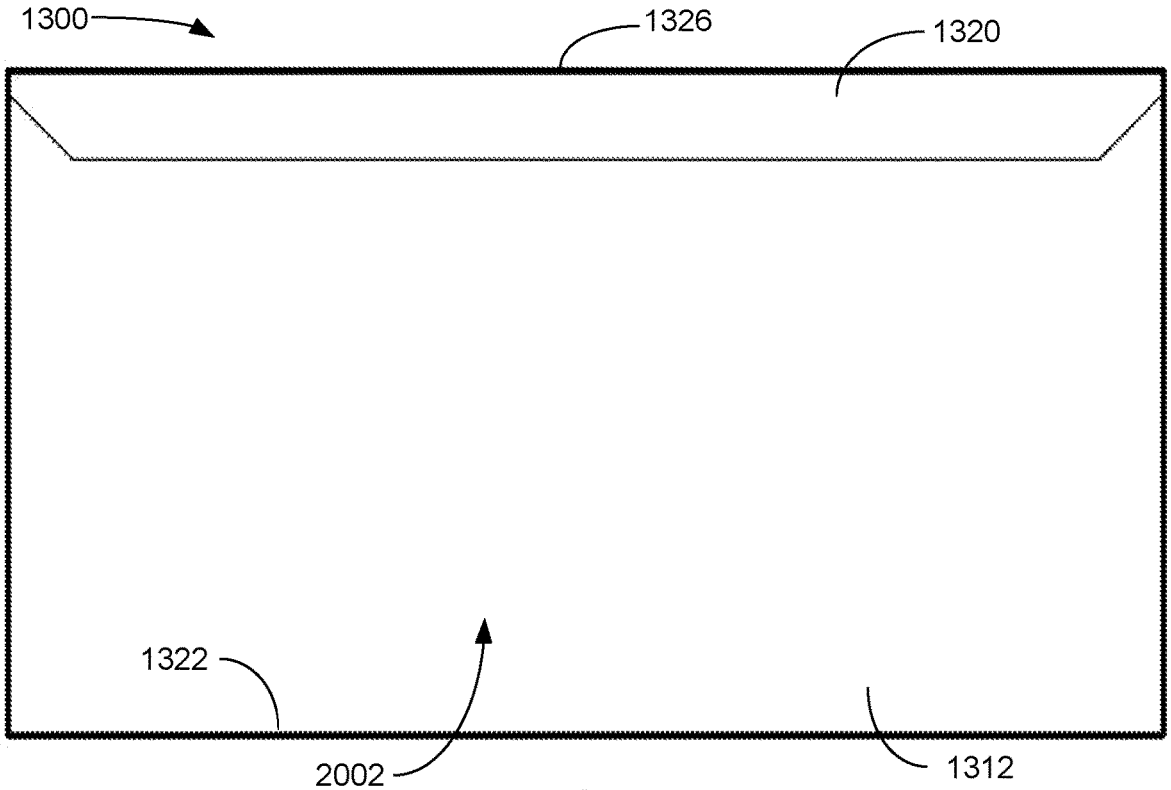
FIG. 20 is a rear elevation view illustrating the second exemplary embodiment of the plastic acoustic enclosure of FIG. 13, according to a preferred embodiment of the present invention.

FIG. 20 is a rear elevation view illustrating the second exemplary embodiment of the plastic acoustic enclosure 1300 of FIG. 13, according to a preferred embodiment of the present invention. Short adhesive panel 1320 is shown fully folded along fold line 1326 and adhered to the rear surface 2002 of rear panel 1312.

Figure 21:
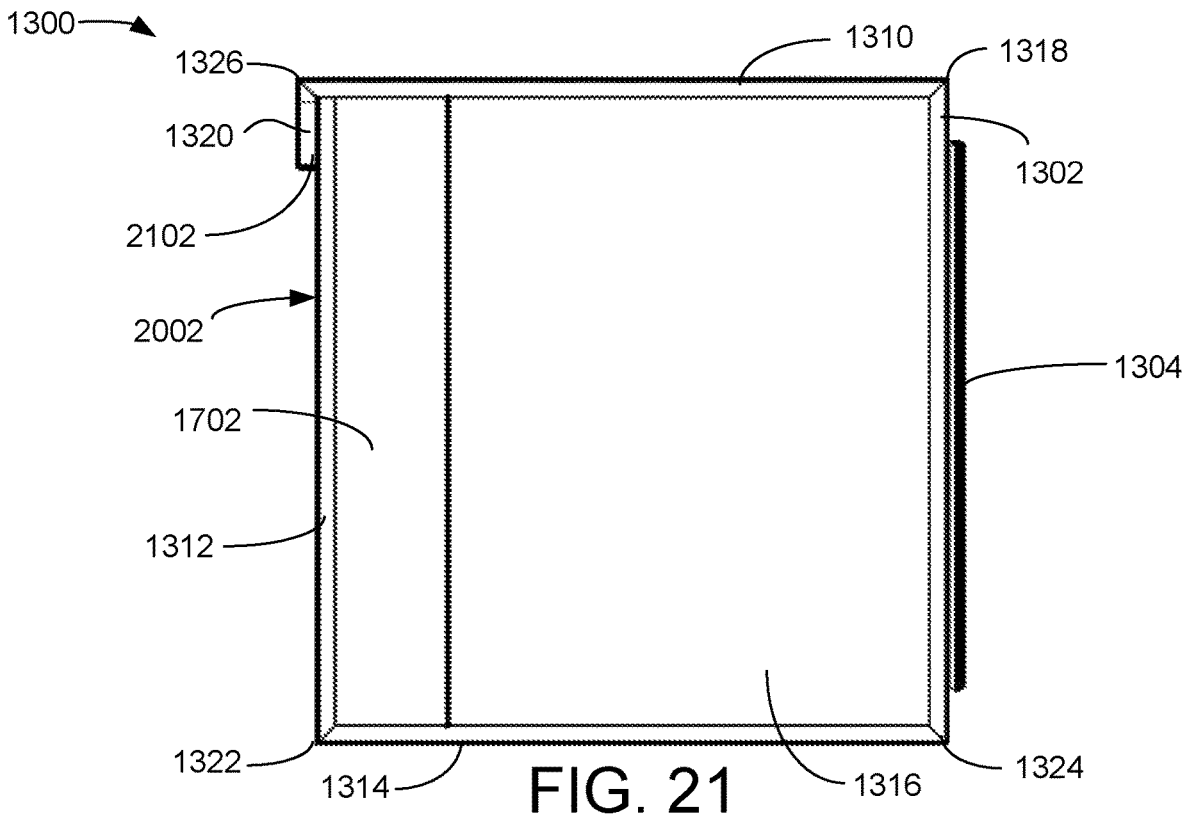
FIG. 21 is a left side elevation view illustrating the second exemplary embodiment of the plastic acoustic enclosure of FIG. 13, according to a preferred embodiment of the present invention.

FIG. 21 is a left side elevation view illustrating the second exemplary embodiment of the plastic acoustic enclosure 1300 of FIG. 13, according to a preferred embodiment of the present invention. Adhesive joint 2102 between short adhesive panel 1320 and the rear surface 2002 of rear panel 1312 can best be seen in this view.

Figure 22:
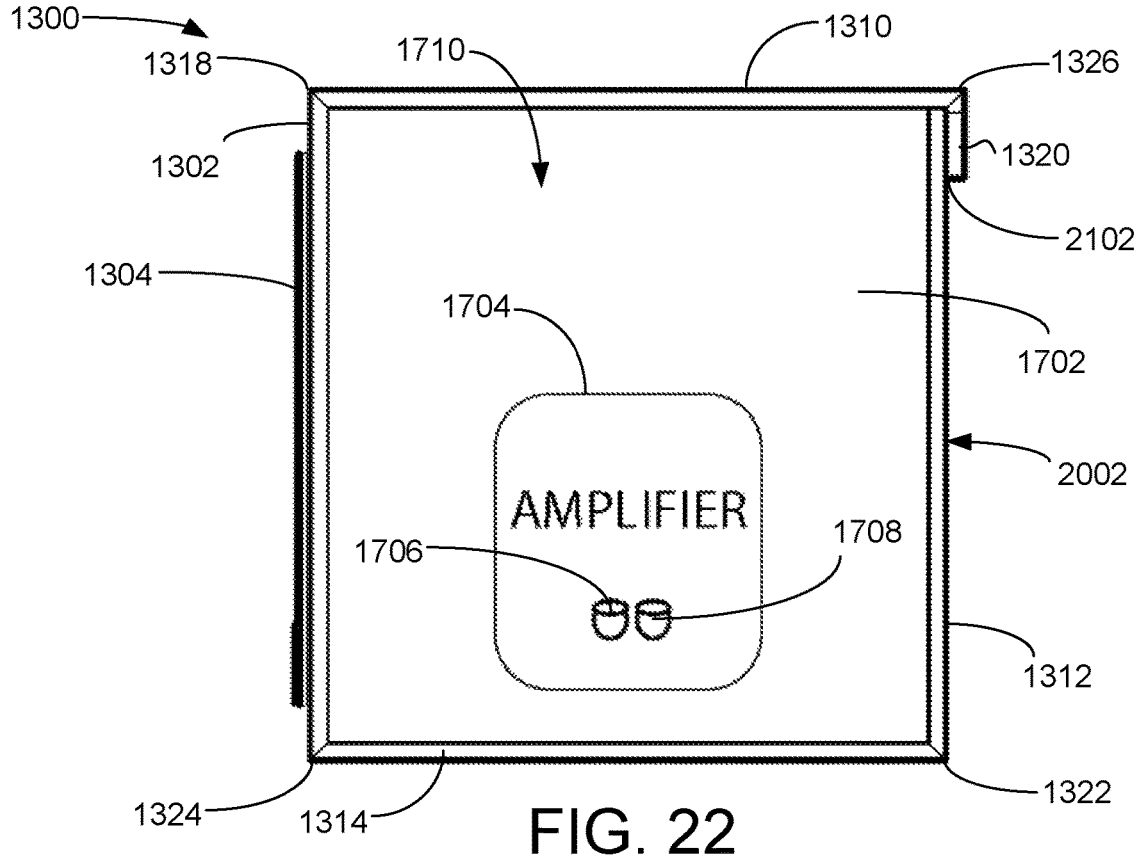
FIG. 22 is a right side elevation view illustrating the second exemplary embodiment of the plastic acoustic enclosure of FIG. 13, according to a preferred embodiment of the present invention.

FIG. 22 is a right side elevation view illustrating the second exemplary embodiment of the plastic acoustic enclosure 1300 of FIG. 13, according to a preferred embodiment of the present invention. The advantages in having the audio amplifier 1704 on an exterior surface 1710 of the right side panel 1702 include ease of access for the user and improved heat dissipation from the audio amplifier 1704. In various other embodiments, audio amplifier 1704 may be attached to any external surface of the plastic acoustic enclosure 1300. Any of the embodiments 100, 1300, 2300, and 2900 illustrated herein, or referred to, may receive an audio amplifier 1704.

Figure 23:
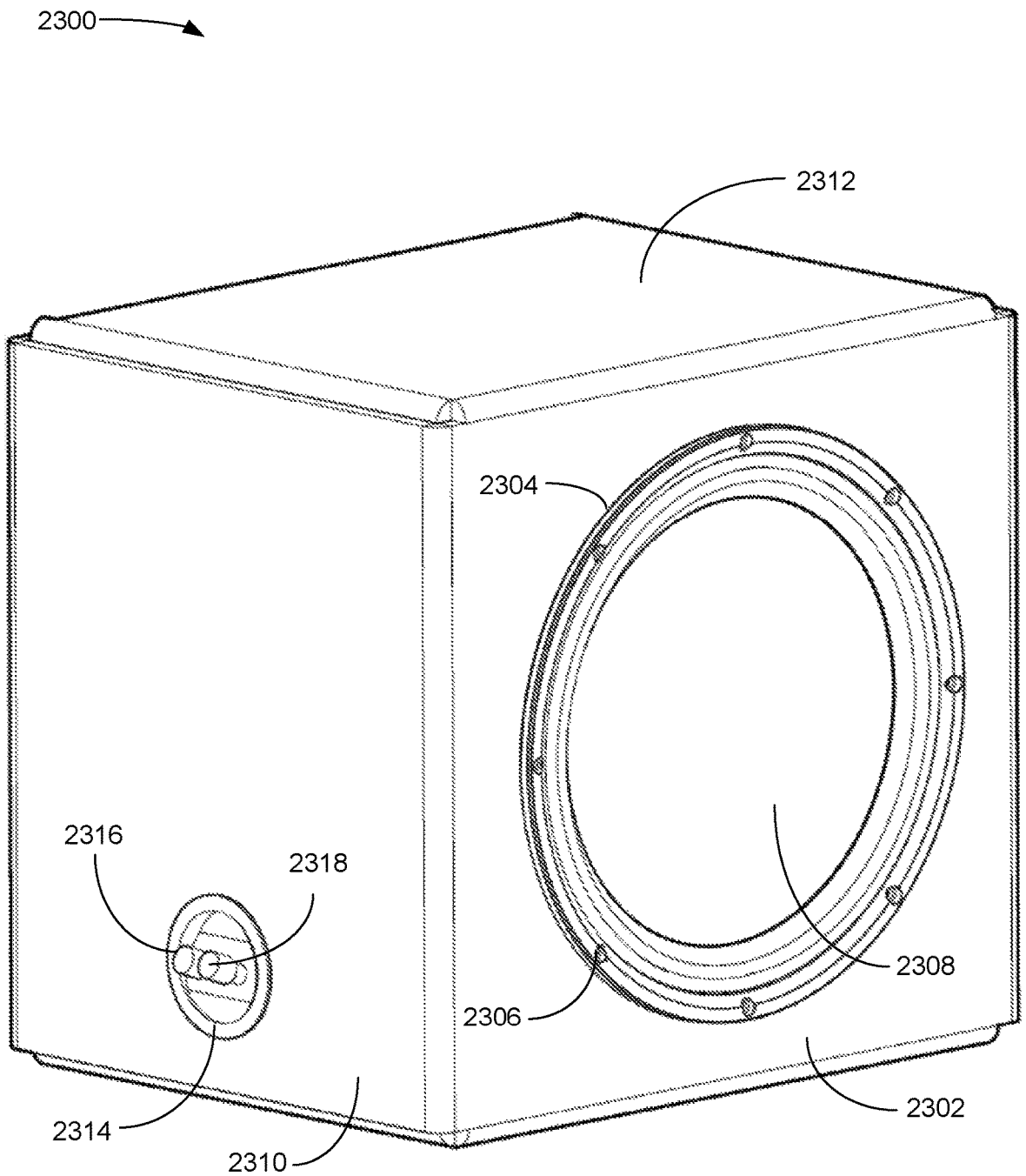
FIG. 23 is a front-side perspective view illustrating a third exemplary embodiment of the plastic acoustic enclosure, according to a preferred embodiment of the present invention.

FIG. 23 is a front-side perspective view illustrating a third exemplary embodiment of the plastic acoustic enclosure 2300, according to a preferred embodiment of the present invention. Front panel 2302 supports speaker 2308 having a speaker basket rim 2304 having rim fastener openings 2306 (one of eight labeled). Left side panel 2310 supports connector plug 2314 which, in turn, supports audio signal wire connectors 2316 and 2318. Top panel 2312 suggests, correctly, that the plastic acoustic enclosure 2300 is generally in the shape of a box. The shape of the plastic acoustic enclosure 2300 and the shape of speaker 2308 are not limitations of the present invention. However, the present embodiment of plastic acoustic enclosure 2300 is preferred for simplicity of design and economy of production.

Figure 24:
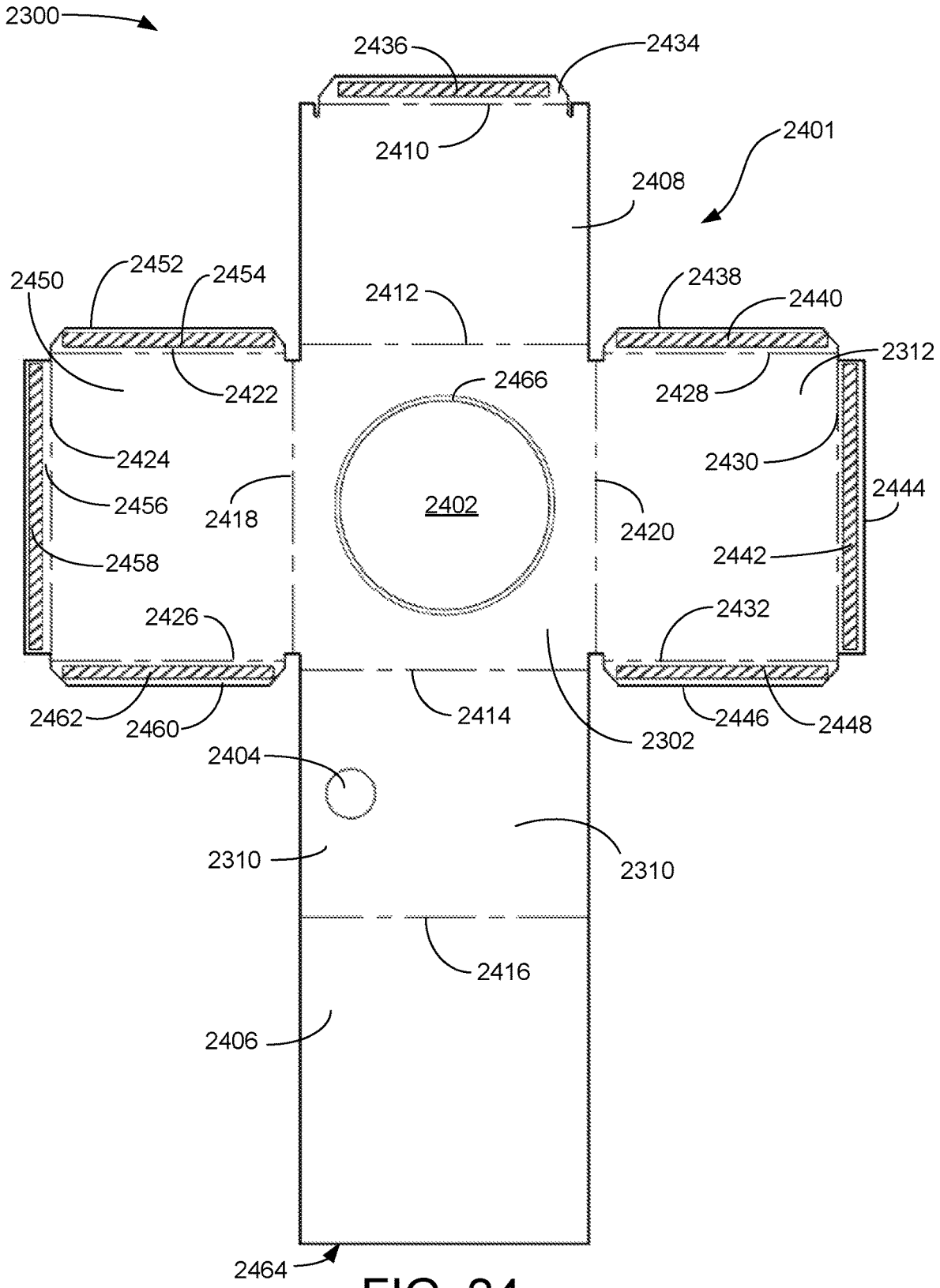
FIG. 24 is an exterior side plan view illustrating a prepared panel for forming the third exemplary embodiment of the plastic acoustic enclosure of FIG. 23, according to a preferred embodiment of the present invention.

FIG. 24 is an exterior plan view illustrating a prepared sheet 2401 for forming the third exemplary embodiment of the plastic acoustic enclosure 2300 of FIG. 23, according to a preferred embodiment of the present invention. Corrugated plastic sheet 2401 includes front panel 2302, left side panel 2310, rear panel 2406, right side panel 2408, top panel 2312, and bottom panel 2450. Fold line 2410 is aligned the centerline of a V-shaped grove on the opposite side of the corrugated plastic sheet 2401 (similar to those shown in detail in FIG. 1 and FIG. 14, and not repeated here). Fold line 2410 is between right side panel 2408 and short adhesive panel 2434. The V-shaped groove is similar to those described in regard to previous embodiments and has groove sides which are angled such that, when short adhesive panel 2434 is folded with respect to right side panel 2408, the two panels 2434 and 2408 close the groove sides together to make a right angle. Fold line 2412 is the aligned to the centerline of a V-shaped grove on the opposite side of the corrugated plastic sheet 2401 (similar to those shown in detail in FIG. 1 and FIG. 14, and not repeated here). Fold line 2412 is between right side panel 2408 and front panel 2302. The V-shaped groove is similar to those described in regard to previous embodiments and has groove sides which are angled such that, when right side panel 2408 is folded with respect to front panel 2302, the two panels 2408 and 2302 close the groove sides together to make a right angle. Fold line 2414 is the centerline of a V-shaped grove on the opposite side of the corrugated plastic sheet 2401 (similar to those shown in detail in FIG. 1 and FIG. 14, and not repeated here). Fold line 2414 is between left side panel 2310 and front panel 2302. The V-shaped groove is similar to those describes in regard to previous embodiments and has groove sides which are angled such that, when left side panel 2310 is folded with respect to front panel 2302, the two panels 2310 and 2302 close the groove sides together to make a right angle. Fold line 2416 is between left side panel 2310 and rear panel 2406. The V-shaped groove on the opposite side of the corrugated plastic sheet 2401 is similar to those described in regard to previous embodiments and has groove sides which are angled such that, when left side panel 2310 is folded with respect to panel 2406, the two panels 2310 and 2406 close the groove sides together to make a right angle. Fold line 2420 is between top panel 2312 and front panel 2302. The V-shaped groove on the opposite side of the corrugated plastic sheet 2401 is similar to those described in regard to previous embodiments and has groove sides which are angled such that, when top panel 2312 is folded with respect to front panel 2302, the two panels 2312 and 2302 close the groove sides together to make a right angle. Fold line 2418 is between bottom panel 2450 and front panel 2302. The V-shaped groove on the opposite side of the corrugated plastic sheet 2401 is similar to those described in regard to previous embodiments and has groove sides which are angled such that, when bottom panel 2450 is folded with respect to front panel 2302, the two panels 2450 and 2302 close the groove sides together to make a right angle. In a various embodiments, a sound deadening material may be applied to any of the groove sides to avoid plastic-on-plastic vibration noise. Fold lines 2410, 2412, 2414, 2416, 2418, and 2420 fold away from the observer (into of the page) of FIG. 24, as do fold lines 2422, 2424, 2426, 2428, 2430, and 2432.

Top panel 2312 includes right side top adhesive flange 2428, rear side top adhesive flange 2444, and left side top adhesive flange 2446 which are connected across fold lines 2428, 2430, and 2432, respectively. Right side top adhesive flange 2438, rear side top adhesive flange 2444, and left side top adhesive flange 2446 support adhesive strips 2440, 2442, and 2448, with release layers, respectively. Bottom panel 2450 includes right side bottom adhesive flange 2452, rear side bottom adhesive flange 2456, and left side bottom adhesive flange 2460 which are connected across grooved fold lines 2422, 2424, and 2426, respectively. Right side bottom adhesive flange 2452, rear side bottom adhesive flange 2456, and left side bottom adhesive flange 2460 support adhesive strips 2454, 2458, and 2462, with release layers, respectively. Rear panel edge 2464 is not beveled in this embodiment.

Speaker opening 2402 in front panel 2302 receives speaker 2308 and preferably includes rim 2466 for receiving fasteners for the speaker 2308. Connector plug opening 2404 receives connector plug 2314.

Figure 25:
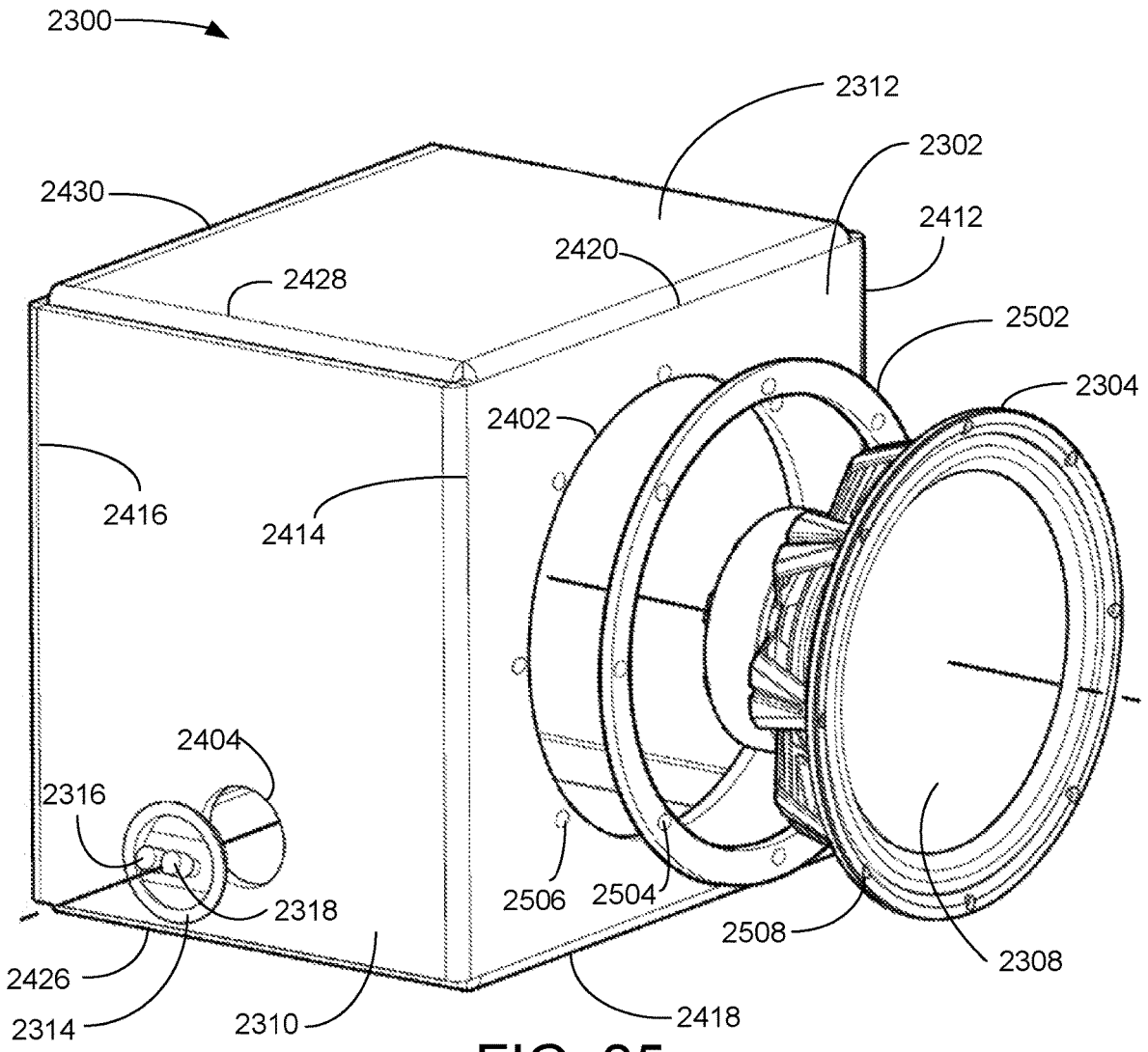
FIG. 25 is a front-side perspective exploded view illustrating the third exemplary embodiment of the plastic acoustic enclosure of FIG. 23, according to a preferred embodiment of the present invention.

FIG. 25 is a front-side perspective exploded view illustrating the third exemplary embodiment of the plastic acoustic enclosure 2300 of FIG. 23, according to a preferred embodiment of the present invention. Plastic acoustic enclosure 2300 is shown in an intermediate step of assembly. Speaker support ring 2502 has support ring fastener openings 2504 (one of six visible labeled of eight used) that align with front panel fastener openings 2506 (one of five visible labeled of eight used) and speaker basket rim fastener openings 2508 to receive fasteners to fasten speaker 2308 to front panel 2302. In an embodiment, speaker support ring 2502 may be installed on the interior surface of front panel 2302. Speaker support ring 2502 is preferably made of a rigid material such as, without limitation, metal, hard plastic, or composite material.

Figure 26:
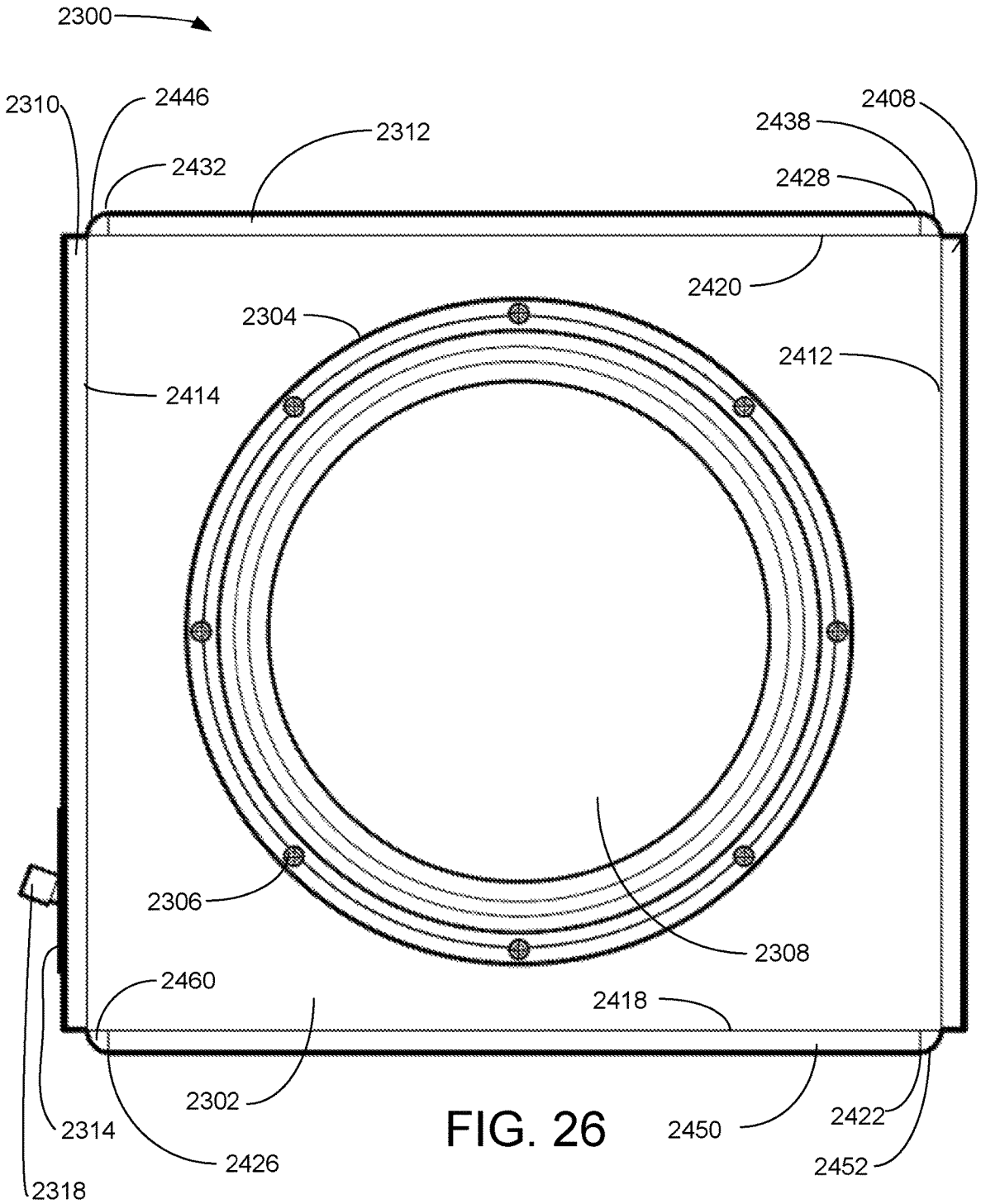
FIG. 26 is a front elevation view illustrating the third exemplary embodiment of the plastic acoustic enclosure of FIG. 23, according to a preferred embodiment of the present invention.

FIG. 26 is a front elevation view illustrating the third exemplary embodiment of the plastic acoustic enclosure 2300 of FIG. 23, according to a preferred embodiment of the present invention. The folding along panel fold lines 2412, 2414, 2418 and 2420 can be seen, as well as fold lines 2422, 2426, 2428, and 2432 of adhesive flanges 2452, 2460, 2438, and 2446, respectively.

Figure 27:
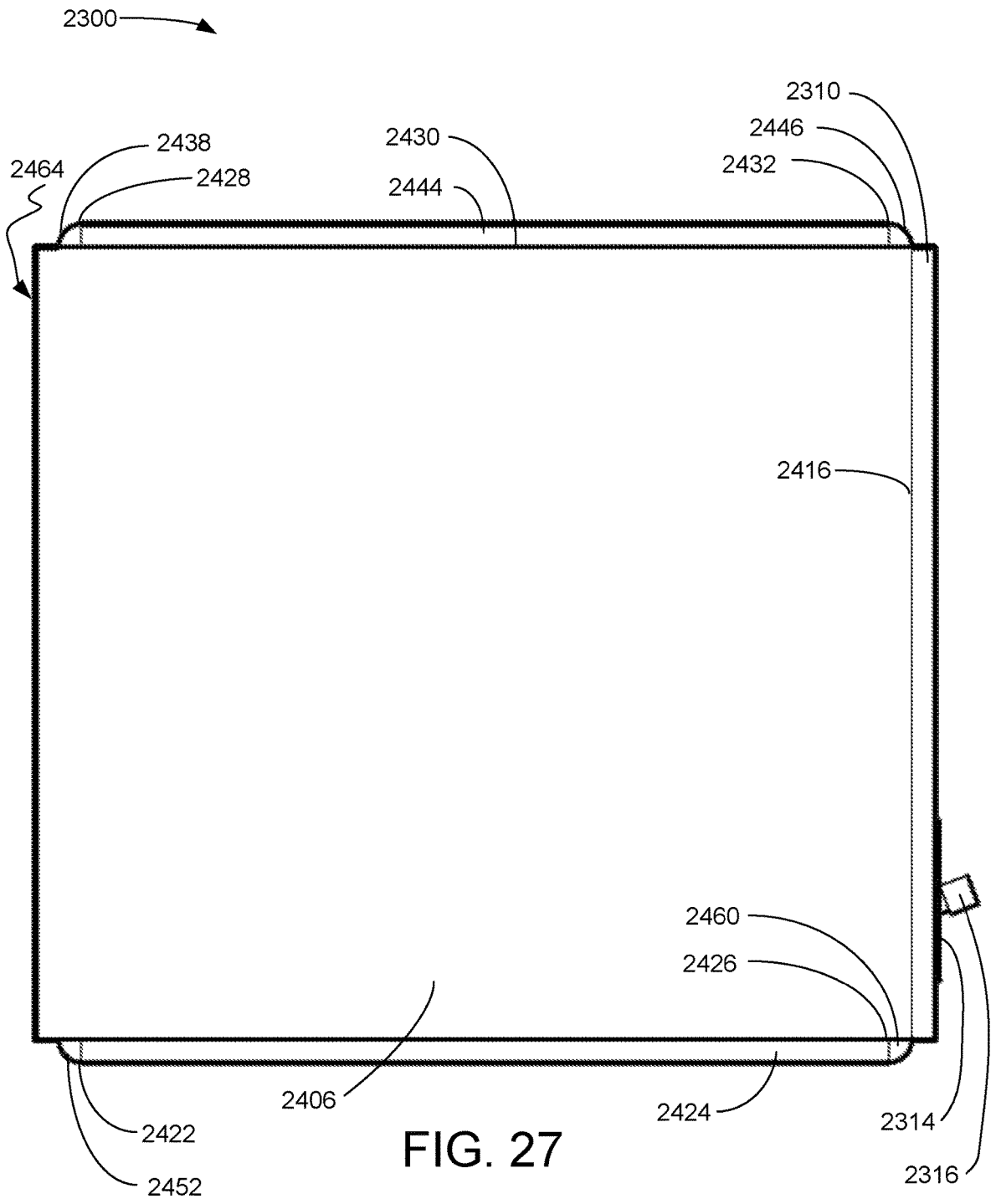
FIG. 27 is a rear elevation view illustrating the third exemplary embodiment of the plastic acoustic enclosure of FIG. 23, according to a preferred embodiment of the present invention.

FIG. 27 is a rear elevation view illustrating the third exemplary embodiment of the plastic acoustic enclosure 2300 of FIG. 23, according to a preferred embodiment of the present invention. The folding along panel fold line 2416 and rear panel edge 2464 can be seen, as well as fold lines 2422, 2426, 2428, and 2432 of adhesive flanges 2452, 2460, 2438, and 2446, respectively.

Figure 28:
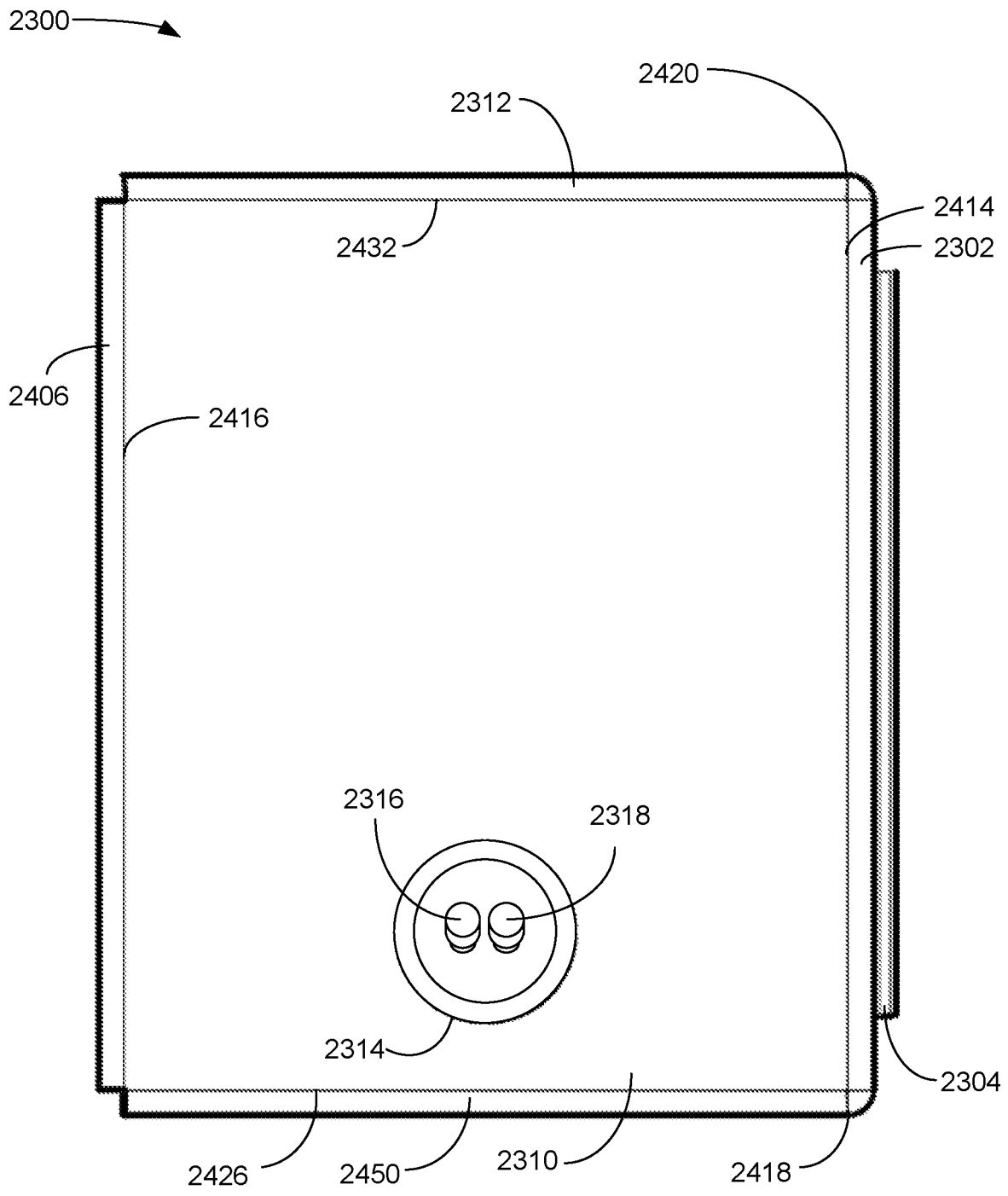
FIG. 28 is a left side elevation view illustrating the third exemplary embodiment of the plastic acoustic enclosure of FIG. 23, according to a preferred embodiment of the present invention.

FIG. 28 is a left side elevation view illustrating the third exemplary embodiment of the plastic acoustic enclosure 2300 of FIG. 23, according to a preferred embodiment of the present invention. Panel fold lines 2414, 2416, 2418, and 2420 can be seen as well as adhesive flange fold lines 2426 and 2432 for adhesive flanges 2460 and 2446, respectively.

Figure 29:
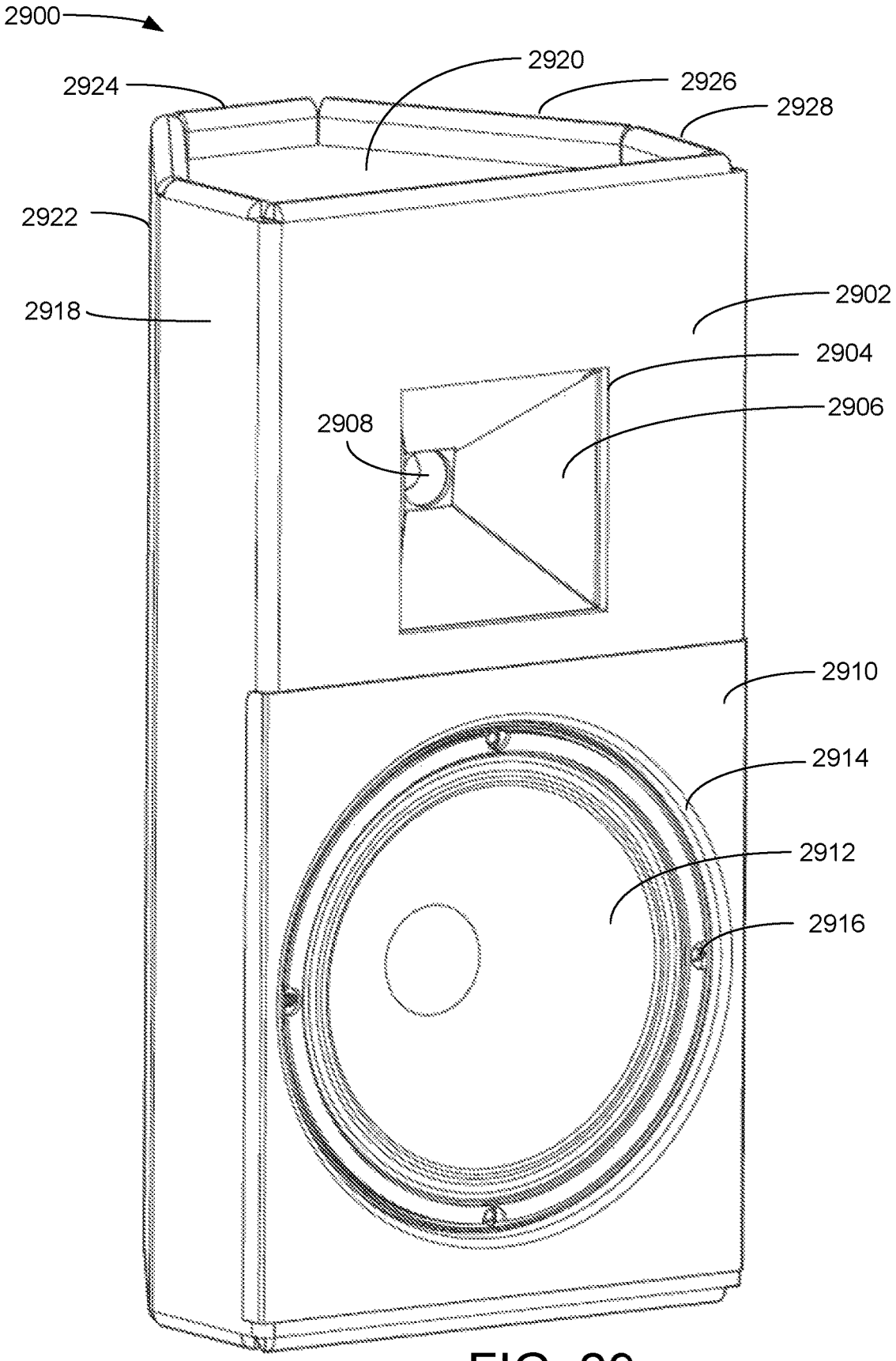
FIG. 29 is a front-side perspective view illustrating a fourth exemplary embodiment of the plastic acoustic enclosure, according to a preferred embodiment of the present invention.

FIG. 29 is a front-side perspective view illustrating a fourth exemplary embodiment of the plastic acoustic enclosure 2900, according to a preferred embodiment of the present invention. Five-sided plastic acoustic enclosure 2900 includes front panel 2902, preferably made of corrugated plastic 702. Front panel 2902 has a square tweeter opening 2904 with a corrugated plastic tweeter horn 2906 adhesively attached to the interior surface of front panel 2902. A tweeter 2908 is mounted to the tweeter horn 2906.

Front panel 2902 supports a speaker support panel 2910 which, in turn, supports speaker 2912 having a basket rim 2914 having multiple basket rim fastener openings 2916. Plastic acoustic enclosure 2900 has left and right narrow panels 2918 and 2928 extending from opposing side edges of front panel 2902, left and right wide panels 2922 and 2926 extending from side edges of narrow panels 2918 and 2928, respectively, and a narrow back panel 2924 extending between rear side edges of left and right wide panels 2922 and 2926. Top panel 2920 attaches to panels 2902, 2918, 2922, 2924, 2926 and 2928, as will be discussed in greater detail below.

Figure 30A:
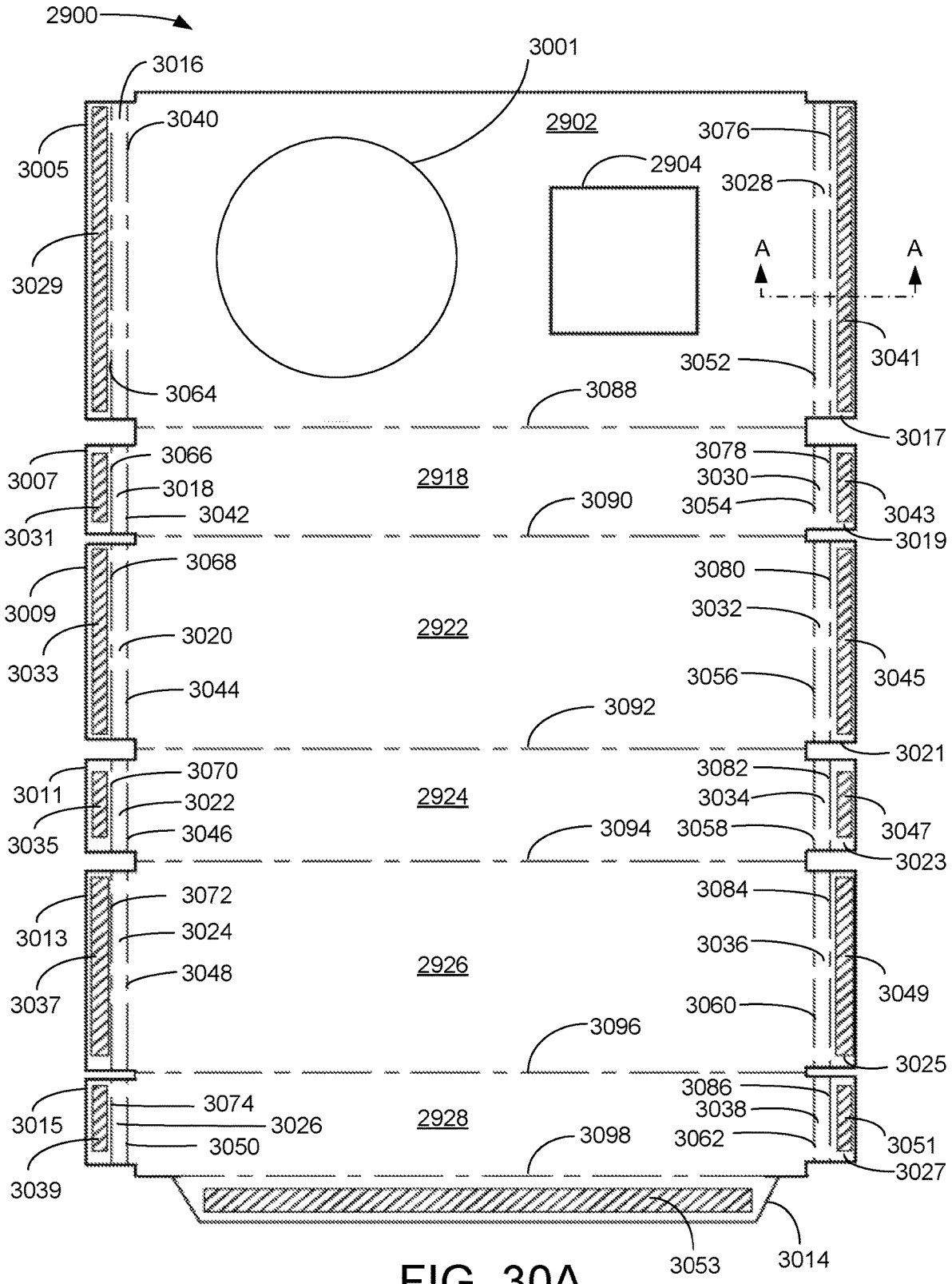
FIG. 30A is an interior side plan view illustrating a prepared panel for forming the fourth exemplary embodiment of the plastic acoustic enclosure of FIG. 29 and defining cross section AA, according to a preferred embodiment of the present invention.

FIG. 30A is an interior side plan view illustrating the fourth exemplary embodiment of the plastic acoustic enclosure 2800 of FIG. 29 and defining cross sections AA, according to a preferred embodiment of the present invention. A sheet of corrugated plastic has seven panels: 2902, 2918, 2922, 2924, 2926, 2928, and 3014 delineated by panel fold lines 3088, 3090, 3092, 3094, 3096, and 3098, respectively. Front panel 2902 has a speaker opening 3001 and a tweeter opening 2904, as shown. Front panel 2902 includes a top front panel double-folding adhesive flange 3017 having first and second parallel fold lines 3052 and 3076 with a top edge 3028 there between. Top front panel double-folding adhesive flange 3017 has an adhesive strip 3041 with a release layer. Front panel 2902 includes a bottom front panel double-folding adhesive flange 3005 having first and second parallel fold lines 3040 and 3064 with a bottom edge 3016 there between. Bottom front panel double-folding adhesive flange 3005 has an adhesive strip 3029 with a release layer.

Left side narrow panel 2918 is delineated from front panel 2902 by fold line 3088, which is similar to fold lines shown in detail in FIG. 1 and FIG. 14 with V-shaped grooves, which details are omitted here to simplify the drawing. Left side narrow panel 2918 includes a top left-side narrow panel double-folding adhesive flange 3019 having first and second parallel fold lines 3054 and 3078 with a top edge 3030 there between. Top left-side narrow panel double-folding adhesive flange 3019 has an adhesive strip 3043 with a release layer. Left side narrow panel 2918 includes a bottom left side narrow panel double-folding adhesive flange 3007 having first and second parallel fold lines 3042 and 3066 with a bottom edge 3018 there between. Bottom left side narrow panel double-folding adhesive flange 3007 has an adhesive strip 3031 with a release layer.

Left side wide panel 2922 is delineated from left side narrow panel 2918 by fold line 3090, which is similar to fold lines shown in detail in FIG. 1 and FIG. 14 with V-shaped grooves, which details are omitted here to simplify the drawing. Left side wide panel 2922 includes a top left-side wide panel double-folding adhesive flange 3021 having first and second parallel fold lines 3056 and 3080 with a top edge 3032 there between. Top left-side wide panel double-folding adhesive flange 3021 has an adhesive strip 3045 with a release layer. Left side wide panel 2922 includes a bottom left-side wide panel double-folding adhesive flange 3009 having first and second parallel fold lines 3044 and 3068 with a top edge 3020 there between. Bottom left-side wide panel double-folding adhesive flange 3009 has an adhesive strip 3033 with a release layer.

Narrow back panel 2924 is delineated from left side wide panel 2922 by fold line 3092, which is similar to fold lines shown in detail in FIG. 1 and FIG. 14 with V-shaped grooves, which details are omitted here to simplify the drawing. Narrow back panel 2924 includes a top narrow back panel double-folding adhesive flange 3023 having first and second parallel fold lines 3058 and 3082 with a top edge 3034 there between. Top narrow back panel double-folding adhesive flange 3023 has an adhesive strip 3047 with a release layer. Narrow back panel 2924 includes a bottom narrow back panel double-folding adhesive flange 3011 having first and second parallel fold lines 3046 and 3070 with a bottom edge 3022 there between. Bottom narrow back panel double-folding adhesive flange 3011 has an adhesive strip 3035 with a release layer.

Right side wide panel 2926 is delineated from narrow back panel 2924 by fold line 3094, which is similar to fold lines shown in detail in FIG. 1 and FIG. 14 with V-shaped grooves, which details are omitted here to simplify the drawing. Right side wide panel 2926 includes a top right-side wide panel double-folding adhesive flange 3035 having first and second parallel fold lines 3060 and 3084 with a top edge 3036 there between. Top right-side wide panel double-folding adhesive flange 3025 has an adhesive strip 3049 with a release layer. Right side wide panel 2926 includes a bottom right-side wide panel double-folding adhesive flange 3013 having first and second parallel fold lines 3048 and 3072 with a bottom edge 3024 there between. Bottom right-side wide panel double-folding adhesive flange 3013 has an adhesive strip 3037 with a release layer.

Right side narrow panel 2928 is delineated from right side wide panel 2926 by fold line 3096, which is similar to fold lines shown in detail in FIG. 1 and FIG. 14 with V-shaped grooves, which details are omitted here to simplify the drawing. Right side wide panel 2926 includes a top right side narrow panel double-folding adhesive flange 3027 having first and second parallel fold lines 3062 and 3086 with a top edge 3038 there between. Top right side narrow panel double-folding adhesive flange 3027 has an adhesive strip 3051 with a release layer. Right side narrow panel 2928 includes a bottom right side narrow panel double-folding adhesive flange 3015 having first and second parallel fold lines 3050 and 3074 with a bottom edge 3026 there between. Bottom right side wide panel double-folding adhesive flange 3015 has an adhesive strip 3039 with a release layer.

Adhesive panel 3014 is delineated from right side narrow panel 2928 by fold line 3098, which is similar to fold lines shown in detail in FIG. 1 and FIG. 14 with V-shaped grooves, which details are omitted here to simplify the drawing. Adhesive panel 3014 has adhesive strip 3053 for securing the folding panels 2902, 2918, 2922, 2924, 2926, 2928, and 3014 in an assembled configuration.

Figure 30B:
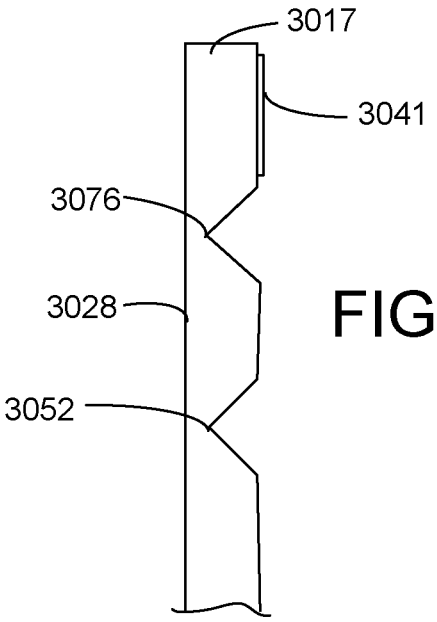
FIG. 30B is a cross sectional view through cross section AA of FIG. 30A illustrating an exemplary top front adhesive panel as a detail of the fourth exemplary embodiment of the plastic acoustic enclosure of FIG. 29, according to a preferred embodiment of the present invention.

FIG. 30B is a cross sectional view through cross section AA of FIG. 30A illustrating an exemplary top front panel double-folding adhesive panel 3017 illustrating a detail of the fourth exemplary embodiment of the plastic acoustic enclosure 2900 of FIG. 29, according to a preferred embodiment of the present invention. First and second fold lines 3052 and 3076 are centerlines of V-shaped grooves that enable folding to a desired angle, as shown.

Figure 30C:
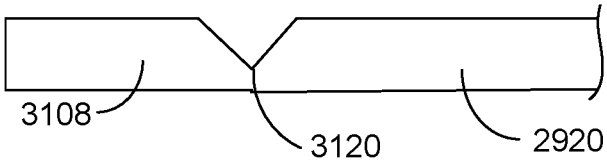
FIG. 30C is a cross sectional view through cross section BB of FIG. 31 illustrating an exemplary top panel as a detail of the fourth exemplary embodiment of the plastic acoustic enclosure of FIG. 29 and FIG. 31, according to a preferred embodiment of the present invention.
Figure 31:
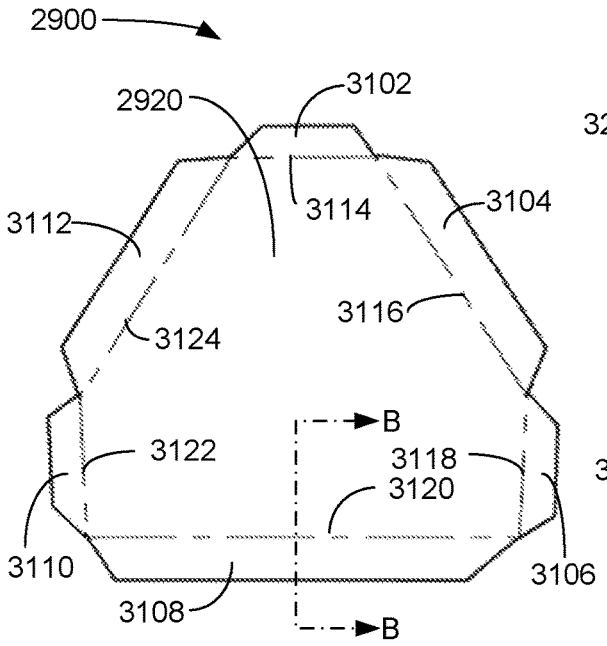
FIG. 31 is an outer side plan view illustrating an exemplary top panel of the fourth exemplary embodiment of the plastic acoustic enclosure of FIG. 29 and defining cross section BB, according to a preferred embodiment of the present invention.

FIG. 30C is a cross sectional view through cross section BB of FIG. 31 illustrating an exemplary top panel 2920 as a detail of the fourth exemplary embodiment of the plastic acoustic enclosure 2900 of FIG. 29 and FIG. 31, according to a preferred embodiment of the present invention. Fold line 3120 is a centerline of a V-shaped groove that enables folding to a desired angle, as shown.

Figure 30D:
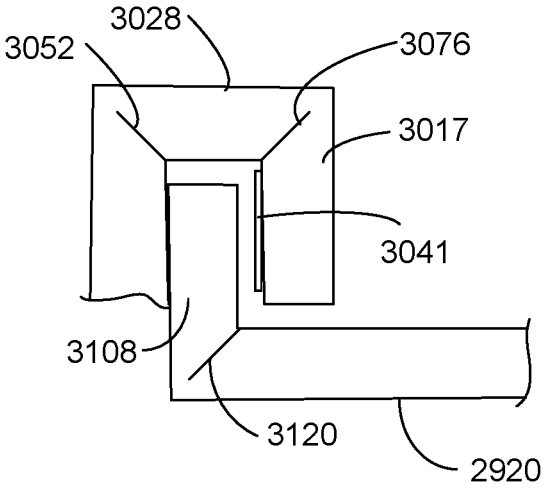
FIG. 30D is a cross sectional view illustrating an exemplary top front adhesive panel and top panel illustrating as details of the fourth exemplary embodiment of the plastic acoustic enclosure of FIG. 29 and FIG. 31, according to a preferred embodiment of the present invention.

FIG. 30D is a cross sectional view illustrating an exemplary top front panel double-folding adhesive panel 3017 and top panel 2920 illustrating a detail of the fourth exemplary embodiment of the plastic acoustic enclosure 2900 of FIG. 29 and FIG. 31, according to a preferred embodiment of the present invention. Top front panel double-folding adhesive panel 3017 has been folded at both fold lines 3052 and 3076 and the release strip has been removed from adhesive strip 3041. Top panel front flange 3108 has been folded at fold line 3120 and partially inserted into the bend of folded top front panel double-folding adhesive panel 3017 in an intermediate step of assembly.

Figure 30E:
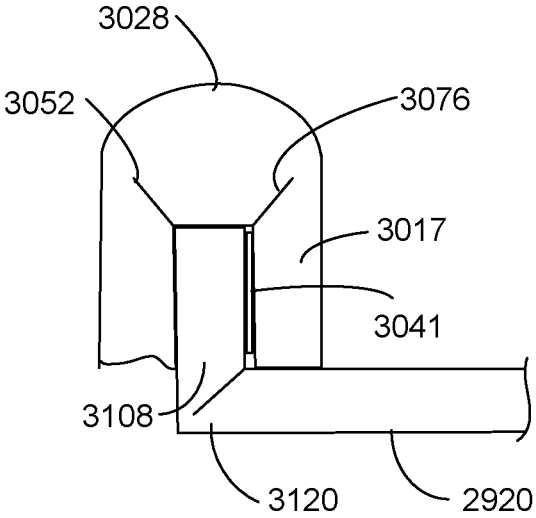
FIG. 30E is a cross sectional view illustrating an exemplary top front adhesive panel and top panel as details of the fourth exemplary embodiment of the plastic acoustic enclosure of FIG. 29 and FIG. 31, according to a preferred embodiment of the present invention.

FIG. 30E is a cross sectional view illustrating an exemplary top front panel double-folding adhesive panel 3017 and top panel 2920 as a detail of the fourth exemplary embodiment of the plastic acoustic enclosure 2900 of FIG. 29 and FIG. 31, according to a preferred embodiment of the present invention. Top panel front flange 3108 has been fully inserted in the bend of folded top front panel double-folding adhesive panel 3017 and the bend has been compressed in a final step of assembly. Compression causes top edge 3028 to bulge into a rounded edge. This adhesive coupling is exemplary of connections for all of the top panel flanges 3102, 3104, 3106, 3108, and 3110, as well as all bottom panel flanges 3204, 3206, 3208, 3210, 3212, and 3214 (see FIG. 31 and FIG. 32).

FIG. 31 is an outer side plan view illustrating an exemplary top panel 2920 of the fourth exemplary embodiment of the plastic acoustic enclosure 2900 of FIG. 29 and defining cross section BB, according to a preferred embodiment of the present invention. Top panel front flange 3108 is delineated from top panel 2920 by fold line 3120, which is similar to fold lines shown in detail in FIG. 1 and FIG. 14, which details are omitted here to simplify the drawing. Left narrow panel flange 3110 is delineated from top panel 2920 by fold line 3122. Left wide panel flange 3112 is delineated from top panel 2920 by fold line 3124. Narrow back panel flange 3102 is delineated from top panel 2920 by fold line 3114. Right wide panel flange 3104 is delineated from top panel 2920 by fold line 3116. Right narrow panel flange 3106 is delineated from top panel 2920 by fold line 3118. Folding along fold line 3120 is illustrated in FIGS. 30C-30D, and is exemplary of fold lines generally.

Figure 32:
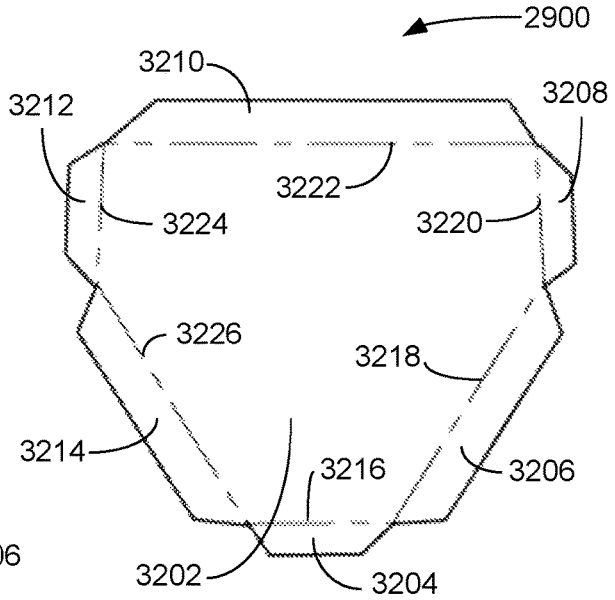
FIG. 32 is an outer side plan view illustrating an exemplary bottom panel of the fourth exemplary embodiment of the plastic acoustic enclosure of FIG. 29, according to a preferred embodiment of the present invention.

FIG. 32 is an outer side plan view illustrating an exemplary bottom panel 3202 of the fourth exemplary embodiment of the plastic acoustic enclosure 2900 of FIG. 29, according to a preferred embodiment of the present invention. Bottom panel 3202 is a mirror image of top panel 2920, and is used to close off the bottom end of the plastic acoustic enclosure 2900. Bottom panel front flange 3210 is delineated from bottom panel 3202 by fold line 3222, which is similar to fold lines shown in detail in FIG. 1 and FIG. 14, which details are omitted here to simplify the drawing. Left narrow panel flange 3208 is delineated from bottom panel 3202 by fold line 3220. Left wide panel flange 3206 is delineated from bottom panel 3202 by fold line 3218. Narrow back panel flange 3204 is delineated from bottom panel 3202 by fold line 3216. Right wide panel flange 3214 is delineated from bottom panel 3202 by fold line 3226. Right narrow panel flange 3212 is delineated from bottom panel 3202 by fold line 3224.

Figure 33:
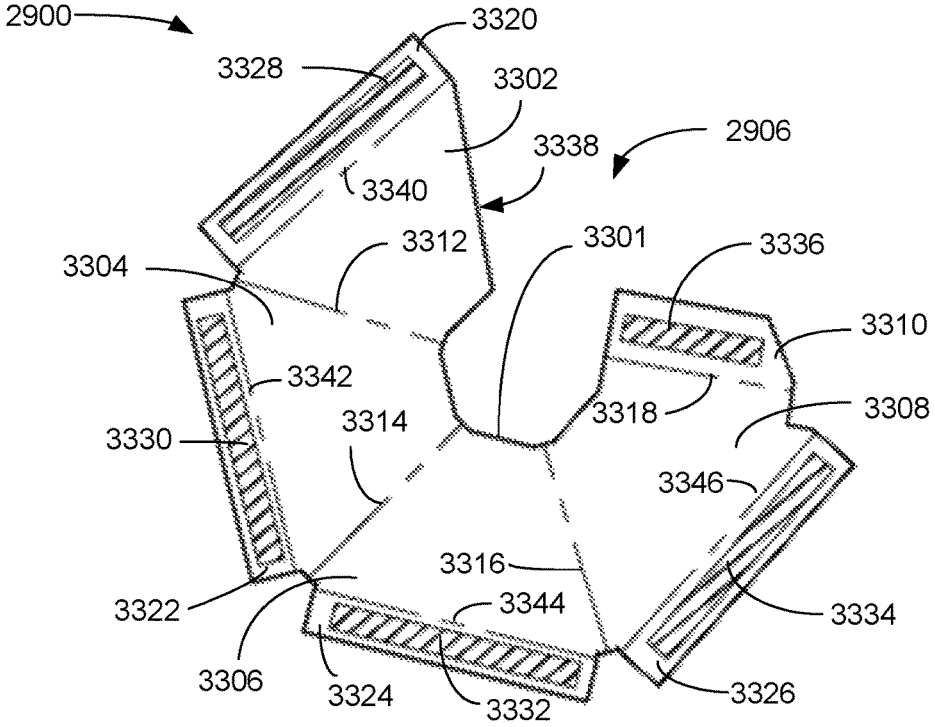
FIG. 33 is an interior plan view illustrating an exemplary tweeter horn panel of the fourth exemplary embodiment of the plastic acoustic enclosure of FIG. 29, according to a preferred embodiment of the present invention.

FIG. 33 is an interior plan view illustrating an exemplary tweeter horn 2906 of the fourth exemplary embodiment of the plastic acoustic enclosure 2900 of FIG. 29, according to a preferred embodiment of the present invention. Tweeter horn 2906 is a shaped sheet 3301 of corrugated plastic that includes trapezoidal corrugated plastic panels 3302, 3304, 3306 and 3308, as well as adhesive corrugated plastic folding panel 3310, which may be folded to secure the four trapezoidal corrugated plastic panels 3302, 3304, 3306 and 3308 into a tweeter horn 2906 configuration (a truncated pyramidal shell). First trapezoidal corrugated plastic panel 3302 has an adhesive foldable flange 3320 delineated from trapezoidal corrugated plastic panel 3302 by fold line 3340, similar to fold line shown in FIG. 1 and FIG. 14, with V-shaped grooves not shown for simplicity of the drawing. Adhesive foldable flange 3320 has an adhesive strip 3328 with a release layer. First trapezoidal corrugated plastic panel 3302 has a free edge 3338 which, during assembly, will be aligned to fold line 3318, similar to fold line shown in FIG. 1 and FIG. 14, with V-shaped grooves not shown for simplicity of the drawing. First trapezoidal corrugated plastic panel 3302 is delineated from second trapezoidal corrugated plastic panel 3304 by Adhesive corrugated plastic folding panel 3312, similar to fold line shown in FIG. 1 and FIG. 14, with V-shaped grooves not shown for simplicity of the drawing. Second trapezoidal corrugated plastic panel 3304 has an adhesive foldable flange 3322 delineated from panel trapezoidal corrugated plastic 3304 by fold line 3342, similar to fold line shown in FIG. 1 and FIG. 14, with V-shaped grooves not shown for simplicity of the drawing. Adhesive foldable flange 3322 has an adhesive strip 3330 with a release layer. Second trapezoidal corrugated plastic panel 3304 is delineated from third trapezoidal corrugated plastic panel 3306 by fold line 3314, similar to fold line shown in FIG. 1 and FIG. 14, with V-shaped grooves not shown for simplicity of the drawing. Third trapezoidal panel 3306 has an adhesive foldable flange 3324 delineated from panel 3306 by fold line 3344, similar to fold line shown in FIG. 1 and FIG. 14, with V-shaped grooves not shown for simplicity of the drawing. Adhesive foldable flange 3324 has an adhesive strip 3332 with a release layer. Third trapezoidal corrugated plastic panel 3306 is delineated from fourth trapezoidal corrugated plastic panel 3308 by fold line 3316, similar to fold line shown in FIG. 1 and FIG. 14, with V-shaped grooves not shown for simplicity of the drawing. Fourth trapezoidal corrugated plastic panel 3308 has an adhesive foldable flange 3326 delineated from fourth trapezoidal corrugated plastic panel 3308 by fold line 3346, similar to fold line shown in FIG. 1 and FIG. 14, with V-shaped grooves not shown for simplicity of the drawing. Adhesive foldable flange 3326 has an adhesive strip 3334 with a release layer. Adhesive corrugated plastic folding panel 3310 is delineated from fourth trapezoidal corrugated plastic panel 3308 by fold line 3318, similar to fold line shown in FIG. 1 and FIG. 14, with V-shaped grooves not shown for simplicity of the drawing. Adhesive corrugated plastic folding panel 3310 has an adhesive strip 3336 which, after assembly, will adhere to the rear surface of first trapezoidal corrugated plastic panel 3302 (not visible in this view). Adhesive strips 3328, 3330, 3332, and 3334 adhere to the interior surface of front panel 2902 aligned near the sides of tweeter opening 2904 to fasten the tweeter horn 2906 to the front panel 2902, as shown in FIG. 29.

Figure 34:
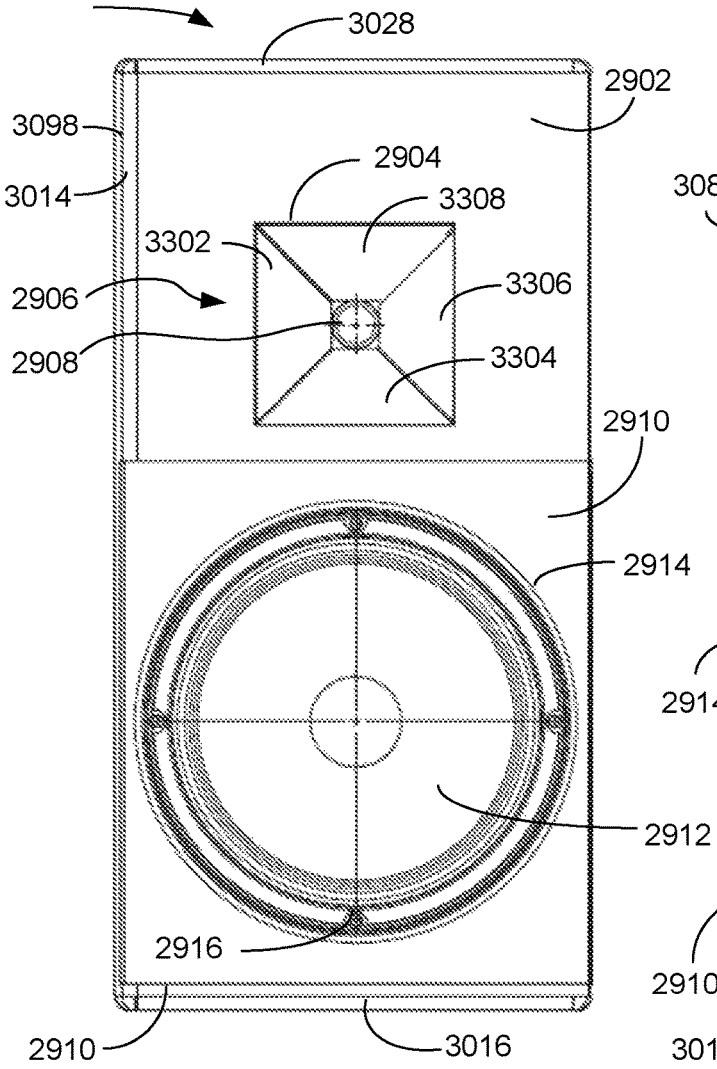
FIG. 34 is a front elevation view illustrating a variation the fourth exemplary embodiment of the plastic acoustic enclosure of FIG. 29, according to a preferred embodiment of the present invention.

FIG. 34 is a front elevation view illustrating a variation of the fourth exemplary embodiment of the plastic acoustic enclosure 2900 of FIG. 29, according to a preferred embodiment of the present invention. In this variation of the embodiment, the left, right and rear panels extend from the right side of the front panel 2902, rather than from the left side as shown in FIG. 30A, remembering that FIG. 30A is of the interior surfaces. As a result, adhesive panel 3014 wraps around the left side of front panel 2902 and fold line 3098 can be seen. Both approaches are within the scope of the present invention.

Figure 35:
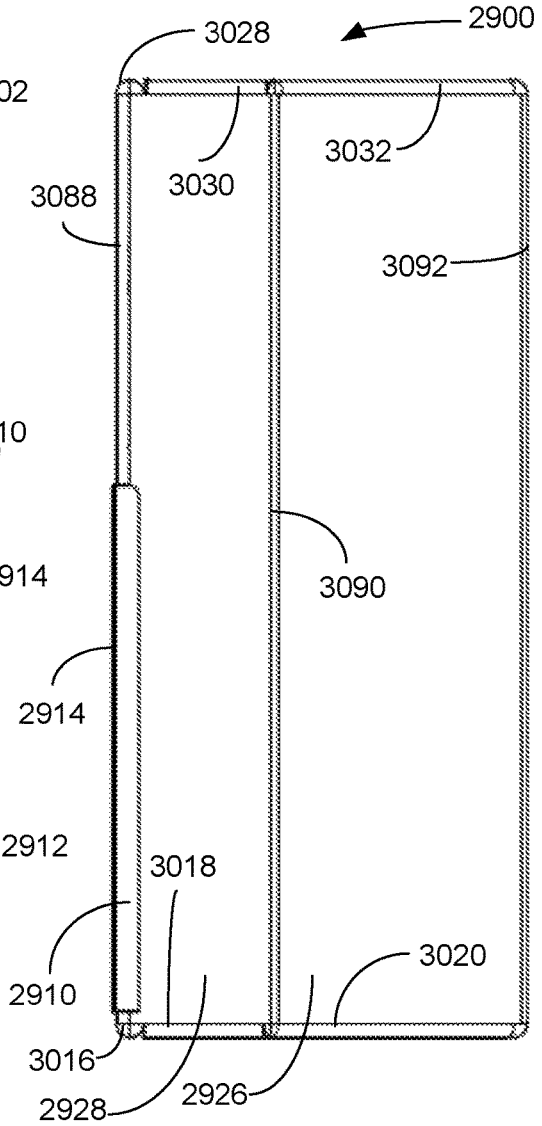
FIG. 35 is a side elevation view illustrating the fourth exemplary embodiment of the plastic acoustic enclosure of FIG. 29, according to a preferred embodiment of the present invention.

FIG. 35 is a right side elevation view illustrating the fourth exemplary embodiment of the plastic acoustic enclosure 2900 of FIG. 29 in the variation of FIG. 34, according to a preferred embodiment of the present invention. In various embodiments, various numbers and widths of sides may be used, consistent with acoustical quality and the design constraints of using corrugated foldable plastic sheets, folded and secured adhesively, and adapted to support a speaker.

Figure 36:
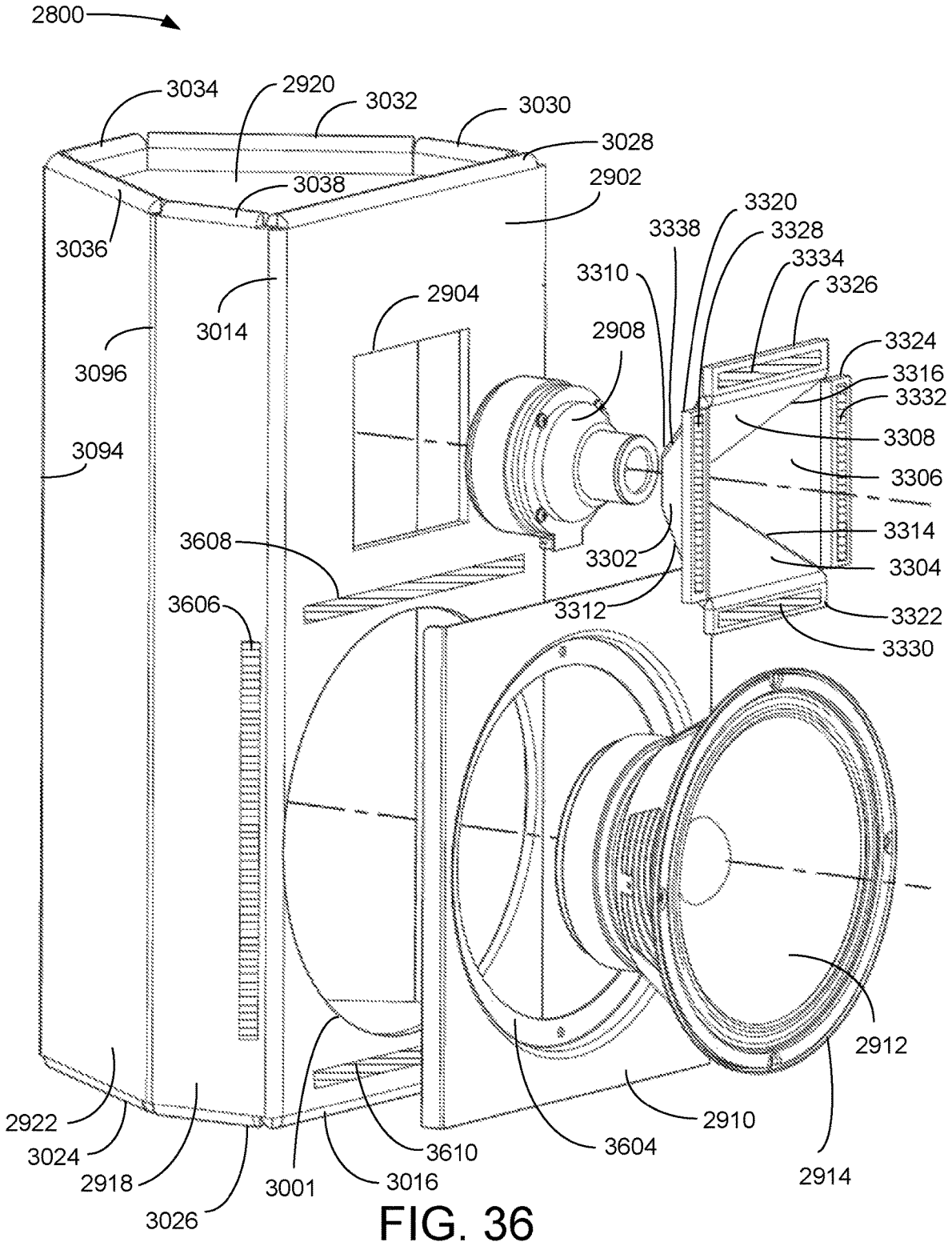
FIG. 36 is a front-side perspective exploded view illustrating the fourth exemplary embodiment of the plastic acoustic enclosure of FIG. 29, according to a preferred embodiment of the present invention.

FIG. 36 is a front-side perspective exploded view illustrating the fourth exemplary embodiment of the plastic acoustic enclosure 2900 of FIG. 29 in the variation of FIG. 34, according to a preferred embodiment of the present invention. Adhesive strips 3606, 2608, and 3610 are arranged around speaker opening 3001 to secure speaker support panel 2910 to front panel 2902 and left narrow panel 2918. An additional adhesive strip, not visible in this view, is on right side narrow panel 2928 to assist in securing the speaker support panel 2910 to right side narrow panel 2928. Speaker support panel 2910 has a counter sunk annular flange 3604, to which the speaker basket rim 2914 directly fastens. In various embodiments, various numbers of speakers may be supported in one plastic acoustic enclosure 2900.

Figure 37A:
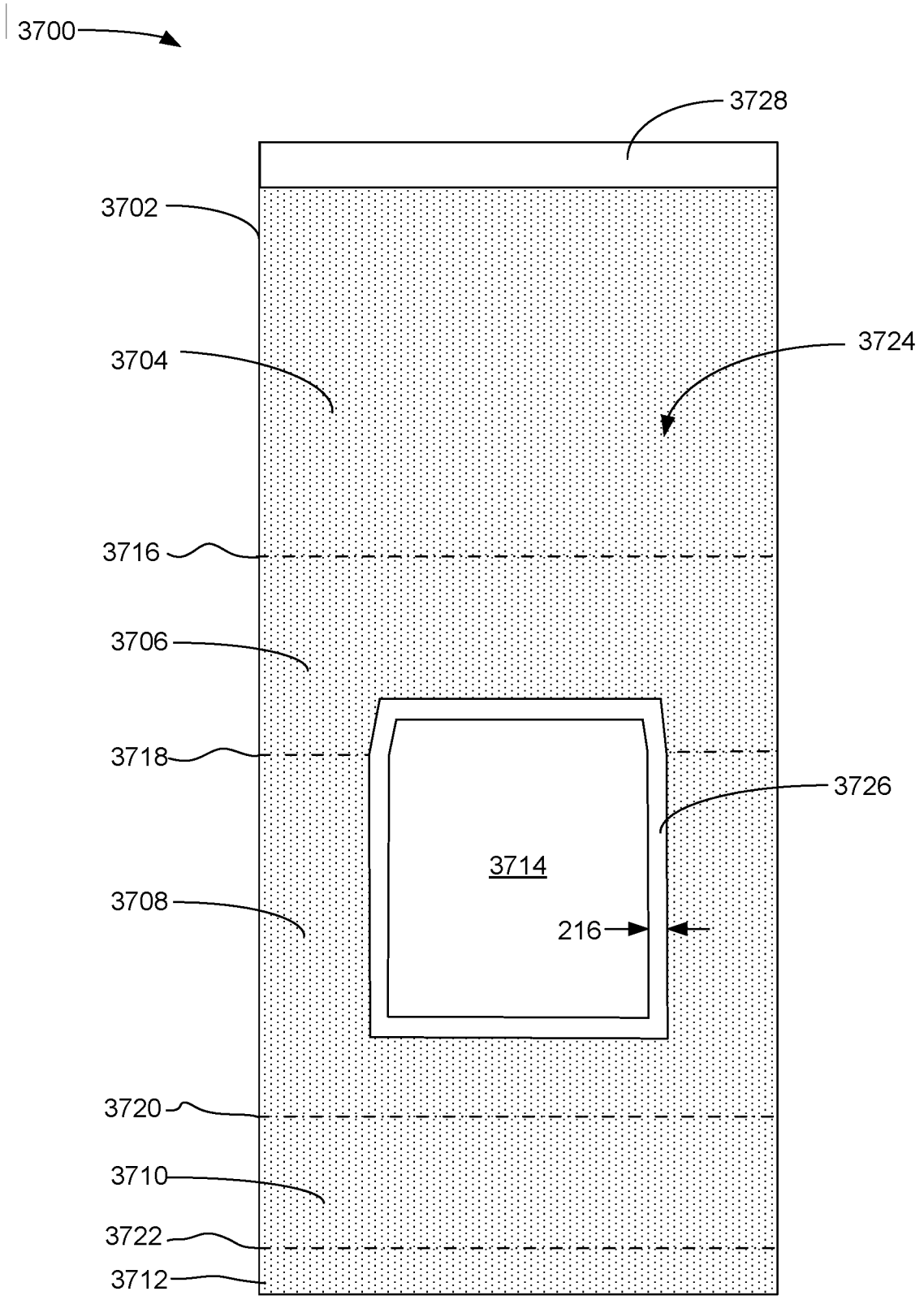
FIG. 37A is an exterior side plan view illustrating a prepared cut sheet an exemplary embodiment of the covered plastic acoustic enclosure, according to a preferred embodiment of the present invention.

FIG. 37A is an exterior side plan view illustrating a covered cut sheet 3702 of an exemplary embodiment of the covered plastic acoustic enclosure 3700, according to a preferred embodiment of the present invention. Covered plastic acoustic enclosure 3700 is similar to plastic acoustic enclosure 100, except that a covering 3724 has been applied to the plastic prepared cut sheet 102, forming covered cut sheet 3702. Covered cut sheet 3702 has panels 3704, 3706, 3708, 3710, and 3712 and fold lines 3716, 3718, 3720, and 3722, similar to plastic prepared cut sheet 102. Coverings, such as covering 3724, and the coverings illustrated or described in additional embodiments, are selected to affect the acoustics of the acoustic enclosure by damping vibration, changing the first modal vibration frequency of various panels, and controlling secondary sound emissions from the covered acoustic enclosure 3700. Coverings, such as covering 3724, and the coverings illustrated or described in additional embodiments, may have various additional functions independent of acoustics. For non-limiting examples, some functions include: an optional flat black surface for concealment in stage craft applications or a bright yellow-green surface for hazardous locations, a padding for safety around children, various protections from environmental influences such as ultraviolet electromagnetic radiation, scuff resistance, and adaptability for cleaning.

Different types of acoustically effective coverings 3724 may be applied to make covered cut sheet 3702. For non-limiting examples, textured, printed, patterned, and/or embossed vinyl, fabric, leather, metallic foil, plastic, wood veneer, carpet, acoustic damping materials, and/or composite sheets may be adhered, applied, or laminated onto plastic prepared cut sheet 102 to form covered cut sheet 3702, within the constraint that the acoustically effective covering 3724 must be sufficiently flexible and/or gathered to accommodate folding of the corrugated plastic during assembly. For further non-limiting examples, an applied paint, filler, rubberized coating, padding, upholstery, or wire mesh may be adhered, applied, or laminated onto plastic cut sheet 102 to form covered plastic cut sheet 3702, within the constraint that the acoustically effective covering 3724 must be sufficiently flexible and/or gathered to accommodate folding of the corrugated plastic during assembly.

Figure 37B:
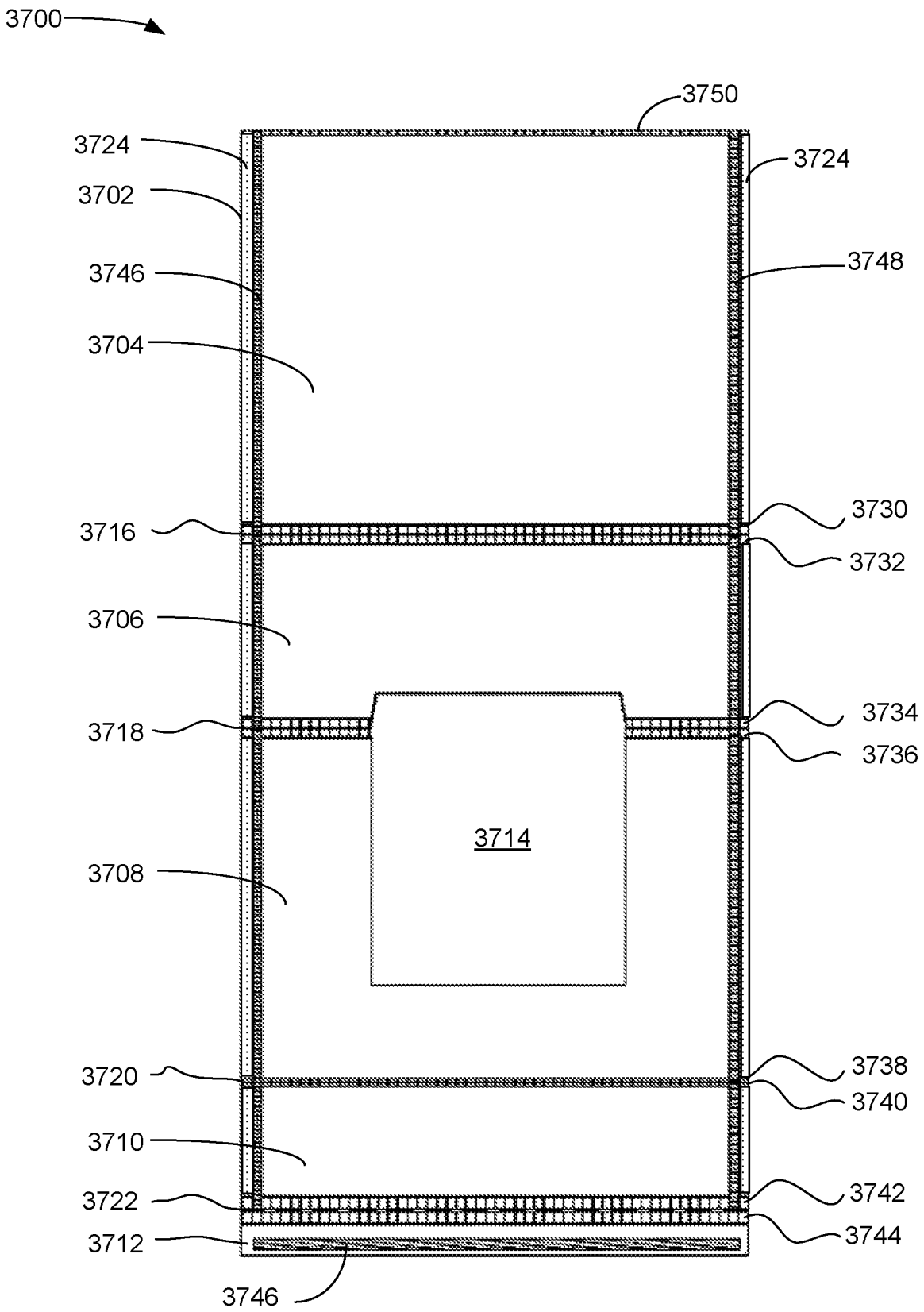
FIG. 37B is an interior side plan view illustrating the prepared cut sheet for forming the exemplary embodiment of the covered plastic acoustic enclosure of FIG. 37A, according to a preferred embodiment of the present invention.

FIG. 37B is an interior side plan view illustrating the covered cut sheet 3702 for forming the exemplary embodiment of the covered plastic acoustic enclosure 3700 of FIG. 37A, according to a preferred embodiment of the present invention. FIG. 37B is similar to FIG. 1 except it is covered on one side, which will be the exterior side, when assembled. Coverings 3724 can be divided into two broad classes: thick coverings 3724, which interfere with adhesives used to assemble the covered cut sheet 3702 into the covered plastic acoustic enclosure 3700; and thin coverings 3724, which do not interfere with adhesives used to assemble the covered cut sheet 3702 into the covered plastic acoustic enclosure 3700. A thick covering 3724 requires that adhesion surface 3726 for rims 212 and 204; and adhesion surface 3728 for adhesive strip 3746 not be covered, as shown. Groove sides 3730 and 3732, 3734 and 3736, 3738 and 3740, and 3742 and 3744, as well as side panel attachment features 3746 and 2748 are not covered. If a thin covering 3724 is receptive to adhesives, then uncovered adhesion surfaces 3726 and 3728 are not required. The preferred configuration is to leave the adhesion surfaces free of covering 3724, as shown. Covering 3724 also wraps around the side edges of plastic cut sheet 3702 except in the area of groove sides 3730 and 3732, 3734 and 3736, 3738 and 3740, 3742 and 3744, and extends onto the interior side of the covered plastic cut sheet 3702 to the outer edges of side panel attachment features 3746 and 3748. The top edge 3750 is beveled.

Figure 37C:
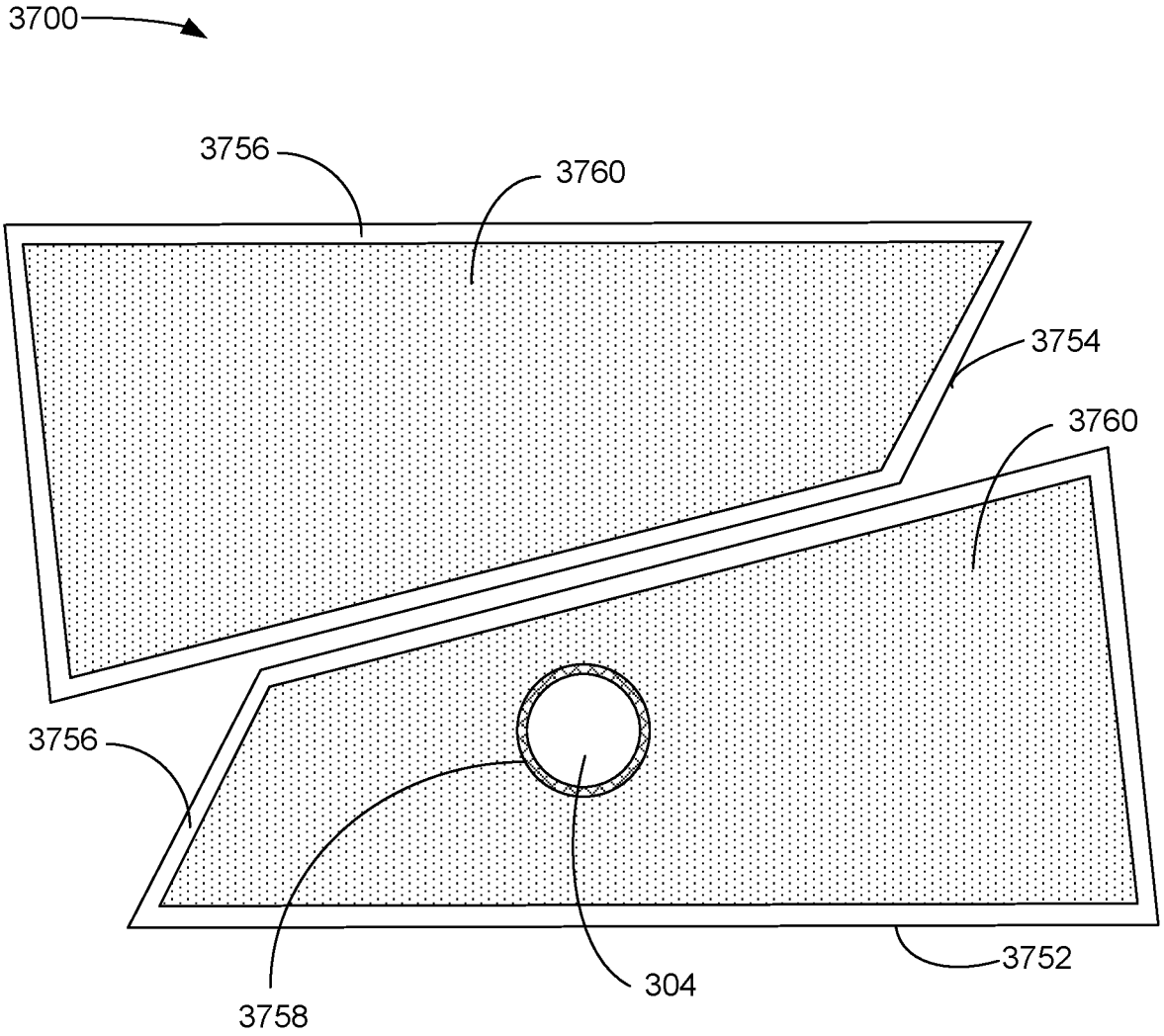
FIG. 37C is a top plan view illustrating an exemplary embodiment of covered side panels of the exemplary covered plastic acoustic enclosure of FIG. 37A, according to a preferred embodiment of the present invention.

FIG. 37C is a top plan view illustrating an exemplary embodiment of covered side panels 3752 and 3754 of the exemplary covered plastic acoustic enclosure 3700 of FIG. 37A, according to a preferred embodiment of the present invention. Covering 3760 is preferably the same as covering 3724, but may vary in some embodiments. For embodiments in which side panel attachment features 3746 and 3748 include grooves, a portion 3756 of the perimeter of each covered side panel 3752 and 3754 is left uncovered, as shown, for fitting into the grooves. Opening 304 is surrounded by an uncovered portion 3758 to accommodate a rim of speaker wiring connector plug 1004. Covered plastic acoustic enclosure 3700 is otherwise similar to plastic acoustic enclosure 100.

Figure 38:
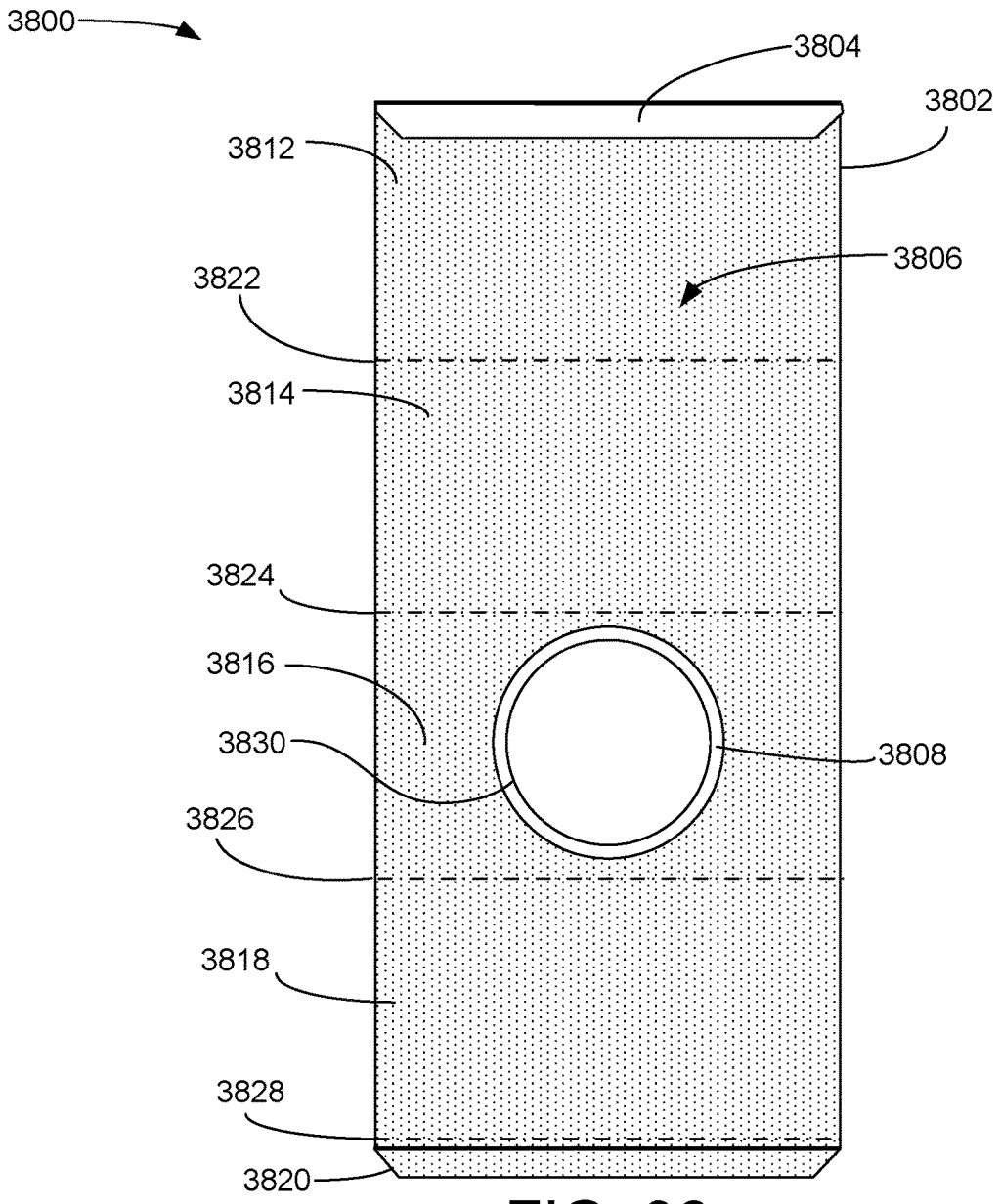
FIG. 38 is an exterior side plan view illustrating a prepared cut sheet of a second exemplary embodiment of the covered plastic acoustic enclosure, according to a preferred embodiment of the present invention.

FIG. 38 is an exterior side plan view illustrating a covered cut sheet 3802 of a second exemplary embodiment of the covered plastic acoustic enclosure 3800, according to a preferred embodiment of the present invention. Covered plastic acoustic enclosure 3800 is similar to plastic acoustic enclosure 1300, except that a cover 3806 has been applied to the cut sheet of corrugated plastic 1402, forming covered cut sheet 3802. Covered cut sheet 3802 has foldable covered panels 3812, 3814, 3816, 3818, and short adhesive panel 3820 separated by fold lines 3822, 3824, 3826, and 3828, as shown. An uncovered portion 3804 of covered back panel 3812 is left uncovered to receive adhesive strip 4006 (see FIG. 40) on covered short adhesive panel 3820 when the covered cut sheet 3802 is folded and assembled. An annular uncovered portion 3808 of covered front panel 3816 is left uncovered to receive a speaker basket rim 1304 during assembly.

Figure 39:
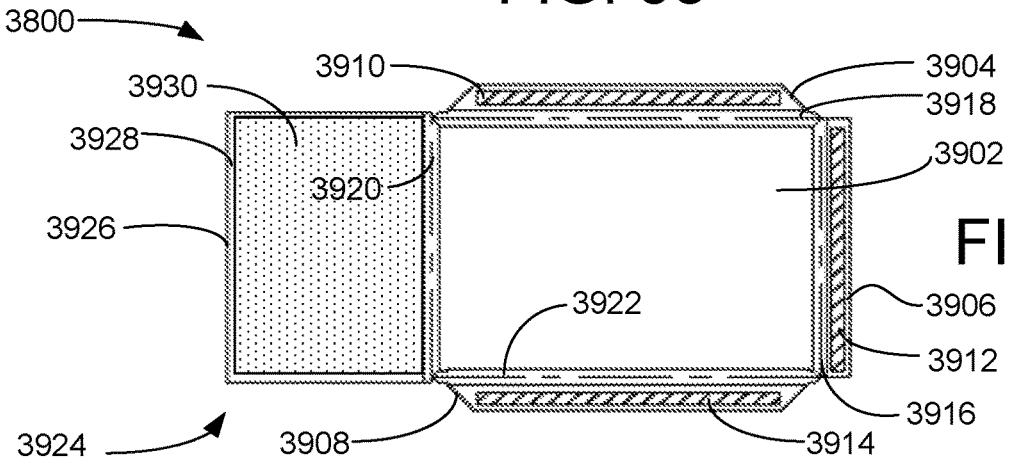
FIG. 39 is an inner side elevation view illustrating a prepared cut sheet for forming an exemplary plastic internal support of the second exemplary embodiment of the plastic acoustic enclosure of FIG. 38, according to a preferred embodiment of the present invention.

FIG. 39 is an inner side elevation view illustrating an internal support structure 3924 of the second exemplary embodiment of the plastic acoustic enclosure 3800 of FIG. 38, according to a preferred embodiment of the present invention. FIG. 39 illustrates a covered version of the internal support structure 1534. Covered left side panel 3926 includes a cover 3930, which may be the same as covering 3806, and an uncovered edge portion 3928 adjacent the perimeter on three sides, as shown. Covered left side panel 3926 is coupled to interior rear panel 3902 across fold line 3920, which includes attachment feature 4008, shown as channels (see FIG. 40) in a manner similar to the channels of FIG. 14. Interior rear panel 3902 has top adhesive flange 3904, right side adhesive flange 3906, and bottom adhesive flange 3908 connected across grooved fold lines 3918, 3916, and 3922, respectively. Top adhesive flange 3904, right side adhesive flange 3906, and bottom adhesive flange 3908 support adhesive strips 3910, 3912, and 3914, with release layers, respectively. For embodiments in which attachment feature 4008 includes a channel, uncovered edge portion 3928 of covered left side panel 3926 not coupled to interior rear panel 3902 are received in attachment feature 4008, when assembled. In various additional embodiments, interior rear panel 3902 may also be covered on one or both sides.

Figure 40:
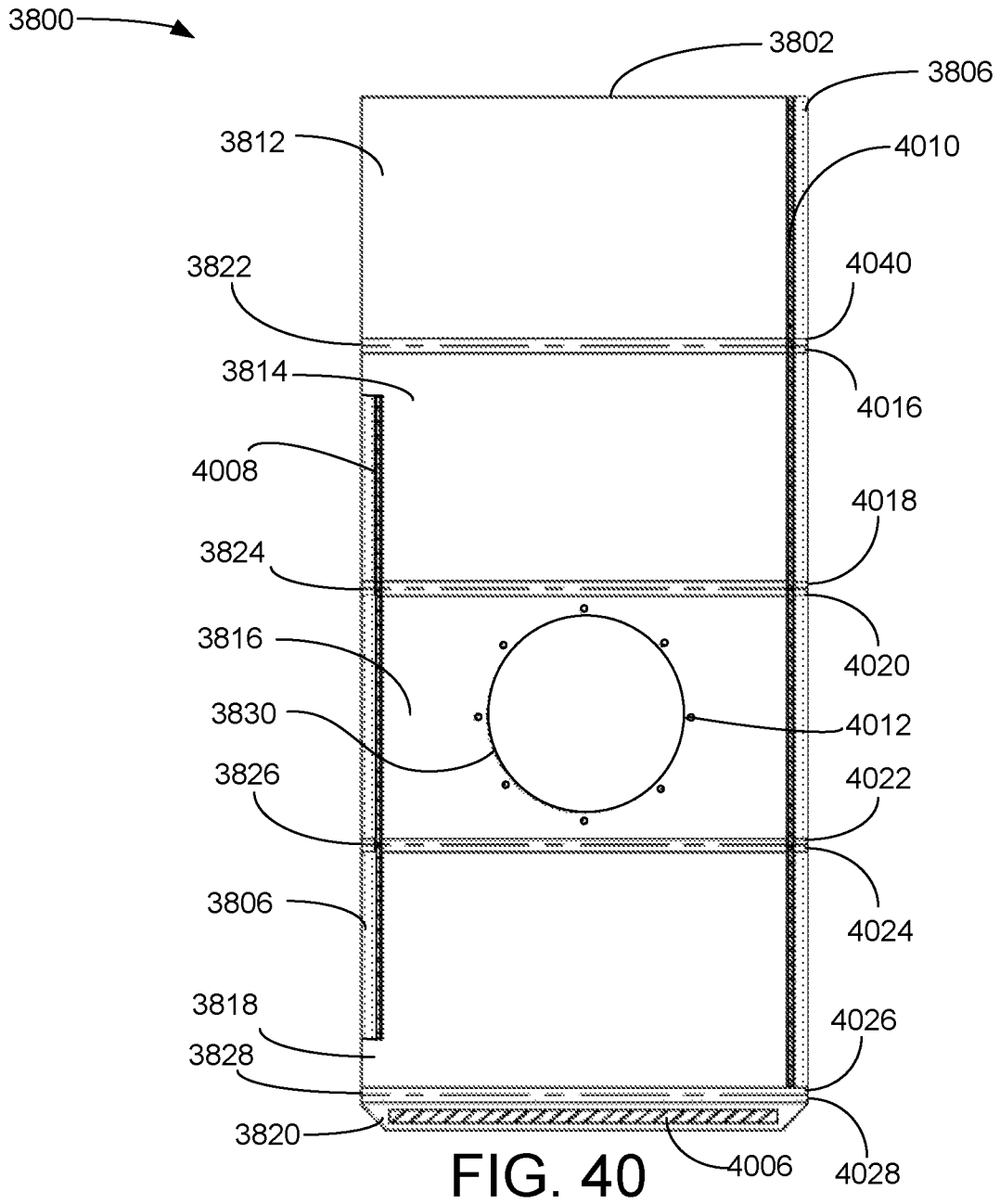
FIG. 40 is an exterior side plan view illustrating a prepared cut sheet of a second exemplary embodiment of the covered plastic acoustic enclosure of FIG. 38, according to a preferred embodiment of the present invention.

FIG. 40 is an exterior side plan view illustrating a prepared cut sheet 3802 of a second exemplary embodiment of the covered plastic acoustic enclosure 3800 of FIG. 38, according to a preferred embodiment of the present invention. Single covered cut sheet 3802, preferably of corrugated plastic, includes covered back panel 3812, covered bottom panel 3814, covered front panel 3816, covered top panel 3818, and covered short adhesive panel 3820. Fold line 3822 is the centerline of a V-shaped grove having groove sides 4040 and 4016, which are angled such that, when covered back panel 3812 is folded with respect to covered bottom panel 3814, the two panels 3812 and 3814 close the groove sides 4040 and 4016 together to make a right angle joint. Fold line 3824 is the centerline of a V-shaped grove having groove sides 4018 and 4020, which are angled such that, when covered bottom panel 3814 is folded with respect to covered front panel 3816, the two panels 3814 and 3816 close the groove sides 4018 and 4020 together to make a right angle joint. Fold line 3826 is the centerline of a V-shaped grove having groove sides 4022 and 4024, which are angled such that, when covered front panel 3816 is folded with respect to covered top panel 3818, the two panels 3816 and 3818 close the groove sides 4022 and 4024 together to make a right angle joint. Fold line 3828 is the centerline of a V-shaped grove having groove sides 4026 and 4028, which are angled such that, when covered top panel 3818 is folded with respect to covered short adhesive panel 3820, the two panels 3819 and 3820 close the groove sides 4026 and 4028 together to make a right angle joint. In various embodiments, a sound deadening material may be applied to any of the groove sides 4040, 4016, 4018, 4020, 4022, 4024, 4026, and 4028 to avoid plastic-on-plastic vibration noise. In various embodiments, the sound deadening material may be an adhesive sound deadening material. Covered short adhesive panel 3820 supports an adhesive strip 4006 with a release layer for securing covered back panel 3812, covered bottom panel 3814, covered front panel 3816, covered top panel 3818, and covered short adhesive panel 3820 in a folded configuration. Preferably, the adhesive is permanent. Side panel attachment features 4008 and 4010 assist in securing covered left and right side panels 3926 and 4102 (see FIG. 41), respectively. Side panel attachment features 4008 and 4010 may be channels, adhesive strips with release layers, channels with adhesive strips with release layers, adhesive sound deadening materials with release layers, or channels with adhesive sound deadening materials with release layers. Covered front panel 3816 has a speaker opening 3830 and multiple fastener openings 4012 (one of eight labeled). In various embodiments, other panel sizes, shapes, and folding angles may be used. However, the present embodiment is preferred for simplicity of design and low cost.

Figure 41:
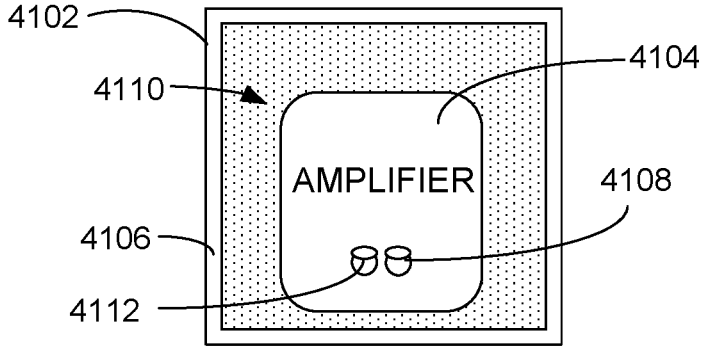
FIG. 41 is a front elevation view illustrating an exemplary amplifier-supporting end panel of the second exemplary embodiment of the covered plastic acoustic enclosure of FIG. 38, according to a preferred embodiment of the present invention.

FIG. 41 is a front elevation view illustrating an exemplary amplifier-supporting covered right side panel 4102 of the second exemplary embodiment of the covered plastic acoustic enclosure 3800 of FIG. 38, according to a preferred embodiment of the present invention. Covered right side panel 4102 has a covering 4110 that leaves an uncovered portion 4106 adjacent to the perimeter for insertion into side panel attachment feature 4010 in an embodiment where side panel attachment feature 4010 is a channel and covering 4110 is thick. A "thick covering" is one which would interfere with inserting the covered right side panel 4102 into the channel 4010 if the covered right side panel 4102 was completely covered. For non-limiting example, a covering 4110 made of carpet is a thick covering. A thin covering 4110, such as a metal foil covering 4110, may be received in a channel embodiment of the side panel attachment feature 4010 with appropriate minor variation in the width of the channel. The portion of covered right side panel 4102 where the amplifier 4104 is attached may have a thin covering 4110 or no thick covering 4110. Audio signal wire connectors 4108 and 4112 allow direct connection to an audio source.

Figure 42:
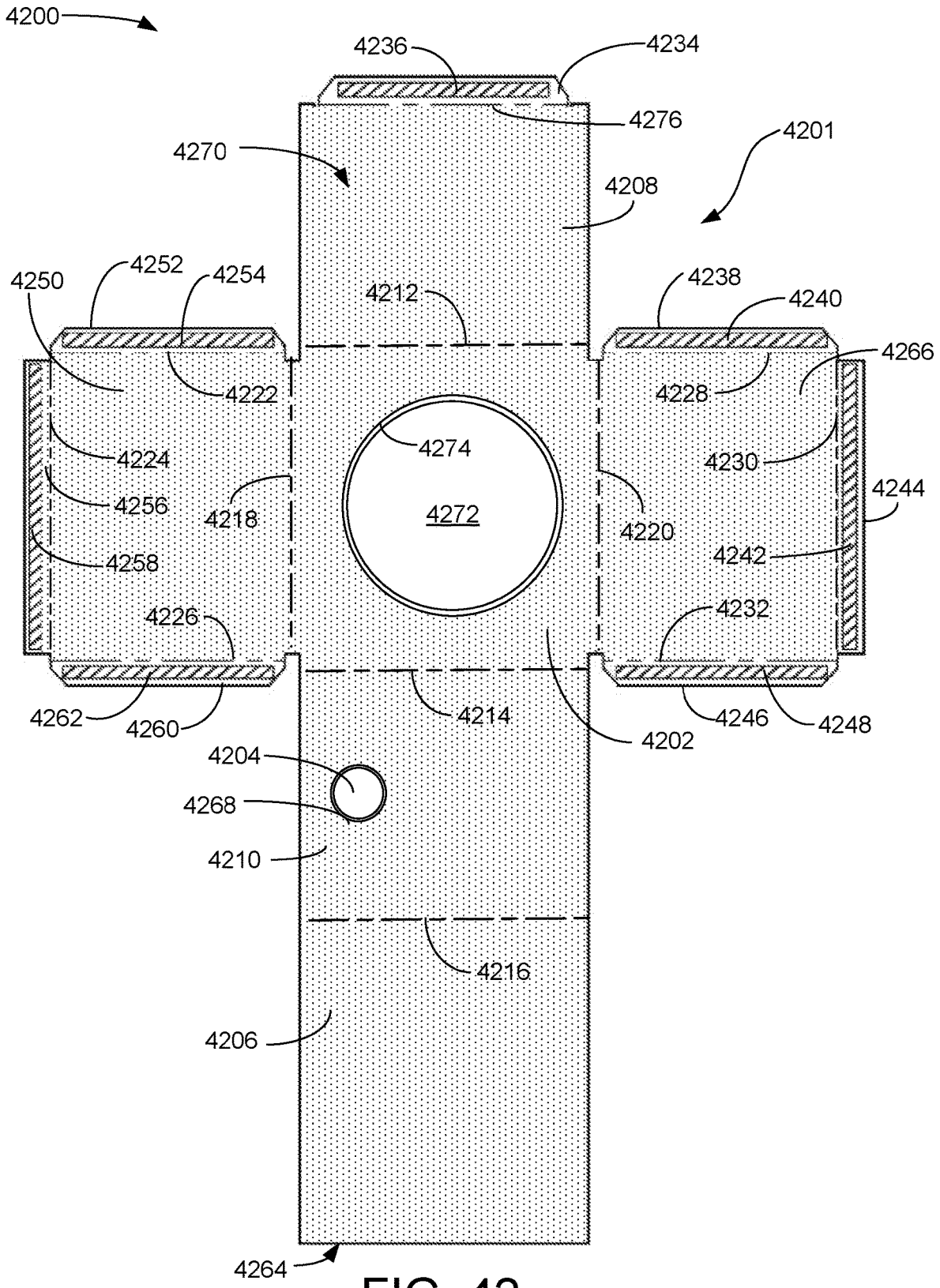
FIG. 42 is an exterior side plan view illustrating a prepared cut sheet for forming a third exemplary embodiment of a covered plastic acoustic enclosure, according to a preferred embodiment of the present invention.

FIG. 42 is an exterior side plan view illustrating a prepared panel 4201 for forming a third exemplary embodiment of a covered plastic acoustic enclosure 4200, according to a preferred embodiment of the present invention. Covered plastic acoustic enclosure 4200 is similar to plastic acoustic enclosure 2300, except that a cover 3806 has been applied to the cut sheet of corrugated plastic 2401, forming covered cut sheet 3802. Covered top panel 4266 is a version of the embodiment 2300 of FIG. 24 that is covered on one side. Corrugated plastic cut sheet 4201 includes covered front panel 4202, covered left side panel 4210, covered rear panel 4206, covered right side panel 4208, covered top panel 4266, and covered bottom panel 4250. Fold line 4212 is the aligned to the centerline of a V-shaped grove on the opposite side of the corrugated plastic cut sheet 4201 (similar to those shown in detail in FIG. 1 and FIG. 14, and not repeated here). Fold line 4212 is between covered right side panel 4208 and covered front panel 4202. The V-shaped groove is similar to those described in regard to previous embodiments and has groove sides which are angled such that, when covered right side panel 4208 is folded with respect to covered front panel 4202, the two panels 4208 and 4202 close the groove sides together to make a right angle. Fold line 4214 is the centerline of a V-shaped grove on the opposite side of the corrugated plastic cut sheet 4201 (similar to those shown in detail in FIG. 1 and FIG. 14, and not repeated here). Fold line 4214 is between covered left side panel 4210 and covered front panel 4202. The V-shaped groove is similar to those describes in regard to previous embodiments and has groove sides which are angled such that, when covered left side panel 4210 is folded with respect to covered front panel 4202, the two panels 4210 and 4202 close the groove sides together to make a right angle. Fold line 4216 is between covered left side panel 4210 and covered rear panel 4206. The V-shaped groove on the opposite side of the corrugated plastic cut sheet 4201 is similar to those described in regard to previous embodiments and has groove sides which are angled such that, when covered left side panel 4210 is folded with respect to covered rear panel 4206, the two panels 4210 and 4206 close the groove sides together to make a right angle. Fold line 4220 is between covered top panel 4266 and covered front panel 4202. The V-shaped groove on the opposite side of the covered corrugated plastic cut sheet 4201 is similar to those described in regard to previous embodiments and has groove sides which are angled such that, when covered top panel 4266 is folded with respect to covered front panel 4202, the two panels 4266 and 4202 close the groove sides together to make a right angle. Fold line 4218 is between covered bottom panel 4250 and covered front panel 4202. The V-shaped groove on the opposite side of the covered corrugated plastic cut sheet 4201 is similar to those described in regard to previous embodiments and has groove sides which are angled such that, when covered bottom panel 4250 is folded with respect to covered front panel 4202, the two panels 4250 and 4202 close the groove sides together to make a right angle. In a various embodiments, a sound deadening material may be applied to any of the groove sides to avoid plastic-on-plastic vibration noise. Fold lines 4212, 4214, 4216, 4218, 4220, and 4276 fold away from the observer (into of the page) of FIG. 42, as do fold lines 4222, 4224, 4226, 4228, 4230, and 4232.

Covered top panel 4266 includes right side top adhesive flange 4238, rear side top adhesive flange 4244, and left side top adhesive flange 4246 which are connected across fold lines 4228, 4230, and 4232, respectively. Right side top adhesive flange 4238, rear side top adhesive flange 4244, and left side top adhesive flange 4246 support adhesive strips 4240, 4242, and 4248, with release layers, respectively. Covered bottom panel 4250 includes right side bottom adhesive flange 4252, rear side bottom adhesive flange 4256, and left side bottom adhesive flange 4260 which are connected across grooved fold lines 4222, 4224, and 4226, respectively. Right side bottom adhesive flange 4252, rear side bottom adhesive flange 4256, and left side bottom adhesive flange 4260 support adhesive strips 4254, 4258, and 4262, with release layers, respectively. Rear panel edge 4264 is not beveled in this embodiment. Covered right side panel 4208 includes adhesive flange 4234 which is connected across fold line 4276 and supports adhesive strip 4236.

Edges of covered rear panel 4206, covered right side panel 4208, and covered left side panel 4210 that do not have an adhesive flange are preferably covered with covering 4270. Connector plug opening 4204 in covered left side panel 4210 receives connector plug 2314 and an uncovered annular portion 4268 of covered left side panel 4210 accommodates a rim of connector plug 2314 in embodiments having a thick covering 4270. Speaker opening 4272 in covered front panel 4202 receives a loudspeaker and an uncovered annular portion 4274 of covered front panel 4202 accommodates a rim of a speaker 2308 in embodiments having a thick covering 4270.

Figure 43:
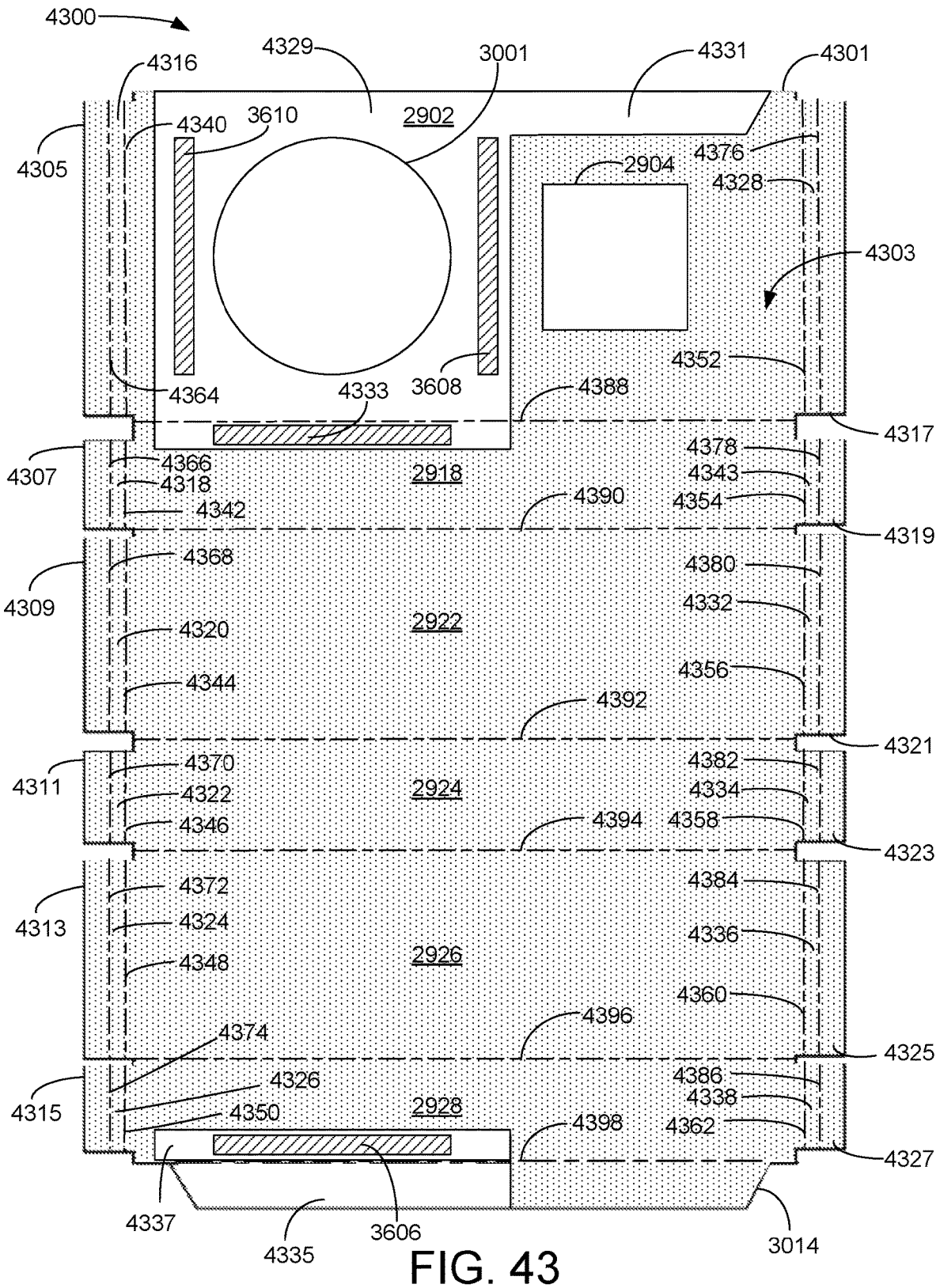
FIG. 43 is an exterior side plan view illustrating a prepared cut sheet for forming a fourth exemplary embodiment of the covered plastic acoustic enclosure, according to a preferred embodiment of the present invention.

FIG. 43 is an exterior side plan view illustrating a prepared panel for forming a fourth exemplary embodiment of the covered plastic acoustic enclosure 4300, according to a preferred embodiment of the present invention. Covered plastic acoustic enclosure 4300 is preferably a partially covered version of plastic acoustic enclosure 2900. A covered sheet of corrugated plastic 4301 has seven panels: 2902, 2918, 2922, 2924, 2926, 2928, and 3014, delineated by panel fold lines 4388, 4390, 4392, 4394, 4396, and 4398, respectively. Front panel 2902 has a speaker opening 3001 and a tweeter opening 2904, as shown. Front panel 2902 includes a top front panel double-folding adhesive flange 4317 having first and second parallel fold lines 4352 and 4376 with a top edge 4328 there between. Front panel 2902 includes a bottom front panel double-folding adhesive flange 4305 having first and second parallel fold lines 4340 and 4364 with a bottom edge 4316 there between. Covering 4303 does not cover the uncovered portion 4329 that will be covered by speaker support panel 2910 during assembly of an embodiment with a thick covering 4303. Adhesive strips 3608, 3610, and 3606, with release layers, secure the speaker support panel 2910.

Left side narrow panel 2918 is delineated from front panel 2902 by fold line 4388, which is similar to fold lines shown in detail in FIG. 1 and FIG. 14 with V-shaped grooves on the opposite side of the covered corrugated plastic sheet 4301. Left side narrow panel 2918 includes a top left-side narrow panel double-folding adhesive flange 4319 having first and second parallel fold lines 4354 and 4378 with a top edge 4343 there between. Left side narrow panel 2918 includes a bottom left side narrow panel double-folding adhesive flange 4307 having first and second parallel fold lines 4342 and 4366 with a bottom edge 4318 there between. Left side narrow panel 2918 includes an extension of uncovered portion 4329 and an adhesive strip 4333 for securing speaker support panel 2910, as shown.

Left side wide panel 2922 is delineated from left side narrow panel 2918 by fold line 4390, which is similar to fold lines shown in detail in FIG. 1 and FIG. 14 with V-shaped grooves on the opposite side of covered corrugated plastic sheet 4301. Left side wide panel 2922 includes a top left-side wide panel double-folding adhesive flange 4321 having first and second parallel fold lines 4356 and 4380 with a top edge 4332 there between. Left side wide panel 2922 includes a bottom left-side wide panel double-folding adhesive flange 4309 having first and second parallel fold lines 4344 and 4368 with a top edge 4320 there between.

Narrow back panel 2924 is delineated from left side wide panel 2922 by fold line 4392, which is similar to fold lines shown in detail in FIG. 1 and FIG. 14 with V-shaped grooves on the opposite side of covered corrugated plastic sheet 4301. Narrow back panel 2924 includes a top narrow back panel double-folding adhesive flange 4323 having first and second parallel fold lines 4358 and 4382 with a top edge 4334 there between. Narrow back panel 2924 includes a bottom narrow back panel double-folding adhesive flange 4311 having first and second parallel fold lines 4346 and 4370 with a bottom edge 4322 there between.

Right side wide panel 2926 is delineated from narrow back panel 2924 by fold line 4394, which is similar to fold lines shown in detail in FIG. 1 and FIG. 14 with V-shaped grooves on the opposite side of covered corrugated plastic sheet 4301. Right side wide panel 2926 includes a top right-side wide panel double-folding adhesive flange 4325 having first and second parallel fold lines 4360 and 4384 with a top edge 4336 there between. Right side wide panel 2926 includes a bottom right-side wide panel double-folding adhesive flange 4313 having first and second parallel fold lines 4348 and 4372 with a bottom edge 4324 there between.

Right side narrow panel 2928 is delineated from right side wide panel 2926 by fold line 4396, which is similar to fold lines shown in detail in FIG. 1 and FIG. 14 with V-shaped grooves on the opposite side of covered corrugated plastic sheet 4301. Right side wide panel 2926 includes a top right side narrow panel double-folding adhesive flange 4327 having first and second parallel fold lines 4362 and 4386 with a top edge 4338 there between. Right side wide panel 2926 includes a bottom right side narrow panel double-folding adhesive flange 4315 having first and second parallel fold lines 4350 and 4374 with a bottom edge 4326 there between. Right side narrow panel 2928 has an uncovered portion 4337 which supports an adhesive strip, preferably with a release layer, for securing speaker support panel 2910.

Adhesive panel 3014 is delineated from right side narrow panel 2928 by fold line 4398, which is similar to fold lines shown in detail in FIG. 1 and FIG. 14 with V-shaped grooves on the opposite side of covered corrugated plastic sheet 4301. Adhesive panel 3014 has an uncovered portion 4335, which will be covered by speaker support panel 2910 when installed. Assembly of covered plastic acoustic enclosure 4300 is similar to assembly of plastic acoustic enclosure 2900.

In a particular embodiment, a covering 4303 that is thin and compatible with adhesive strips 3606, 3608, 3610, and 4333 may be used to completely cover the side of covered corrugated plastic sheet 4301 that will be the exterior surfaces, when assembled.

Figure 44:
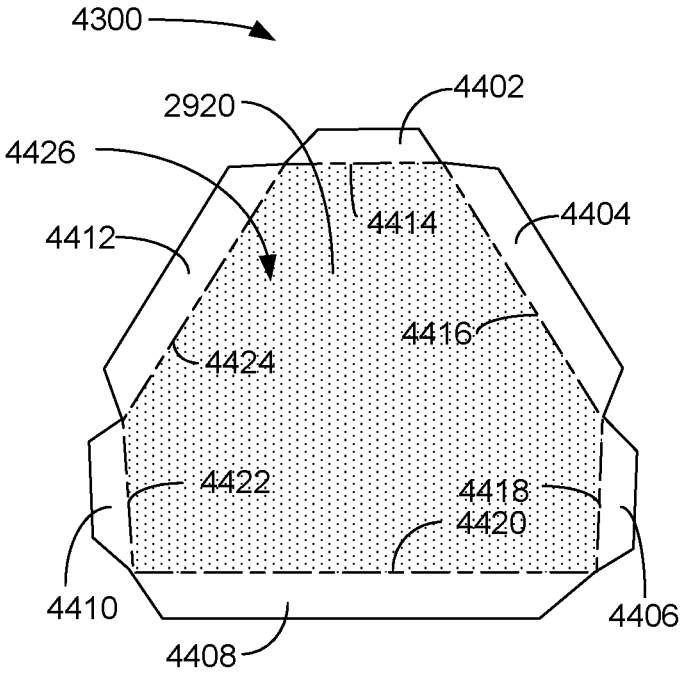
FIG. 44 is an outer side plan view illustrating an exemplary top panel of the fourth exemplary embodiment of the plastic acoustic enclosure of FIG. 43, according to a preferred embodiment of the present invention.

FIG. 44 is an outer side plan view illustrating an exemplary top panel of the fourth exemplary embodiment of the plastic acoustic enclosure 4300 of FIG. 43, according to a preferred embodiment of the present invention. Top panel front flange 4408 is delineated from top panel 2920 by fold line 4420, which is similar to fold lines shown in detail in FIG. 1 and FIG. 14, which details are omitted here to simplify the drawing. Left narrow panel flange 4410 is delineated from top panel 2920 by fold line 4422. Left wide panel flange 4412 is delineated from top panel 2920 by fold line 4424. Narrow back panel flange 4402 is delineated from top panel 2920 by fold line 4414. Right side wide panel flange 4404 is delineated from top panel 2920 by fold line 4416. Right side narrow panel flange 4406 is delineated from top panel 2920 by fold line 4418. Folding along fold line 4420 is illustrated in FIGS. 30C-30D, and is exemplary of fold lines generally. Thick covering 4426 does not extend onto the flanges 4402, 4404, 4406, 4408, 4410, and 4412. In a particular embodiment, a thin covering 4426 that is compatible with adhesives may cover the flanges 4402, 4404, 4406, 4408, 4410, and 4412.

The primary focus of the illustrated embodiments has been to provide a covering on the foldable plastic sheet to obtain the economic advantage of applying the covering during production of the cut sheets of corrugated plastic, and to obtain a light-weight acoustic enclosure. Various processes beyond mass production, such as print on demand and custom covering design developed by a customer on a supplier's website, are compatible with the present invention.

The invention claimed is:

1. A covered plastic acoustic enclosure, comprising:

a. a sheet of foldable corrugated plastic having:
   i. a first side that will be an exterior side when said sheet is folded; and
   ii. a second side that will be an interior side when said sheet is folded;
   iii. a plurality of panels;

b. a plurality of fold lines delineating said plurality of panels;

c. an acoustically effective covering attached on at least a portion of said first side, wherein said covering is not corrugated plastic;

d. wherein said acoustically effective covering comprises one of:
   i. an acoustically damping material;
   ii. a material for changing the first modal vibration frequency of at least one panel of said plurality of panels; and
   iii. a material for controlling secondary sound emissions from said covered plastic acoustic enclosure;

e. at least one of:
   i. at least one opening in said sheet of corrugated plastic;
   ii. at least one speaker support shaped to correspond to said at least one opening; and
   iii. wherein said at least one speaker support is not a portion of said sheet of foldable corrugated plastic;

f. top and bottom panels of said plurality of panels extending from opposing sides of, and being of one piece with, a front panel of said plurality of panels, said top panel and said bottom panel each having three adhesive foldable flanges, each adhesive foldable flange of said three adhesive foldable flanges extending from three respective edges of each of said top and bottom panel; and g. wherein a speaker support of said at least one speaker support comprises a speaker support ring.

2. The covered plastic acoustic enclosure of claim 1, comprising at least one panel of corrugated plastic, in addition to said sheet of foldable corrugated plastic, configured to become an internal part of said covered plastic acoustic enclosure upon assembly.

3. The covered plastic acoustic enclosure of claim 2, wherein at least one said fold line of said plurality of fold lines comprises a centerline of a V-shaped groove in said at least one additional panel of corrugated plastic.

4. The covered plastic acoustic enclosure of claim 2, comprising an audio amplifier supported on one of:

a. said sheet of corrugated plastic; and b. a panel of said at least one additional panel of corrugated plastic.

5. The covered plastic acoustic enclosure of claim 2, comprising at least one adhesive foldable flange extending from said at least one additional panel of corrugated plastic.

6. The covered plastic acoustic enclosure of claim 1, comprising at least one adhesive positioned to secure said sheet of corrugated plastic in a folded configuration.

7. The covered plastic acoustic enclosure of claim 1, wherein each said fold line of said plurality of fold lines comprises a centerline of a V-shaped groove in said second side of said sheet of corrugated plastic.

8. The covered plastic acoustic enclosure of claim 7, comprising acoustic dampening material applied to at least one of:

a. said V-shaped groove;

b. a portion of said sheet of corrugated plastic; and c. a channel in said sheet of corrugated plastic.

9. The covered plastic acoustic enclosure of claim 1, wherein said at least one speaker support supports said speaker at least partially within said plastic acoustic enclosure, when assembled.

10. The covered plastic acoustic enclosure of claim 9, comprising a rim on said at least one speaker support, wherein at least a portion of said rim is configured to rest on an environmental surface when said plastic acoustic enclosure is assembled and placed in an operational orientation when said plastic acoustic enclosure is assembled and placed in an operational orientation.

11. The covered plastic acoustic enclosure of claim 9, comprising a plurality of adhesive applications adapted to adhere said speaker support to said sheet of corrugated plastic.

12. The covered plastic acoustic enclosure of claim 1, comprising:

a. two covered corrugated plastic side panels; and b. wherein said at least one speaker support comprises:
   i. a speaker support fixture having:
      1) a speaker opening; and
      2) at least one straight side; and
   ii. a rim extending angularly from said at least one straight side of said speaker support fixture.

13. The covered plastic acoustic enclosure of claim 1, comprising:

a. a corrugated plastic interior support that is not a portion of said sheet of foldable corrugated plastic; and
b. wherein said at least one speaker support comprises a speaker support ring.

14. The covered plastic acoustic enclosure of claim 1, comprising:
a. a corrugated plastic panel, that is not a portion of said sheet of foldable corrugated plastic, foldable to form a tweeter horn, when assembled; and
b. wherein said at least one speaker support comprises a speaker support panel having an annular flange operable to be counter sunk into said at least one opening in said sheet of corrugated plastic.

15. A covered plastic acoustic enclosure, comprising:
a. a sheet of foldable corrugated plastic having:
i. a first side that will be an exterior side when said sheet is folded; and
ii. a second side that will be an interior side when said sheet is folded;
iii. a plurality of panels;
b. a plurality of fold lines delineating said plurality of panels;
c. an acoustically effective covering attached on at least a portion of said first side, wherein said covering is not corrugated plastic;
d. wherein said acoustically effective covering comprises one of:
i. an acoustically damping material;
ii. a material for changing the first modal vibration frequency of at least one panel of said plurality of panels; and
iii. a material for controlling secondary sound emissions from said covered plastic acoustic enclosure; and
e. at least one of:
i. at least one opening in said sheet of corrugated plastic; and
ii. at least one speaker support shaped to correspond to said at least one opening;
f. wherein each said fold line of said plurality of fold lines comprises a centerline of a V-shaped groove in said second side of said sheet of corrugated plastic;
g. at least one adhesive strip adapted to secure said sheet of corrugated plastic in a folded configuration, when assembled;
h. at least one adhesive foldable flange extending from said at least one panel of said plurality of panels of said sheet of foldable corrugated plastic;
i. at least one speaker support supporting a speaker at least partially within said plastic acoustic enclosure, when assembled;
j. an angularly extending rim on said at least one speaker support, wherein at least a portion of said rim is configured to rest on an environmental surface when said covered plastic acoustic enclosure is assembled and placed in an operational orientation; and
k. a plurality of adhesive strips adapted to adhere said at least one speaker support to either said sheet of corrugated plastic or said covering, when assembled.

16. The covered plastic acoustic enclosure of claim 15 comprising acoustic dampening material applied to at least one of:
a. said V-shaped groove;
b. a portion of said sheet of corrugated plastic; and
c. a channel in said sheet of corrugated plastic.

17. The covered plastic acoustic enclosure of claim 15, comprising an audio amplifier supported on one of:
a. said sheet of corrugated plastic;
b. a panel of said at least one additional panel of corrugated plastic; and
c. said covering.

18. A covered plastic acoustic enclosure, comprising:
a. a sheet of foldable corrugated plastic having:
i. a first side that will be an exterior side when said sheet is folded;
ii. a second side that will be an interior side when said sheet is folded; and
iii. a plurality of panels;
b. a plurality of fold lines delineating said plurality of panels;
c. an acoustically effective covering attached on at least a portion of said first side, wherein said covering is not corrugated plastic;
d. wherein said acoustically effective covering comprises one of:
i. an acoustically damping material;
ii. a material for changing the first modal vibration frequency of at least one panel of said plurality of panels; and
iii. a material for controlling secondary sound emissions from said covered plastic acoustic enclosure; and
e. at least one of:
i. at least one opening in said sheet of corrugated plastic; and
ii. at least one speaker support shaped to correspond to said at least one opening;
f. wherein each said fold line of said plurality of fold lines comprises a centerline of a V-shaped groove in said second side of said sheet of corrugated plastic;
g. at least one adhesive strip adapted to secure said sheet of corrugated plastic in a folded configuration, when assembled;
h. at least one adhesive foldable flange extending from said at least one panel of said sheet of foldable corrugated plastic; and
i. further comprising at least one of:
i. at least one corrugated plastic side panel adapted to form a part of said plastic acoustic enclosure, when assembled;
ii. said at least one speaker support comprising a speaker support ring adapted to form a part of said plastic acoustic enclosure, when assembled;
iii. said at least one speaker support comprising a speaker support panel adapted to form a part of said plastic acoustic enclosure, when assembled;
iv. said at least one speaker support comprising a speaker support fixture adapted to form a part of said plastic acoustic enclosure, when assembled;
v. a corrugated plastic interior support adapted to form a part of said plastic acoustic enclosure, when assembled;
vi. top and bottom panels of said plurality of panels of said sheet of corrugated plastic extending from opposing sides of, and being of one piece with, a front panel of said plurality of panels, said top panel and said bottom panel each having three adhesive foldable flanges, each adhesive foldable flange of said three adhesive foldable flanges extending from one of three respective edges of each of said top and bottom panel, respectively;
vii. an audio amplifier supported on one of;
1) a corrugated plastic panel of said at least one corrugated plastic side panel; and 2) said corrugated plastic sheet;

viii. acoustic dampening material applied to one of:

1) said V-shaped groove;

2) a portion of said sheet of corrugated plastic; and 3) a channel in said sheet of corrugated plastic; and ix. attachment features on said sheet of corrugated plastic, comprising at least one of:

1) channels;

2) adhesive strips;

3) said adhesive strips with release layers;

4) said channels with adhesive strips;

5) said channels with adhesive strips with release layers;

6) adhesive sound deadening materials;

7) said adhesive sound deadening materials with release layers;

8) said channels with adhesive sound deadening materials; and 9) said channels with adhesive sound deadening materials with release layers;

j. top and bottom panels of said plurality of panels extending from opposing sides of, and being of one piece with, a front panel of said plurality of panels, said top panel and said bottom panel each having three adhesive foldable flanges, each adhesive foldable flange of said three adhesive foldable flanges extending from three respective edges of each of said top and bottom panel; and k. wherein a speaker support of said at least one speaker support comprises a speaker support ring.

* * * * *